US007090731B2

(12) United States Patent
Kashima et al.

(10) Patent No.: US 7,090,731 B2
(45) Date of Patent: Aug. 15, 2006

(54) HIGH STRENGTH STEEL SHEET HAVING EXCELLENT FORMABILITY AND METHOD FOR PRODUCTION THEREOF

(75) Inventors: Takahiro Kashima, Hyogo (JP); Shunichi Hashimoto, Hyogo (JP); Shushi Ikeda, Hyogo (JP); Hiroshi Akamizu, Hyogo (JP); Koh-ichi Sugimoto, Nagano (JP); Akihiko Nagasaka, Nagano (JP); Akinobu Kanda, Nagano (JP); Ryo Kikuchi, Nagano (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 10/470,752

(22) PCT Filed: Jan. 31, 2002

(86) PCT No.: PCT/JP02/00744

§ 371 (c)(1),
(2), (4) Date: Jul. 31, 2003

(87) PCT Pub. No.: WO02/061161

PCT Pub. Date: Aug. 8, 2002

(65) Prior Publication Data

US 2004/0074575 A1 Apr. 22, 2004

(30) Foreign Application Priority Data

| | | |
|---|---|---|
| Jan. 31, 2001 | (JP) | 2001-023401 |
| Jan. 31, 2001 | (JP) | 2001-023402 |
| Feb. 9, 2001 | (JP) | 2001-034335 |
| Feb. 9, 2001 | (JP) | 2001-034336 |
| Feb. 28, 2001 | (JP) | 2001-055639 |
| Feb. 28, 2001 | (JP) | 2001-055640 |
| Feb. 28, 2001 | (JP) | 2001-055641 |
| Feb. 28, 2001 | (JP) | 2001-055642 |
| Aug. 31, 2001 | (JP) | 2001-264175 |
| Sep. 28, 2001 | (JP) | 2001-300502 |
| Sep. 28, 2001 | (JP) | 2001-300503 |
| Sep. 28, 2001 | (JP) | 2001-300504 |
| Sep. 28, 2001 | (JP) | 2001-300505 |

(51) Int. Cl.

| | |
|---|---|
| ***C22C 38/02*** | (2006.01) |
| ***C22C 38/06*** | (2006.01) |
| ***C21D 8/02*** | (2006.01) |

(52) U.S. Cl. ..... 148/320; 148/333; 148/334; 148/335; 148/336; 148/533; 148/602; 148/661; 148/663; 148/651; 148/652; 148/654

(58) Field of Classification Search ..... 148/320, 148/333–336, 533, 537, 661, 663, 651, 652, 148/654

See application file for complete search history.

(56) References Cited

U.S. PATENT DOCUMENTS

| | | | |
|---|---|---|---|
| 6,280,538 | B1 | 8/2001 | Soshiroda et al. |
| 6,306,527 | B1 | 10/2001 | Ikeda et al. |
| 6,709,535 | B1 | 3/2004 | Utsumi et al. |

FOREIGN PATENT DOCUMENTS

| | | | |
|---|---|---|---|
| EP | 0 881 306 | A1 | 12/1998 |
| EP | 0 997 548 | | 5/2000 |
| EP | 1096029 | * | 11/2000 |
| EP | 1 072 689 | A1 | 1/2001 |
| JP | 7-252592 | | 10/1995 |
| JP | 11-350064 | | 12/1999 |
| JP | 2000-144311 | | 5/2000 |
| JP | 2001-3150 | | 1/2001 |
| JP | 2001-207235 | * | 7/2004 |

OTHER PUBLICATIONS

U.S. Appl. No. 10/470,752, filed Jul. 31, 2003, Kashima et al.
U.S. Appl. No. 10/262,317, filed Oct. 2, 2002, Ikeda et al.
U.S. Appl. No. 10/639,588, filed Aug. 13, 2003, Ikeda et al.
U.S. Appl. No. 10/626,612, filed Jul. 25, 2003, Ikeda et al.
U.S. Appl. No. 10/614,821, filed Jul. 9, 2003, Akamizu et al.
U.S. Appl. No. 10/785,080, filed Feb. 25, 2004, Ikeda et al.

U.S. Appl. No. 10/470/752, filed Jul. 13, 2003, Kashima et al.
Patent Abstracts of Japan, JP 2001-003150, Jan. 9, 2001.
Patent Abstracts of Japan, JP 07-252592, Oct. 3, 1995.
Koh-ichi Sugimoto, et al., "Stretch-Flangeability of a High-Strength Trip Type Bainitic Sheet Steel", ISIJ International, vol. 40, No. 9, XP-001182010, 2000, pp. 920-926, 2000.
Koh-Ichi Sugimoto, et al., "Effects of Retained Austenite Parameters on Warm Stretch-Flangeability in TRIP-aided Dual-phase Sheet Steels", ISIJ International, vol. 39, No. 1, XP-001182011, 1999, pp. 56-63.
Arif Basuki, et al., "Effect of Deformation in the Intercritical Area on the Grain Refinement of Retained Austenite of 0.4C Trip Steel", Scripta Materialia, vol. 40, No. 9, XP-004325627, Apr. 1999, pp. 1003-1008.
U.S. Appl. No. 11/110,716, filed Apr. 21, 2005, Ikeda et al.
U.S. Appl. No. 10/470,752, filed Jul. 13, 2003, Kashima et al.
S. Traint, et al., "Niedriglegierte TRIP-Feinbleche mit Kupferzusatz", BHM, vol. 144, No. 9, XP-001117545, 1999, pp. 362-368.
Patent Abstracts of Japan, JP 09-263883, Oct. 7, 1997.
Patent Abstracts of Japan, JP 06-108152, Apr. 19, 1994.
U.S. Appl. No. 11/044,185, filed Jan. 28, 2005, Ikeda et al.
U.S. Appl. No. 10/740,752, filed Jul. 31, 2003, Kashima et al.
U.S. Appl. No. 11/030,100, filed Jan. 7, 2005, Akamizu et al.
U.S. Appl. No. 10/928,176, filed Aug. 30, 2004, Kashima et al.
U.S. Appl. No. 10/470,752, filed Jul. 31, 2004, Kashima et al.

* cited by examiner

*Primary Examiner*—Deborah Yee
(74) *Attorney, Agent, or Firm*—Oblon, Spivak, McClelland, Maier & Neustadt, P.C.

(57) ABSTRACT

A high strength steel sheet having (2-1) a base phase structure, the base phase structure being tempered martensite or tempered bainite and accounting for 50% or more in terms of a space factor relative to the whole structure, or the base phase structure comprising tempered martensite or tempered bainite which accounts for 15% or more in terms of a space factor relative to the whole structure and further comprising ferrite, the tempered martensite or the tempered bainite having a hardness which satisfies the relation of Vickers hardness (Hv)$\geqq$500[C]+30[Si]+3[Mn]+50 where [ ] represents the content (mass %) of each element, and (2-2) a second phase structure comprising retained austenite which accounts for 3 to 30% in terms of a space factor relative to the whole structure and optionally further comprising bainite and/or martensite, the retained austenite having a C concentration (C$\gamma$R) of 0.8% or more.

29 Claims, 16 Drawing Sheets

GRAY SCALE MAP TYPE:<NONE>

COLOR CODED MAP TYPE:
INVERSE POLE FIGURE [001]

fcc_generic

BOUNDARIES:<NONE>

×15000

×15000

×15000

×15000

10 μm

10 μm

HIGH STRENGTH STEEL SHEET HAVING EXCELLENT FORMABILITY AND METHOD FOR PRODUCTION THEREOF

TECHNICAL FIELD

The present invention relates to a high strength steel sheet having excellent formability (stretch flange formability and total elongation). More particularly, the present invention is concerned with a high strength steel sheet having both high strength of the order of 500 to 1400 MPa and excellent formability in an ultra-high strength region, further, a high strength steel sheet also superior in fatigue characteristic, and further a high strength steel sheet also superior in bake hardening property [hardening property after baking finish, may be referred to hereinafter also as "BH (Bake Hardening)" property] which can ensure a high strength by baking finish.

BACKGROUND ART

Steel sheets used after pressing in automobiles and industrial machines are required to possess both high strength and high ductility, which requirement has been becoming more and more strong in recent years.

Heretofore, as a steel sheet having both high strength and high ductility there has been known a composite ferrite-martensite steel sheet [dual phase (DP) steel sheet] comprising ferrite as a base and a low temperature transformation structure contained therein which structure is constituted mainly by marternsite (see, for example, JP-A No. 122820/1980). This steel sheet is not only superior in ductility but also characteristic in that yield elongation does not appear due to a large quantity of free dislocation introduced into a martensite producing region, and yield stress becomes lower, and that therefore a shape freezing characteristic in working is satisfactory. By making control to the aforesaid structure there is obtained a steel sheet high in tensile strength (TS) and superior in elongation (El) characteristic, but inferior in stretch flange formability [hole expanding property (local ductility)].

On the other hand, as a steel sheet superior in stretch flange formability there is known a two-phase steel sheet of ferrite and bainite (see, for example, JP-A No. 145965/1982). This steel sheet, in comparison with the above DP steel sheet, is superior not only in stretch-flange formability but also in resistance-weldability (especially there is no softening of a heat affected zone) and in fatigue characteristic. However, there is a problem that the steel sheet in question is inferior in elongation characteristic.

Further, there is known a retained austenite steel sheet wherein retained austenite ($\gamma_R$) is produced within the structure and undergoes induced transformation (strain induced transformation: TRIP) during deformation in working to improve ductility. For example, JP-A No. 43425/1985 discloses a steel sheet which is high in strength and extremely superior in ductility and which is produced by controlling the structure of a composite phase steel sheet into a structure having 10% or more of ferrite and 10% or more of $\gamma_R$ in terms of volume fraction, with the balance being bainite or martensite or a mixture thereof. It is described in the above unexamined publication that with such a structure, not only the strain induced transformation effect of $\gamma_R$ but also high ductility is exhibited by soft ferrite, resulting in ductility being ensured by ferrite and $\gamma_R$ and strength ensured by bainite and martensite. However, also in the case of this steel sheet, like the foregoing DP steel, there has been a problem of stretch flange formability being unsatisfactory.

In view of the above-mentioned problems, studies have been made for providing a steel sheet superior in such formability as stretch flange formability (hole expanding property) while ensuring good strength-ductility balance based on $\gamma_R$. JP-A No. 104947/1997 discloses a steel sheet having a three-phase microstructure of ferrite, bainite and $\gamma_R$ and with a ferrite occupancy rate/ferrite grain size ratio and $\gamma_R$ occupancy rate being controlled to predetermined ranges. This is based on the following knowledge: "An increase of $\gamma_R$ brings about improvement of strength-ductility balance and of total elongation and the effect thereof is enhanced by microstructurization; further, as $\gamma_R$ becomes finer, formability such as stretch flange formability is also improved." However, the improvement in stretch flange formability is low and it is keenly desired to provide a high strength steel sheet further superior in stretch flange formability.

Further, for the application of a high strength steel sheet to automobile components, especially such structural members as automobile body members and frames or suspension members such as suspensions and wheels, it is required for the steel sheet to be superior not only in the foregoing elongation and stretch flange formabilitybut also in fatigue characteristic [fatigue endurance ratio (fatigue strength/yield strength)]. Generally, low alloy TRIP steels involve the problem that their fatigue characteristics are deteriorated by martensite of a second phase structure (martensite resulting from transformation of retained austenite).

Further, in applying a high strength steel sheet to suspension members of an automobile as referred to above, it is required for the steel sheet to be superior in bake hardening property (BH property). As to this BH property, it is presumed that, by baking finish after working, C (solid solution C) dissolved supersaturatedly in ferrite is fixed to dislocation in the ferrite which has been introduced during working, with consequent increase in yield strength of the steel sheet, thus leading to improvement of BH property.

However, since there is a limit to the amount of the solid solution C capable of being present supersaturatedly in ferrite, it is difficult to attain a predetermined or higher BH property. For example, there is a problem such that a large deformation results in marked deterioration of BH property, not affording a sufficient strength. For example, also in JP-A No. 297350/2000 there is disclosed a high tensile strength hot-rolled steel sheet, but the present inventors have found out that BH (10%) is about zero although BH (2%) is high.

DISCLOSURE OF THE INVENTION

The present invention has been accomplished in view of the above-mentioned circumstances and it is a first object of the invention to provide a high strength steel sheet superior in formability (stretch flange formability and total elongation) and a method which can produce such a steel sheet efficiently. It is a second object of the present invention to provide a high strength steel sheet superior not only in the aforesaid formabilitybut also in fatigue characteristic, i.e., a high strength steel sheet having well-balanced stretch flange formability, total elongation and fatigue characteristic, and a method which can produce such a steel sheet efficiently. It is a third object of the present invention to provide a high strength steel sheet superior not only in the aforesaid formability but also in bake hardening property, and a method which can produce such a steel sheet efficiently.

A first high strength steel sheet according to the present invention which could achieve the above first object of the invention:

(1) contains the following chemical components in mass %:

C: 0.06 to 0.25%

Si+Al: 0.5 to 3%

Mn: 0.5 to 3%

P: 0.15% or less (not including 0%)

S: 0.02% or less (not including 0%), and (2) has a structure comprising:

(2-1) a base phase structure, the base phase structure being tempered martensite or tempered bainite and accounting for 50% or more in terms of a space factor relative to the whole structure, or the base phase structure comprising tempered martensite or tempered bainite which accounts for 15% or more in terms of a space factor relative to the whole structure and further comprising ferrite, the tempered martensite or the tempered bainite having a hardness which satisfies the relation of Vickers hardness (Hv)≧500[C]+30[Si]+3[Mn]+50 where [ ] represents the content (mass %) of each element, and (2-2) a second phase structure comprising retained austenite which accounts for 3 to 30% in terms of a space factor relative to the whole structure and optionally further comprising bainite and/or martensite, the retained austenite having a C concentration ($C\gamma_R$) of 0.8% or more.

A second high strength steel sheet which could achieve the foregoing second object of the present invention:

(1) contains the following chemical components in mass %:

C: 0.06 to 0.25%

Si+Al: 0.5 to 3%

Mn: 0.5 to 3%

P: 0.15% or less (not including 0%)

S: 0.02% or less (not including 0%), and (2) has a structure satisfying the structure of the first high strength steel sheet described above, wherein the second phase structure satisfies the following expression (1) to enhance a fatigue characteristic:

$$(S1/S)\times 100 \geqq 20 \quad (1)$$

where S stands for a total area of the second phase structure, and S1 stands for a total area of coarse second phase crystal grains (Sb) contained in the second phase structure, the Sb corresponding to three times or more as large as an average crystal grain area (Sm) of the second phase structure.

A third high strength steel sheet according to the present invention which could achieve the foregoing third object of the present invention:

(1) contains the following chemical components in mass %:

C: 0.06 to 0.25%

Si+Al: 0.5 to 3%

Mn: 0.5 to 3%

P: 0.15% or less (not including 0%)

S: 0.02% or less (not including 0%), (2) has a structure satisfying the structure of the first high strength steel sheet described above, and (3) has a hardening property (BH) after baking finish which property satisfies:

BH (2%)≧70 MPa and

BH (10%)≧BH (2%)/2.

A method for producing the first high strength steel sheet described above involves the following methods according to the following structures (A) and (B):

(A) Steel Sheet with a Base Phase Structure Being Tempered Martensite or Tempered Bainite In this case there may be adopted the following method (1) or (2):

(1) A method of producing the above steel sheet through a hot rolling process and a continuous annealing process or a plating process:

the hot rolling process comprising a step of terminating finish rolling at a temperature of not lower than ($A_{r3}$−50)° C. and a step of cooling a resulting steel sheet to a temperature of not higher than Ms point (in case of a base phase structure being tempered martensite) or a temperature of not lower than Ms point and not higher than Bs point (in case of a base phase structure being tempered bainite) at an average cooling rate of not lower than 20° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(2) A method of producing the above steel sheet through a hot rolling process, a cooling process, a first continuous annealing process, and a second continuous annealing process or a plating process:

the first continuous annealing process comprising a step of holding a resulting steel sheet in a heated state at a temperature of not lower than $A_3$ point and a step of cooling the steel sheet to a temperature of not higher than Ms point (in case of a base phase structure being tempered martensite) or a temperature of not lower than Ms point and not higher than Bs point (in case of a base phase structure being tempered bainite) at an average cooling rate of not lower than 20° C./s, the second continuous annealing process or the plating process comprising a step of holding the steel sheet in a heated state at a temperature of not lower than A1 point and not higher than A3 point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(B) Steel Sheet with a Base Phase Structure Comprising Tempered Martensite and Ferrite or Comprising Tempered Bainite and Ferrite In this case there may be adopted the following method (3) or (4):

(3) A method of producing the above steel sheet through a hot rolling process and a continuous annealing process or a plating process:

the hot rolling process comprising a step of terminating finish rolling at a temperature of not lower than ($A_{r3}$−50)° C., cooling a resulting steel sheet to a temperature of not higher than Ms point (in the case of a base phase structure comprising tempered martensite and ferrite) or a temperature of not lower than Ms point and not higher than Bs point (in the case of a base phase structure comprising tempered bainite and ferrite) at an average cooling rate of not lower than 10° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(4) A method of producing the above steel sheet through a hot rolling process, a cooling process, a first continuous annealing process, and a second continuous annealing process or a plating process:

the first continuous annealing process comprising a step of holding a resulting steel sheet in a heated state at a temperature of not lower than $A_1$ point and not higher than $A_3$ point and a step of cooling the steel sheet to a temperature of not higher than Ms point (in the case of abase phase structure comprising tempered martensite and ferrite) or a temperature of not lower than Ms point and not higher than Bs point (in the case of a base phase structure comprising tempered bainite and ferrite) at an average cooling rate of not lower than 10° C./s, the second continuous annealing process or the plating process comprising a step of holding the steel sheet in a heated state at a temperature of not lower than A, point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

A method for producing the foregoing second high strength steel sheet involves the following methods according to the following structures (A) and (B):

(A) Steel Sheet with a Base Phase Structure Being Tempered Martensite or Tempered Bainite In this case there may be adopted the following method (5) or (6):

(5) A method of producing the above steel sheet through a hot rolling process, a tempering process, and a continuous annealing process or a plating process, the hot rolling process comprising a step of terminating finish rolling at a temperature of not lower than $(A_{r3}-50)$° C. and a step of cooling a resulting steel sheet to a temperature of not higher than Ms (in case of a base phase structure being tempered martensite) or a temperature of not lower than Ms and not higher than Bs (in case of a base phase structure being tempered bainite) at an average cooling rate of not lower than 20° C./s and winding up the steel sheet, the tempering process comprising a step of tempering the steel sheet at a temperature of not lower than 400° C. and not higher than $A_{c1}$ point for a period of time of not less than 10 minutes and less than 2 hours, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(6) A method of producing the above steep sheet through a hot rolling process, a cooling process, a first continuous annealing process, a tempering process, and a second continuous annealing process or a plating process, the first continuous annealing process comprising a step of holding a resulting steel sheet in a heated state at a temperature of not lower than $A_3$ point and a step of cooling the steel sheet to a temperature of not higher than Ms point (in case of a base phase structure being tempered martensite) or a temperature of not lower than Ms point and not higher than Bs point (in case of a base phase structure being tempered bainite) at an average cooling rate of not lower than 20° C./s, the tempering process comprising a step of tempering the steel sheet at a temperature of not lower than 400° C. and not higher than $A_{c1}$ point for a period of time of not less than 10 minutes and less than 2 hours, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(B) Steel Sheet with a Base Phase Structure Comprising Tempered Martensite and Ferrite or Comprising Tempered Bainite and Ferrite In this case there may be adopted the following method (7) or (8):

(7) A method of producing the above steel sheet through a hot rolling process, a tempering process, and a continuous annealing process or a plating process, the hot rolling process comprising a step of terminating finish rolling at a temperature of not lower than $(A_{r3}-50)$° C. and a step of cooling a resulting steel sheet to a temperature of not higher than Ms point (in the case of a base phase structure comprising tempered martensite and ferrite) or a temperature of not lower than Ms point and not higher than Bs point (in the case of a base phase structure comprising tempered bainite and ferrite) at an average cooling rate of not lower than 10° C./s and winding up the steel sheet, the tempering process comprising a step of tempering the steel sheet at a temperature of not lower than 400° C. and not higher than $A_1$ point for a period of time of not less than 10 minutes and less than 2 hours, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(8) A method of producing the above steel sheet through a hot rolling process, a cooling process, a first continuous annealing process, a tempering process, and a second continuous annealing process or a plating process, the first continuous annealing process comprising a step of holding a resulting steel sheet in a heated state at a temperature of not lower than $A_1$ point and not higher than $A_3$ point and a step of cooling the slab to a temperature of not higher than Ms point (in the case of a base phase structure comprising tempered martensite and ferrite) or a temperature of not lower than Ms point and not higher than Bs point (in the case of a base phase structure comprising tempered bainite and ferrite) at an average cooling rate of not lower than 10° C./s, the tempering process comprising a step of tempering the steel sheet at a temperature of not lower than 400° C. and not higher than $A_{c1}$ point for a period of time of not less than 10 minutes and less than 2 hours, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C., and a step of holding the steel sheet in the said temperature range for 1 second or more.

A method for producing the foregoing third high strength steel involves the following methods according to the following structures (A) and (B):

(A) Steel Sheet with a Base Phase Structure Being Tempered Martensite or Tempered Bainite In this case there may be adopted the following method (9) or (10):

(9) A method of producing the above steel sheet through a hot rolling process and a continuous annealing process or a plating process, the hot rolling process comprising a step of controlling a heating temperature before hot rolling to a temperature of 950° to 1000° C., a step of terminating finish rolling at a temperature of not lower than $(A_{r3}-50)$° C., and a step of cooling a resulting steel sheet to a temperature of not higher than Ms point or a temperature of not lower than Ms point and not higher than Bs point at an average cooling rate of not lower than 20° C./s and winding up the steel sheet, the continuous annealing process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(10) A method of producing the above steel sheet through a hot rolling process, a cooling process, a first continuous annealing process, and a second continuous annealing process or a plating process, the hot rolling process comprising a step of controlling a heating temperature before hot rolling to a temperature of 950° to 1100° C., the first continuous annealing process comprising a step of holding a resulting steel sheet in a heated state at a temperature of not lower than $A_3$ point and a step of cooling the steel sheet to a temperature of not higher than Ms point or a temperature of not lower than Ms point and not higher than Bs point at an average cooling rate of not lower than 20° C./s, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(B) Steel Sheet with a Base Phase Structure Comprising Tempered Martensite and Ferrite or Comprising Tempered Bainite and Ferrite In this case there may be adopted the following method (11) or (12):

(11) A method of producing the above steel sheet through a hot rolling process and a continuous annealing process or a plating process, the hot rolling process comprising a step of controlling a heating temperature before hot rolling to a temperature of 950° to 1100° C., a step of terminating finish rolling at a temperature of not lower than $(A_{r3}-50)$° C., and a step of cooling a resulting steel sheet to a temperature of not higher than Ms point or a temperature of not lower than Ms point and not higher than Bs point at an average cooling rate of not lower than 10° C./s, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more.

(12) A method of producing the above steel sheet through a hot rolling process, a cooling process, a first continuous annealing process, and a second continuous annealing process or a plating process, the hot rolling process comprising a step of controlling a heating temperature before hot rolling to a temperature of 950° to 1100° C., the first continuous annealing process comprising a step of holding a resulting steel sheet in a heated state at a temperature of not lower than $A_1$ point and not higher than $A_3$ point and a step of cooling the steel sheet to a temperature of not higher than Ms point or a temperature of not lower than Ms point and not higher than Bs point at an average cooling rate of not lower than 10° C./s, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C., and a step of holding the steel sheet in the said temperature range for 1 second or more.

BEST MODE FOR CARRYING OUT THE INVENTION

First, the following description is provided about the first high strength steel sheet according to the present invention.

Having made earnest studies for providing a low alloy TRIP steel sheet having a high stretch flange formability and a high total elongation, the present inventors found out that the desired object could be achieved by using as a base phase structure ① tempered martensite or ② tempered bainite, which is a soft lath structure low in dislocation density, or ③ a mixed structure of the tempered martensite and ferrite, or ④ a mixed structure of the tempered bainite and ferrite, and by making control to, as a second phase structure, a structure having $\gamma_R$ phase with a C concentration ($C\gamma_R$) in retained austenite ($\gamma_R$) of not lower than 0.8%. On the basis of this finding we have accomplished the present invention.

A description will be given below about the base phase structure and the second phase structure which are the greatest feature of the first high strength steel sheet. These structures are not only present in the first steel sheet but also present in common to the second and the third steel sheet which will be described later.

(1) Base Phase Structure

① A Mode Using a Tempered Martensite Structure as a Base Phase Structure

A conventional retained austenite steel sheet has a demerit such that with progress of deformation of a soft phase (base phase) around a hard phase, voids are apt to occur in the interface with the soft phase, resulting in stretch flange formability being deteriorated. But by using not ferrite in the prior art but tempered martensite (or tempered bainite, or a mixed structure of tempered martensite and ferrite, or a mixed structure of tempered bainite and ferrite, which will be described later) as a base phase, the formation of voids has been suppressed and stretch flange formability improved. Further, by controlling the form of lath $\gamma_R$ so as to give a predetermined axial ratio, it has become possible to improve elongation and stretch flange formability as compared with the conventional $\gamma_R$.

"Tempered martensite" used in the present invention has the following features.

Firstly, "tempered martensite" in the present invention means a soft and lath structure low in dislocation density. On the other hand, martensite is a hard structure high in dislocation density and is different in this point from the tempered martensite. Both can be distinguished from each other, for example, by observation under a transmission electron microscope (TEM). A conventional $\gamma_R$ steel sheet has a soft block-like ferrite structure low in dislocation density and is also different in this point from the steel sheet of the present invention which uses the tempered martensite as a base phase structure.

Figure 1:
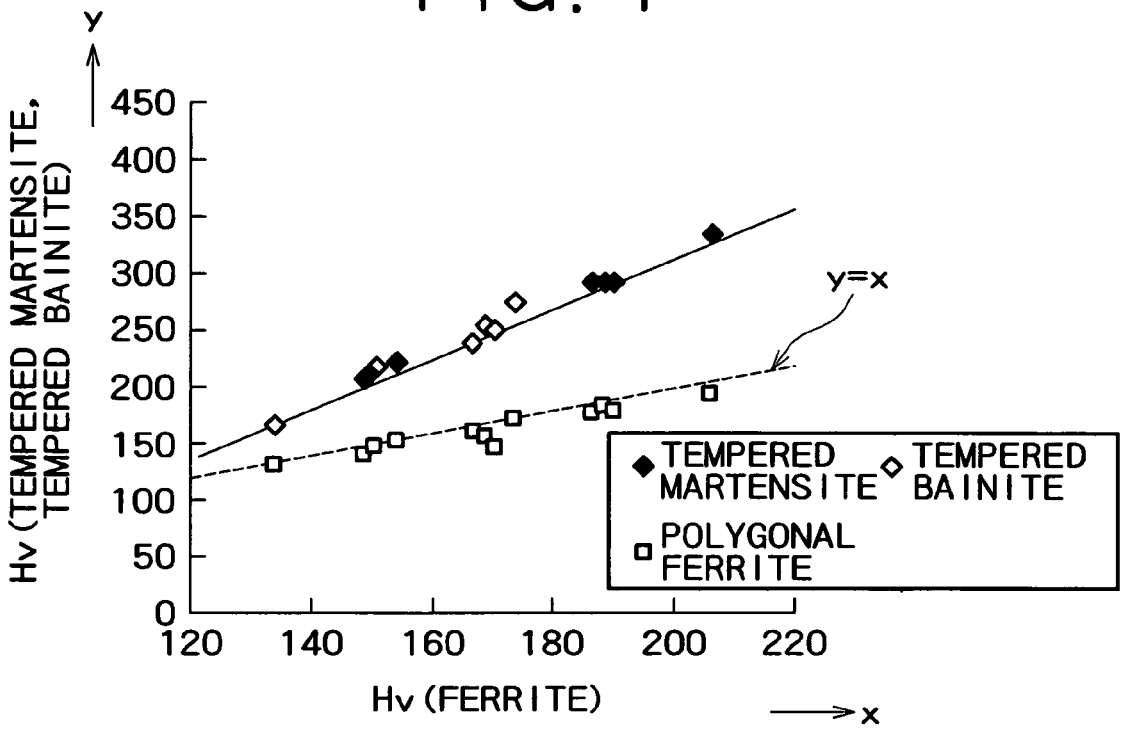
FIG. 1 is a graph comparing between the hardness of tempered martensite and that of polygonal ferrite in the same component system.

Secondly, the tempered martensite has a tendency that its Vickers hardness (Hv) is generally high as compared with polygonal ferrite in the same component system (a system common in point of basic components of C, Si, and Mn). FIG. 1 is a graph comparing between the hardness of tempered martensite (axis of ordinate) and that of polygonal ferrite (axis of abscissa) in steels of the same components (C: 0.1 to 0.3%, Mn: 1.0 to 2.0%, Si: 1.0 to 2.0%). As to Vickers hardness, there was made observation through an optical microscope for Lepera etching andVickers hardness (Hv) of abasephase (gray) portion was measured (load: 1 g). For reference, a straight line y=x is shown with a dotted line in the same figure, from which it is seen that the hardness of tempered martensite is higher than that of polygonal ferrite and that such a tendency becomes more outstanding as the hardness becomes higher.

Figure 2:
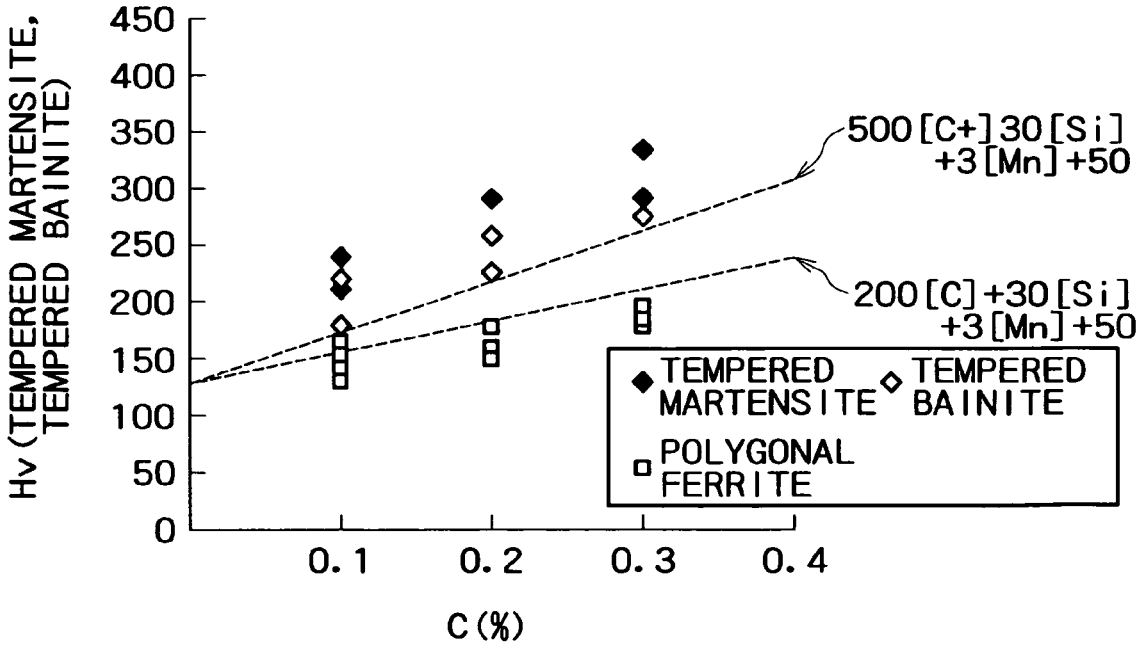
FIG. 2 is a graph showing the influence of the amount of C on the hardness of tempered martensite and that of polygonal ferrite.

In FIG. 2, the data of FIG. 1 are arranged for each of the cases of C being 0.1%, 0.2%, and 0.3%, showing the influence of the amount of C on the hardness of tempered martensite and that of polygonal ferrite. From FIG. 2 it is seen that, in the same amount of C, the hardness of tempered martensite tends to be higher than that of polygonal ferrite and that this tendency becomes outstanding as the amount of C becomes higher.

If the hardness of tempered martensite and that of polygonal ferrite are expressed in terms of relations to the basic components of C, Mn, and Si on the basis of the above results, the following relations are obtained:

Hardness (Hv) of tempered martensite $$\geqq 500[C]+30[Si]+3[Mn]+50$$

Hardness (Hv) of polygonal ferrite $$\approx 200[C]+30[Si]+3[Mn]+50$$

where, [ ] represents the content (mass %) of each element.

We have confirmed that the hardness values (calculated values) obtained from the above relations reflect measured values.

We have also confirmed that the hardness values obtained from the above relations reflect measured values not only in case of the amount of C being 0.1 to 0.3% but also in case of the amount of C being 0.3 to 0.6%, further, 0.06 to 0.1%.

An upper limit in hardness of tempered martensite can vary depending on a component composition for example, but it is recommended that the said upper limit be approximately 500[C]+30[Si]+3[Mn]+200, preferably 500[C]+30[Si]+3[Mn]+150.

As will be described later, tempered martensite having such a characteristic is obtained by providing martensite which has been quenched from a temperature of not lower than $A_3$ point (γ region) and annealing the martensite at a temperature of not lower than $A_1$ point (about 700° C. or higher) and not higher than $A_3$ point.

For allowing the effect of improving the stretch flange formability by the tempered martensite to be exhibited effectively, it is necessary that the tempered martensite be present not less than 50% (preferably not less than 60%) in terms of a space factor relative to the whole structure. The amount of the tempered martensite is determined in consideration of its balance with $\gamma_R$. It is recommended for control to be made appropriately so that a desired characteristic can be exhibited.

② A Mode Using a Mixed Structure of Tempered Martensite and Ferrite as a Base Phase Structure In this mode, the details of tempered martensite is as described above in ①. In this mixed base phase structure, in order for the tempered martensite to function effectively, it is necessary that the tempered martensite be present not less than 15% (preferably not less than 20%) in terms of a space factor relative to the whole structure. The amount of the tempered martensite is determined, taking into account the balance of ferrite and $\gamma_R$ which will be described later. It is recommended for control to be made appropriately so that a desired characteristic can be exhibited.

The term "ferrite" as referred to herein means polygonal ferrite, i.e., ferrite low in dislocation density. The ferrite is superior in elongation characteristic but is inferior in stretch flange formability. On the other hand, a steel sheet according to the present invention having the foregoing mixed structure of ferrite and tempered martensite is improved in stretch flange formability while retaining an excellent elongation characteristic. Thus, in both structural construction and resulting characteristics the steel sheet of the present invention is different from the conventional TRIP steel sheet.

In order for the action based on the present invention to be exhibited effectively it is recommended that ferrite be present not less than 5% (preferably not less than 10%) in terms of a space factor relative to the whole structure. However, if the content of ferrite exceeds 60%, it will become difficult to ensure a required strength; besides, like the conventional TRIP steel sheet, there will occur many voids from the interface between ferrite and a second phase, with consequent deterioration of the stretch flange formability. It is therefore recommended that the upper limit of ferrite content be set at 60%. Controlling the upper limit to less than 30% is very preferable because the ferrite-second phase ($\gamma_R$, martensite) interface will diminish to suppress the formation of voids, thus leading to improvement of the stretch flange formability.

③ A Mode Using Tempered Bainite as a Base Phase Structure

"Tempered bainite" used in the present invention has the following features.

Firstly, "tempered bainite" in the present invention means a soft and lath structure low in dislocation density. On the other hand, bainite is a hard structure high in dislocation density and is different in this point from the tempered bainite. Both can be distinguished from each other, for example, by observation under a transmission electron microscope (TEM). A conventional $\gamma_R$ steel sheet has a soft block-like soft structure low in dislocation density and is also different in this point from the steel sheet of the present invention which uses the tempered bainite as a base phase structure.

Secondly, the tempered bainite has a tendency that its Vickers hardness (Hv) is generally high as compared with polygonal ferrite in the same component system (a system common in point of basic components of C, Si, and Mn). FIG. 1 is a graph comparing the hardness of tempered bainite and that of tempered martensite (axis of ordinate) with the hardness of polygonal ferrite (axis of abscissa) in steels of the same components (C: 0.1 to 0.3%, Mn: 1.0 to 2.0%, Si: 1.0 to 2.0%). As to Vickers hardness, there was made observation through an optical microscope for Lepera etching and Vickers hardness of a base phase (gray) portion was measured (load: 1 g). For reference, a straight line y=x is shown with a dotted line in the same figure, from which it is seen that the hardness of tempered martensite is higher than that of polygonal ferrite and that such a tendency becomes more outstanding as the hardness becomes higher.

In FIG. 2, the data of FIG. 1 are arranged for each of the cases of C being 0.1%, 0.2%, and 0.3%, showing the influence of the amount of C on the hardness of tempered bainite, tempered martensite, and polygonal ferrite. From FIG. 2 it is seen that, in the same amount of C, the hardness of tempered bainite tends to be higher than that of polygonal ferrite and that this tendency becomes more outstanding as the amount of C increases.

On the basis of these results, if the hardness of tempered bainite and that of polygonal ferrite are expressed in terms of relations to the basic components of C, Mn, and Si, there are obtained the following relations:

Hardness (Hv) of tempered bainite $$\geqq 500[C]+30[Si]+3[Mn]+50$$

Hardness (Hv) of polygonal ferrite $$\approx 299[C]+30[Si]+3[Mn]+50$$

where, [ ] represents the content (mass %) of each element.

We have confirmed that the hardness values (calculated values) obtained from the above relations reflect measured values.

We have also confirmed that the hardness values obtained from the above relations reflect measured values not only in case of the amount of C being 0.1 to 0.3% but also in case of the amount of C being 0.3 to 0.6%, further, 0.06 to 0.1%.

An upper limit in hardness of tempered bainite can vary depending on a component composition for example, but it is recommended that the said upper limit be approximately 500[C]+30[Si]+3[Mn]+200, preferably 500[C]+30[Si]+3[Mn]+150.

As will be described later, tempered bainite having such a characteristic is obtained by providing bainite which has been quenched from a temperature of not lower than A3 point (γ region) to a temperature of not lower than Ms point and not higher than Bs point and by annealing the bainite at a temperature of not lower than $A_1$ point (about 700° C. or higher) and not higher than $A_3$ point.

For allowing the effect of improving the stretch flange formability by the tempered bainite to be exhibited effectively, it is recommended that the tempered bainite be present not less than 50% (preferably not less than 60%) in terms of a space factor relative to the whole structure. The amount of the tempered bainite is determined in consideration of its balance with $\gamma_R$ which will be described later. It is recommended for control to be made appropriately so that a desired characteristic can be exhibited.

④ A Mode Using a Mixed Structure of Tempered Bainite and Ferrite as a Base Phase Structure The details of the structures (tempered bainite and ferrite) in this mode are as described in the above ③ and ②.

In this mixed based phase structure, in order for the tempered bainite to function effectively, it is necessary that the tempered bainite be present not less than 15% (preferably not less than 20%) in terms of a space factor relative to the whole structure. The amount of the tempered bainite is determined, taking into account the balance of ferrite and $\gamma_R$ which will be described later. It is recommended for control to be made appropriately so that a desired characteristic can be exhibited.

(2) Second Phase Structure

A description will be given below of the second phase structure in each of the above modes ① to ④.

Retained Austenite ($\gamma_R$)

$\gamma_R$ is effective in improving the fatigue characteristic and in order for this function to be exhibited effectively it is necessary that $\gamma_R$ be present 3% (preferably 5% or more) in terms of a space factor relative to the whole structure. Particularly, in the case where a base phase structure is a mixed structure of tempered martensite and ferrite, it is preferable that $\gamma_R$ be present 5% or more (more preferably 7% or more). If $\gamma_R$ is present in a large amount, the stretch flange formability will be deteriorated. Therefore, we have determined an upper limit of the $\gamma_R$ content to be 30%. Especially when a base phase structure is a single phase structure of tempered martensite or tempered bainite, it is recommended that the upper limit be controlled to 20% (more preferably 15%). On the other hand, if a base phase structure is a mixed structure of tempered martensite and ferrite or a mixed structure of tempered bainite and ferrite, it is recommended to set the upper limit at 25%.

Figure 3:
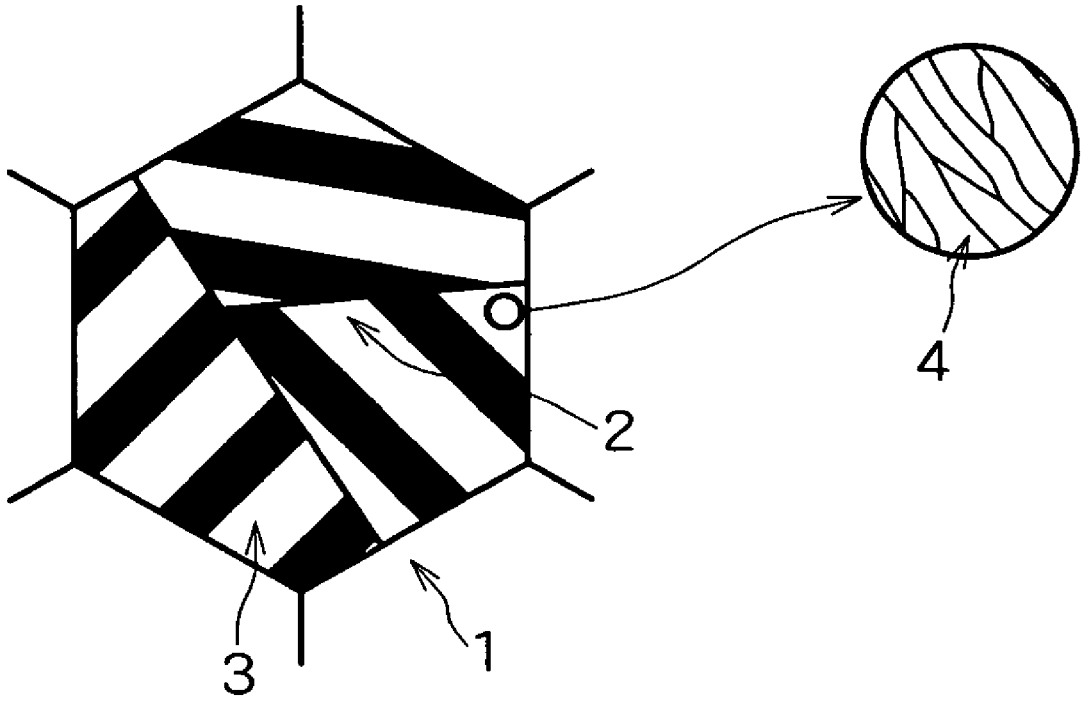
FIG. 3 schematically illustrates characteristics of retained austenite ($\gamma_R$) in the present invention.

Further, it is necessary that the concentration of C ($C\gamma_R$) in the $\gamma_R$ be not less than 0.8%. The $C\gamma_R$ exerts a great influence on the characteristic of TRIP (transformation induced plasticity), and controlling the $C\gamma_R$ to 0.8% or more will be effective particularly in improving elongation, etc. Preferably, the $C\gamma_R$ is not less than 1%, more preferably not less than 1.2%. Although the higher the $C\gamma_R$, the more preferable, an adjustable upper limit in practical operation is considered to be approximately 1.6% In a conventional TRIP steel sheet, $\gamma_R$ of random orientation is present in a pre-austenite grain boundary, while, in the present invention, $\gamma_R$ having the same orientation along for example a block boundary within the same packet is apt to be present. A feature of the $\gamma_R$ in the present invention is illustrated schematically in FIG. 3. In the same figure, the numeral 1 denotes a pre-austenite grain boundary, numeral 2 denotes a packet grain boundary, numeral 3 denotes a block grain boundary, and numeral 4 denotes martensite lath.

Figure 4:
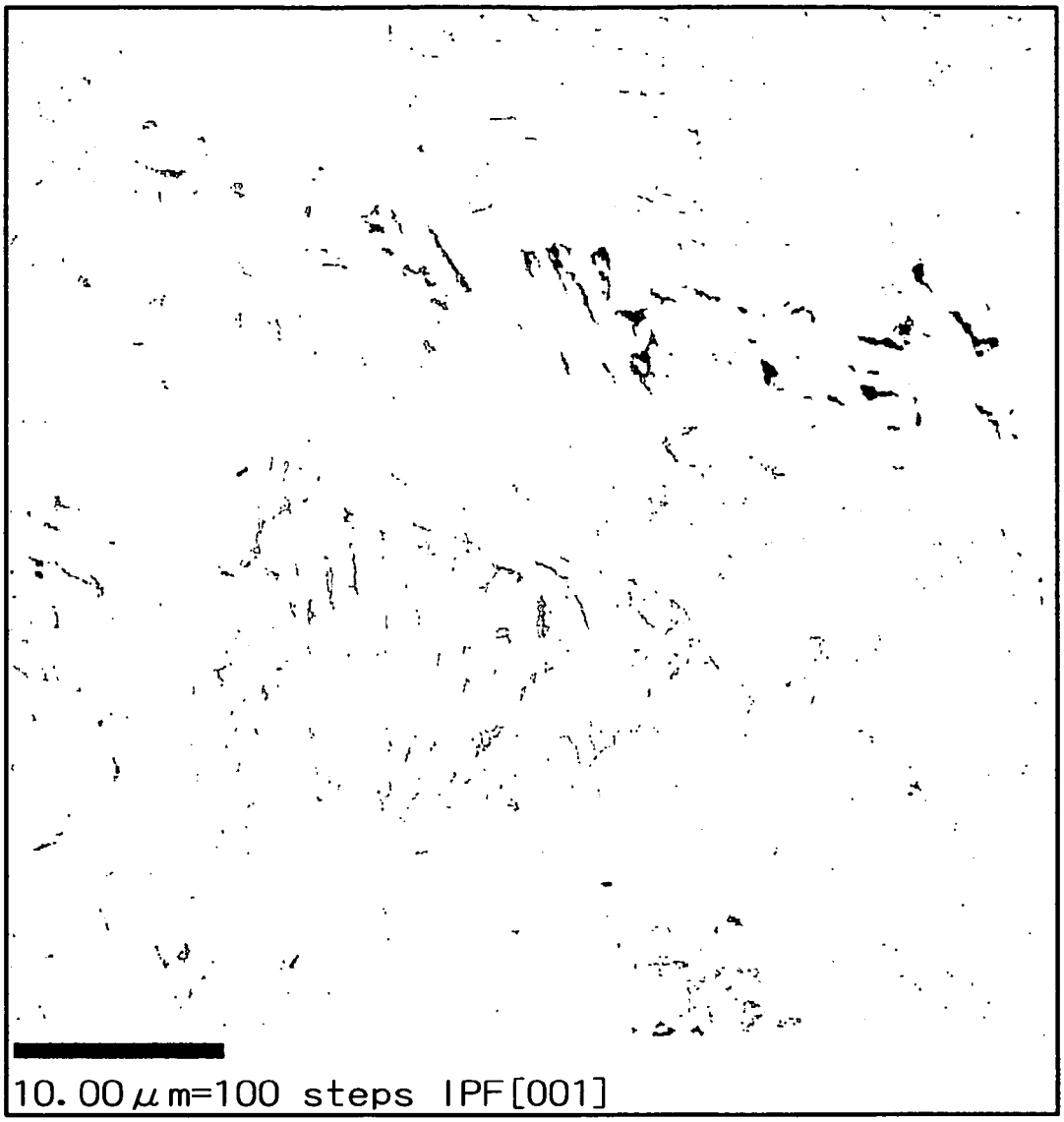
FIG. 4 is an EBSP photograph (×1000) of a steel sheet (No. 3 in Table 2) according to the present invention.
Figure 4:
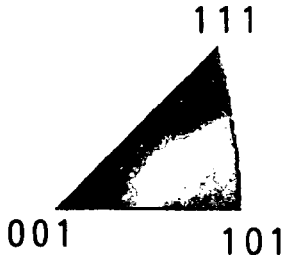
Figure 5:
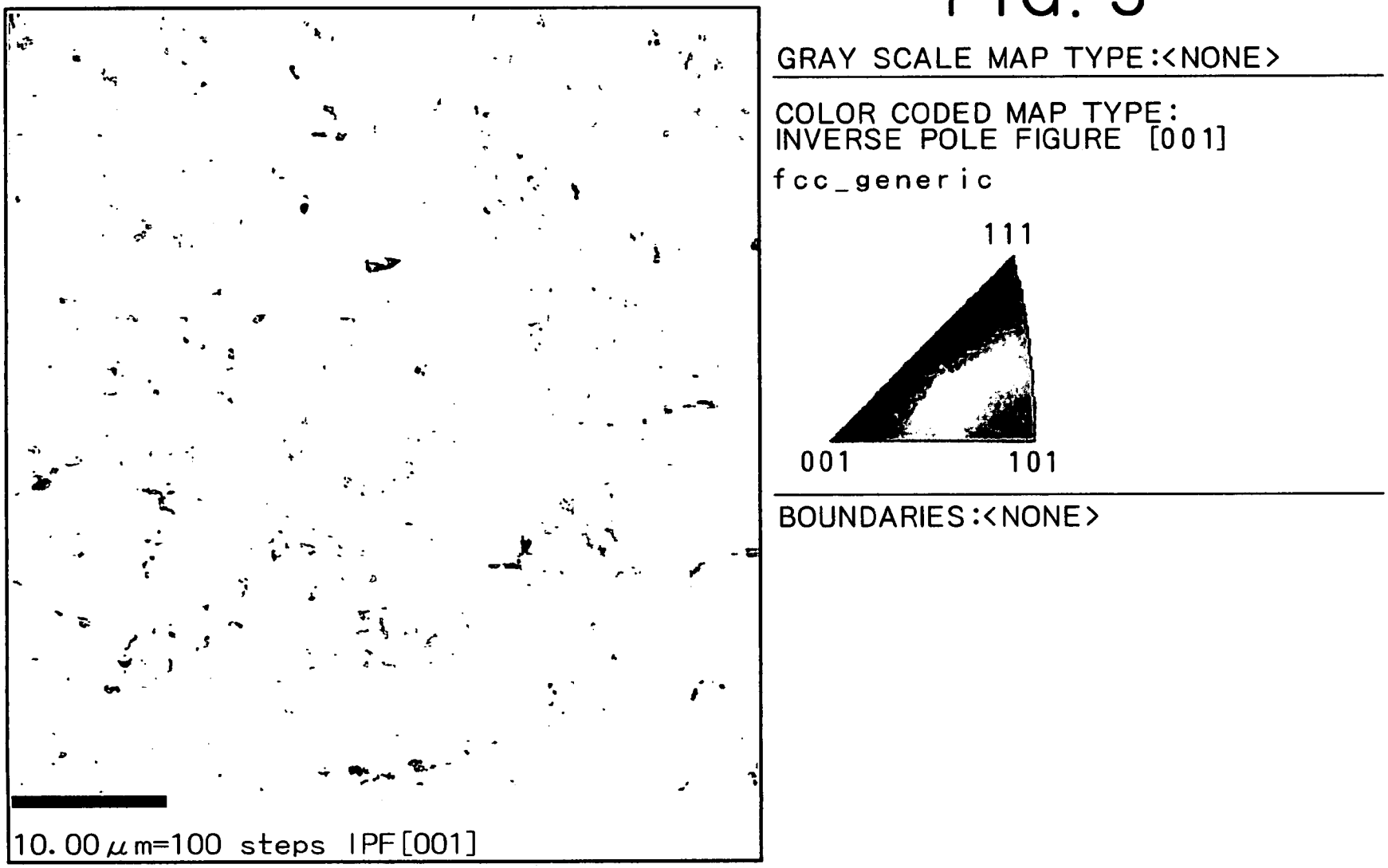
FIG. 5 is an EBSP photograph (×1000) of a conventional retained austenite steel sheet (No. 16 in Table 3)

For the purpose of making this point clearer, FIGS. 4 and 5 illustrate results obtained using EBSP photographs (color maps: magnification 1000 times) of sections in sheet thickness direction of a steel sheet according to the present invention (No. 3 in Table 2 to be described later) and a conventional $\gamma_R$ steel sheet (No. 16 in Table 3 to be described later). The EBSP stands for Electron Back Scatter Diffraction Pattern, and as an EBSP analyzer there was used an analyzer manufactured by TexSEM Laboratories.

With the photographs, $\gamma_R$ in the sheet thickness direction of different crystal orientations can be identified on the basis of a color tone difference. That is, if $\gamma_R$ is checked by a crystal orientation observing method using EBSP different from the ordinary structure observation, a large number of $\gamma_R$ of random orientations are found to be present in a pre-austenite grain boundary in the conventional steel sheet (FIG. 5), while in the steel sheet according to the present invention (FIG. 4) it can be seen that a large number of $\gamma_R$ having the same orientation are present within a certain region, though both of the steel sheet have almost the same structure in appearance. It is presumed that, in the steel sheet of the present invention, $\gamma_R$ having the same orientation is produced along a block boundary for example. In this point the $\gamma_R$ in the steel of the present invention has a different form from the that in the conventional steel sheet.

It is preferable that the $\gamma_R$ in the present invention be in lath form. By "lath form" is meant an average axial ratio (major axis/minor axis) of 2 or more (preferably 4 or more, a preferred upper limit being 30 or less). The $\gamma_R$ in lath form not only affords the same TRIP effect as in the prior art but also affords improved elongation and a more outstanding improvement in stretch flange formability.

Others: Bainite and/or Martensite (including 0%)

In addition to the above retained austenite, the second phase structure may further contain bainite and/or martensite as other structures insofar as the operation of the present invention is not impaired. These structures may remain inevitably in the manufacturing process of the present invention, but the smaller their content, the better. In the second high strength steel sheet according to the present invention, which will be described later, mention may be made mainly of martensite as another structure.

Next, reference will be made to basic components which constitute the steel sheet of the present invention. In the following description, the amounts of chemical components are all in mass %.

C: 0.06 to 0.6%

C is an element essential for ensuring a high strength and for ensuring $\gamma_R$. More specifically, C is an important element for providing a sufficient content of C in $\gamma$ phase and for allowing a desired $\gamma$ phase to remain even at room temperature. C is useful in improving the balance of strength and stretch flange formability. Particularly, if C is added in an amount of 0.25% or more, the amount of $\gamma_R$ increases and C concentration to $\gamma_R$ becomes higher, so that there can be obtained an extremely high strength-elongation balance.

However, if the amount of C added exceeds 0.6%, not only the effect thereof will become saturated, but also there will occur a defect caused by, for example, center segregation into casting. Moreover, if C is added in an amount of 0.25% or more, a deterioration of weldability will result.

Thus, if weldability is mainly taken into account, it is preferable to control the amount of C to 0.06 to 0.25% (more preferably 0.2% or less, still more preferably 0.15% or less) On the other hand, in the case where high elongation is required without the need of spot welding, it is recommended to control the amount of C to 0.25 to 0.6% (more preferably 0.3% or more)

Si+Al: 0.5 to 3%

Si and Al are elements which effectively prevent the formation of carbide by decomposition of $\gamma_R$. Especially, Si is useful also as a solid solution hardening element. For allowing such a function to be exhibited effectively it is necessary that Si and Al be added a total of 0.5% or more, preferably 0.7% or more, more preferably 1% or more. But even if both elements are added in an amount exceeding 3% in total, the aforesaid effect will become saturated, which is wasteful from the economic standpoint; besides, the addition thereof in a large amount will cause hot shortness. For this reason, an upper limit thereof is set at 3%, preferably 2.5% or less, more preferably 2% or less.

Mn: 0.5 to 3%

Mn is an element necessary for stabilizing $\gamma$ and for obtaining a desired $\gamma_R$. For allowing such a function to be exhibited effectively it is necessary to add Mn in an amount of 0.5% or more, preferably 0.7% or more, more preferably 1% or more. However, if Mn is added in an amount exceeding 3%, there will arise a bad influence such as cast piece cracking. Preferably, Mn is added in an amount of not larger than 2.5%, more preferably not larger than 2%.

P: 0.15% or Less (Not Including 0%)

P is an element effective for ensuring a desired $\gamma_R$. For allowing such a function to be exhibited effectively it is recommended to add P in an amount of 0.03% or more (more preferably 0.05% or more). However, if the amount of P added exceeds 0.1%, secondary formability will be deteriorated. More preferably, P is added in an amount of not larger than 0.1%.

S: 0.02% or Less (Including 0%)

S is an element which forms a sulfide inclusion such as MnS and acts as an origin of cracking, with consequent deterioration of formability. The content of S is preferably not more than 0.02%, more preferably not more than 0.015%.

The steel of the present invention basically contains the above components, with the balance being substantially iron and impurities, but the following components may be added insofar as they do not impair the operation of the present invention: At least one of Mo: 1% or less (not including 0%), Ni: 0.5% or less (not including 0%), Cu: 0.5% or less (not including 0%), Cr: 1% or less (not including 0%)

These elements are not only useful as steel strengthening elements but also effective in stabilizing $\gamma_R$ and ensuring a predetermined amount thereof. For allowing such functions to be exhibited effectively, it is recommended that these elements be added in such amounts as Mo: 0.05% or more (more preferably 0.1% or more), Ni: 0.05% or more (more preferably 0.1% or more), Cu: 0.05% or more (more preferably 0.1% or more), and Cr: 0.05% or more (more preferably 0.1% or more). However, even if Mo and Cr are added in an amount exceeding 1% and Ni and Cu are added in an amount exceeding 0.5%, the above effects will become saturated, which is wasteful from the economic standpoint. More preferably, these elements are added in such amounts as Mo: 0.8% or less, Ni: 0.4% or less, Cu: 0.4% or less, and Cr: 0.8% or less.

At least one of Ti: 0.1% or less (not including 0%), Nb: 0.1% or less (not including 0%), V: 0.1% or less (not including 0%)

These elements have a precipitation strengthening and microstructurization effect and are useful for the attainment of a high strength. For allowing these functions to be exhibited effectively it is recommended that these elements be added in such amounts as Ti: 0.01% or more (preferably 0.02% or more), Nb: 0.01% or more (more preferably 0.02% or more), and V: 0.01% or more (more preferably 0.02% or more). However, with respect to all of these elements, an amount exceeding 0.1% will result in saturation of the above effects, which is wasteful from the economic standpoint. More preferably, these elements are added in such amounts as Ti: 0.08% or less, Nb: 0.08% or less, and V: 0.08% or less.

Ca: 0.003% or Less and/or REM: 0.003% or Less (Not Including 0%)

Ca and REM (rare earth elements) function to control the form of sulfide in steel and are effective in improving formability. As examples of rare earth elements employable in the present invention are mentioned Sc, Y, and lanthanoid. For allowing the above effect to be exhibited effectively it is recommended that these elements be each added in an amount of 0.0003% or more (more preferably 0.0005% or more). However, even an amount thereof exceeding 0.003% would result in saturation of the above effect, which is wasteful from the economic standpoint. It is more preferable that they each be added in an amount of 0.0025% or less.

Next, how to produce the foregoing first steel sheet will be described below structure by structure.

(A) Steel Sheet with a Base Phase Structure Being Tempered Martensite or Tempered Bainite The following methods (1) and (2) are mentioned as typical methods for producing this steel sheet.

(1) [Hot Rolling Process]→[Continuous Annealing Process Plating Process]

Figure 6:
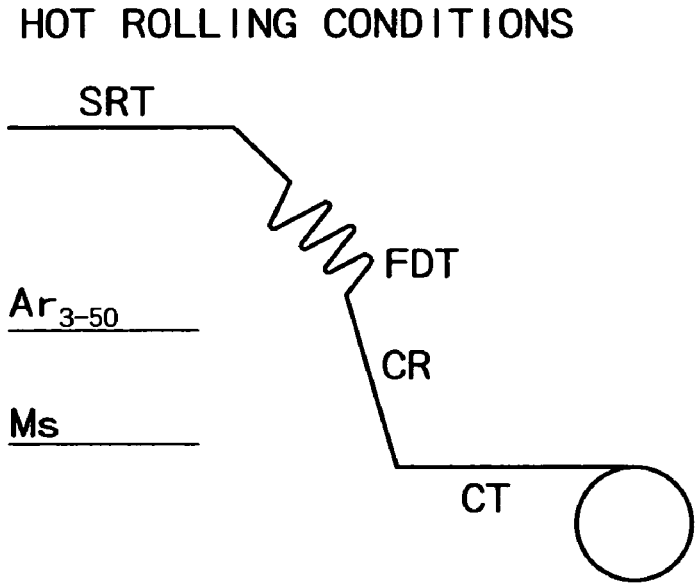
FIG. 6 illustrates the hot rolling process in the method (1), (3), (5), (7), (9), or (11) in the case where a base phase structure is tempered martensite or comprises tempered martensite and ferrite.
Figure 7:
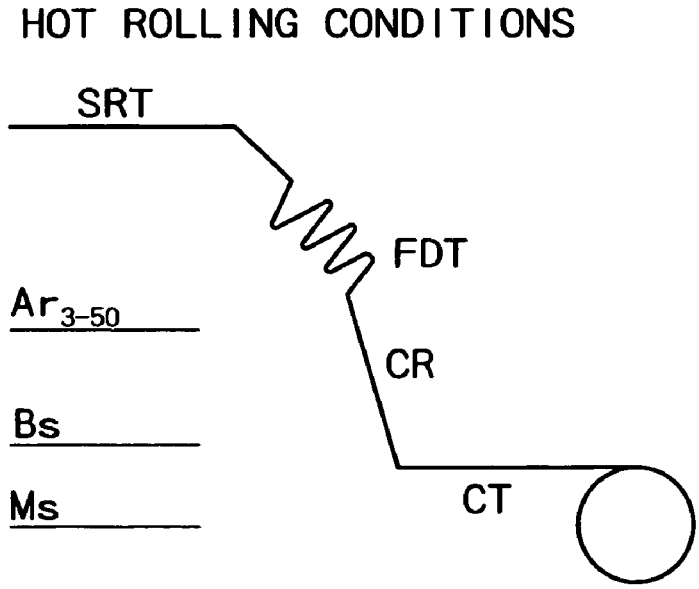
FIG. 7 illustrates the hot rolling process in the method (1), (3), (5), (7), (9), or (11) in the case where a base phase structure is tempered bainite or comprises tempered bainite and ferrite.
Figure 8B:
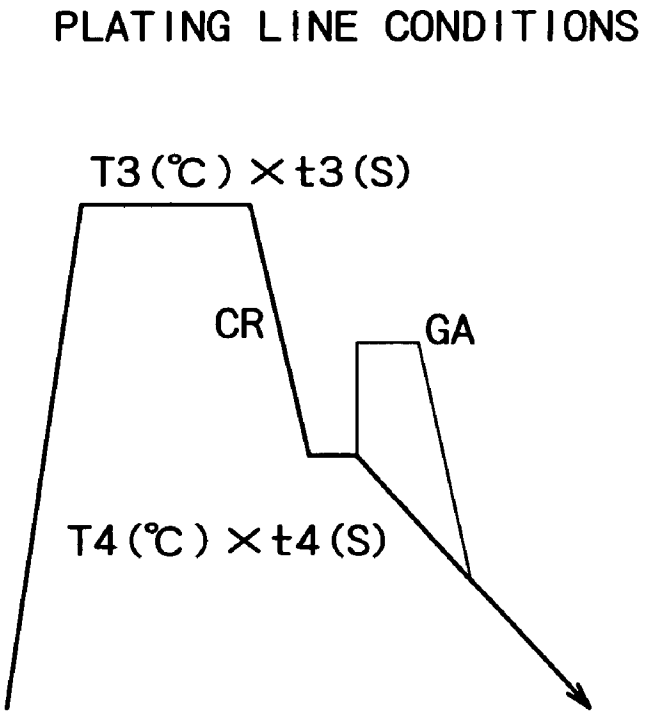
FIG. 8 illustrates the continuous annealing process or the plating process in the method (1), (3), (5), (7), (9), or (11)
Figure 8A:
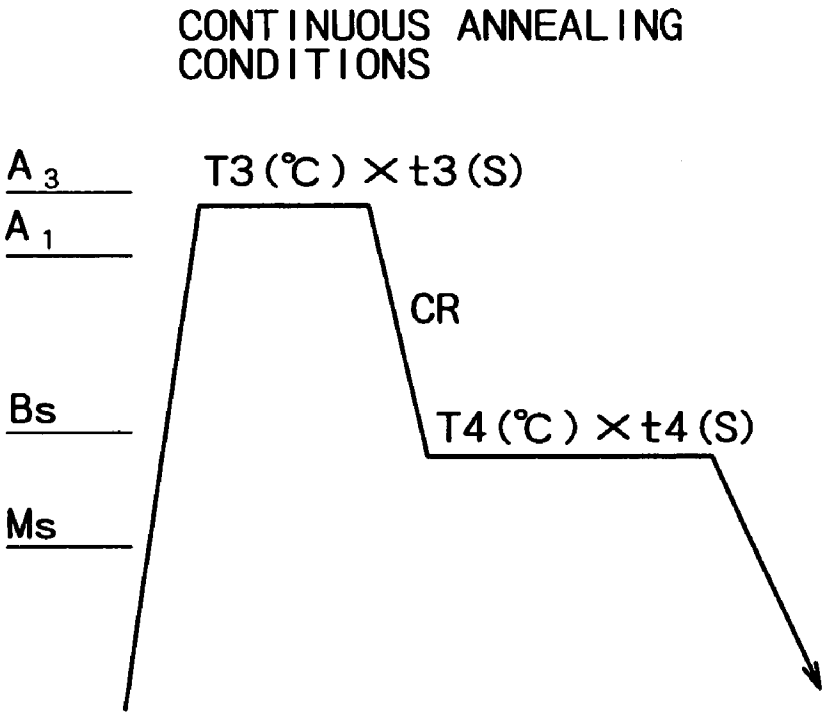

This method produces a desired steel sheet through ① a hot rolling process or ② a continuous annealing process or a plating process. The hot rolling process ① is illustrated in FIG. 6 (in case of a base phase structure being tempered martensite) and FIG. 7 (in case of a base phase structure being quenched bainite), and the continuous annealing process or plating process ② is illustrated in FIG. 8.

① Hot Rolling Process

The hot rolling process comprises a step of terminating finish rolling at a temperature of not lower than $(A_{r3}-50)$° C. and a step of cooling the rolled steel sheet to a temperature of not higher than Ms point (in case of abase phase structure being tempered martensite) or a temperature of not lower than Ms point and not higher than Bs point (in case of a base phase structure being tempered bainite) at an average cooling rate of not lower than 20° C./s and winding up the steel sheet. The hot rolling conditions have been established for obtaining a desired base phase structure (quenched martensite or quenched bainite).

No matter which base phase structure may be adopted, it is recommended that a hot rolling finish temperature (FDT) be set at a temperature of not lower than $(A_{r3}-50)$° C., preferably not lower than $A_{r3}$ point. This is for obtaining a desired quenched martensite or quenched bainite in cooperation with the "cooling to not higher than Ms point" or "cooling to not lower than Ms point and not higher than Bs point" which follows the hot rolling process.

It is recommended that the cooling, which follows the hot rolling process, be carried out to a temperature of not higher than Ms point at an average cooling rate of not lower than 20° C./s while avoiding ferrite transformation and pearlite transformation. This enables a desired quenched martensite or quenched bainite to be obtained without formation of polygonal ferrite, etc. The average cooling rate after the hot rolling also exerts an influence on the final form of $\gamma_R$. If the average cooling rate is high, there will be obtained a lath form. An upper limit of the average cooling rate is not specially limited, and the higher, the better. But in relation to the actual operation level it is recommended to make control appropriately.

In the case where quenched martensite is to be obtained, it is necessary that the winding temperature (CT) be set at a temperature of not higher than Ms point [calculating expression: $Ms=561-474\times[C]-33\times[Mn]-17\times[Ni]-17\times[Cr]-21\times[Mo]$, where [ ] represents mass % of each element. This is because, if the winding temperature exceeds Ms point, it is impossible to obtain a desired quenched martensite and there are produced bainite, etc.

On the other hand, when quenched bainite is to be obtained, it is necessary that the winding temperature (CT) should be not lower than Ms point and not higher than Bs point [calculating expression: the expression of Ms is the same as above; $Bs=830-270\times[C]-90\times[Mn]-37\times[Ni]-70\times[Cr]-80\times[Mo]$, where represents mass % of each element]. This is because, if the winding temperature exceeds Bs point, a desired quenched bainite is not obtained, while if it is lower than Ms point, there is produced tempered martensite.

In the hot rolling process it is recommended that each of the foregoing steps be controlled appropriately in order to obtain a desired quenched martensite or quenched bainite. But as to other conditions, including the heating temperature, there maybe selected conventional conditions (e.g., about 1000 to 1300° C.) suitably.

② Continuous Annealing Process or Plating Process

The above hot rolling process ① is followed by continuous annealing or plating. However, if the shape after the hot rolling is not satisfactory, then for the purpose of correcting the shape there may be applied a cooling process after the hot rolling ① and before the continuous annealing or plating ①. In this case, it is recommended that the cold rolling rate be set at 1 to 30%. This is because, if cold rolling is carried out at a cold rolling rate exceeding 30%, the rolling load will increase and it will become difficult to effect cold rolling.

The continuous annealing or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more. These conditions have been established for tempering the base phase structure (quenched martensite or quenched bainite) produced in the hot rolling process to afford not only a desired tempered martensite but also a fine second phase.

First, by soaking at a temperature of not lower than $A_1$ point and not higher than $A_3$ point (T3 in FIG. 8) for 10 to 600 seconds (t3 in FIG. 8) there is produced a desired structure (tempered martensite and $\gamma_R$, or tempered bainite and $\gamma_R$) (annealing in two phase region). This is because, if the soaking temperature exceeds the above temperature range, the resulting product will all be γ, while if it is lower than the above temperature range, it will be impossible to obtain the desired $\gamma_R$. Further, controlling the above heating holding time (t3) is particularly important for obtaining the desired structure. This is because, if the holding time is shorter than 10 seconds, tempering will be insufficient and there will not be obtained the desired base phase structure (tempered martensite or tempered bainite). Preferably, the holding time is not shorter than 20 seconds, more preferably not shorter than 30 seconds. If the holding time exceeds 600 seconds, it will become impossible to maintain the lath structure which is a feature of tempered martensite or tempered bainite, with consequent deterioration of mechanical characteristics. Preferably, the holding time is not longer than 500 seconds, more preferably not longer than 400 seconds.

Next, cooling is made to a temperature (bainite transformation: T4 in FIG. 8) of not lower than 300° C. (preferably not lower than 350° C.) and not higher than 480° C. (preferably not higher than 450° C.) while controlling an average cooling rate (CR) to a temperature of not lower than 3° C./s (preferably not lower than 5° C./s) and while avoiding pearlite transformation, and the steel sheet is held in this temperature range for 1 second or more (preferably 5 seconds or more: t4 in FIG. 8), whereby the concentration of C to $\gamma_R$ can be attained in a large quantity and in an extremely short time.

If the average cooling speed is lower than the above range, the desired structure will not be obtained, with formation of pearlite. An upper limit of the average cooling rate is not specially limited and the higher, the better. However, in relation to the actual operation level it is recommended that control be made appropriately.

For allowing a desired amount of Cγ to be produced efficiently during cooling it is recommended to adopt a two-step cooling method comprising ① a step of cooling the steel sheet to a temperature (Tq) of ($A_1$ point to 600° C.) at an average cooling rate of not higher than 15° C./s and ② a step of cooling the steel sheet to a temperature of not lower than 300° C. and not higher than 480° C. at an average cooling rate of not lower than 20° C./s.

If cooling is performed to the above temperature range ① at an average cooling rate of not higher than 15° C./s (preferably not higher than 10° C./s), C is concentrated to γ in a larger amount. Next, if cooling is performed to the above temperature range ② at an average cooling rate of not lower than 20° C./s (preferably not lower than 30° C./s, more preferably not lower than 40° C./s), the transformation of γ into pearlite is suppressed and γ remains behind even at a low temperature. As a result, there is obtained a desired γ structure. An upper limit of the average cooling rate is not specially limited. The higher, the more desirable. However, in relation to the actual operation level, it is recommended to control the upper limit appropriately.

The above cooling is followed by austempering. The austempering temperature (T4) is important for ensuring a desired structure and allowing the present invention to fulfill its operation. If the austempering temperature is controlled to a temperature in the foregoing range, there will be obtained $\gamma_R$ stably in a large quantity, whereby TRIP effect based on $\gamma_R$ is exhibited. In contrast therewith, if the austempering temperature is lower than 300° C., martensite phase will exist, while if it exceeds 480° C., the amount of bainite phase will increase to a great extent.

An upper limit of the holding time (t4) is not specially limited, but if the time taken for transformation of austenite into bainite is taken into account, it is recommended to control the upper limit to a time of not longer than 3000 seconds, preferably not longer than 2000 seconds.

In the above process, bainite structure may be produced insofar as it does not impair the operation of the present invention, in addition to the desired base phase structure (tempered martensite or tempered bainite) and martensite. Further, plating and alloying may be performed insofar as the desired structure is not decomposed markedly nor does the application of plating and alloying impair the operation of the present invention.

For producing an alloyed, hot dip galvanized steel sheet it is recommended to carry out a predetermined Fe preplating prior to the above plating. This for the following reason. This causes an Fe plated layer not affected by surface concentration of Si to be formed on the steel sheet surface and the number of coarse Zn—Fe alloy crystal grains present on the alloyed, hot dip galvanized layer surface is decreased to a remarkable extent. Thus, even at a low temperature, alloying is carried out quickly by diffusion of the steel sheet and the Zn plated layer, whereby not only $\gamma_R$, which is effective in obtaining a high elongation characteristic stable, is obtained efficiently, but also it is possible to prevent the occurrence of disadvantages caused by the addition of a large amount of Si [e.g., deterioration of powdering resistance caused by Si oxide, failure to effect plating, deterioration in sliding property (slip characteristic) of the plated surface].

The coarse Zn—Fe alloy crystal grains present on the alloyed, hot dip galvanized layer surface mean Zn—Fe alloy crystal grains each having a major side twice as long as a minor side, or less, and having an average grain diameter of 4 μm or more. By Fe pre-plating it is possible to decrease the number of such coarse crystal grains to five or less (preferably three or less)/70 μm×50 μm. The average grain diameter of the Zn—Fe alloy crystal grains is determined by observing the alloyed layer surface through an SEM (scanning electron microscope) (1500×) and calculating an average length between a length measured in a largest length direction of the crystal grains present in a visual field of 70 μm×50 μm and a length in a direction orthogonal thereto.

More specifically, the above (a) Fe pre-plating is carried out before the steel sheet passes a continuous plating line [a series of such line as CGL: annealing→(b) hot dip galvanizing (same as the above ①)→alloying].

The steps (a) to (c) will be described below.

(a) Fe Pre-plating

The pre-plating step (a) is carried out under conditions which satisfy the following relation (1):

$$0.06W \leqq X \quad (1)$$

where W stands for the amount of hot dip Zn plating deposited ($g/m^2$) and X stands for the amount of Fe pre-plating deposited ($g/m^2$)

First, the amount (X) of Fe pre-plating is controlled to a value of not smaller than 0.06 W in relation to the amount (W) of hot dip Zn plating deposited. This is because, if X is less than 0.06 W, Si concentrates on the steel sheet surface as alloying proceeds, causing the formation of coarse Zn—Fe alloy crystal grains which exert a bad influence on the sliding property of the plated surface. Preferably, X is 0.08 W or more, more preferably 0.10 W or more. An upper limit of W is not specially limited from the standpoint of improving the sliding property of the plated surface, but if X is too much, an increase of cost and deterioration of productivity will result. Therefore, it is recommended to control the upper limit to 0.30 W, preferably 0.28 W or less, more preferably 0.25 W or less.

For effecting Fe pre-plating under conditions which satisfy the foregoing relation (1), it is recommended to carry out the conventional plating while paying attention to electrolysis time. To be more specific, it is recommended to set a plating bath composition to $FeSO_4.7H_2O$: 300 to 450 g/L), a plating bath pH to 1.7 to 2.6, a plating liquid temperature to 40 to 70° C., a current density to 10 to 250 $A/dm^2$, and control the electrolysis time appropriately in accordance with a desired amount of plating to be deposited.

Since the Fe pre-plating is followed by hot dip galvanizing and subsequent alloying, the Fe pre-plating vanishes in the plated surface layer portion, but at the interface between the steel sheet and the alloyed, hot dip galvanized layer there may remain the Fe pre-plating layer insofar as it does not impair the operation of the present invention.

(b) Hot Dip Galvanizing

The Fe plating is followed by annealing and subsequent hot dip galvanizing referred to in the above ②. The detailed thereof are as described in the above ②.

In the hot dip galvanizing step it is recommended that an effective Al concentration in the plating bath be controlled to a value in the range of 0.08 to 0.12 mass % and the plating bath temperature to a temperature in the range of 4450 to 500° C. This is because alloying is accelerated and powdering resistance is improved remarkably thereby.

First, it is preferable that an effective Al concentration in the plating bath be controlled to 0.08 to 0.12%. The "effective Al concentration in the plating bath" means the concentration free Al contained in the plating bath and in more detail it is represented by the following expression:

[Effective Al concentration]=[Total Al concentration]−[Fe concentration (%) in the plating bath]

Generally, in the hot dip galvanizing step the effective Al concentration in the plating bath is controlled to a value in the range of about 0.08 to 0.14%. However, in the above series of methods (a) to (c) the alloying temperature is set low for the purpose of obtaining a desired $\gamma_R$, which will be described later. Therefore, alloying no longer takes place as the Al concentration becomes higher. In the present invention, therefore, the upper limit of Al concentration is controlled preferably to 0.12% (more preferably 0.11%). However, if the Al concentration is lower than 0.08%, a lowering of powdering resistance will result. More preferably, the Al concentration is not lower than 0.09%.

It is preferable that the plating bath temperature be controlled to a temperature in the range of 445° to 500° C. A general plating bath temperature is 430° to 500° C., but in the present invention, since Si which suppresses alloying is added in a large amount, the plating bath temperature range is set to the above range for the purpose of accelerating alloying and enhancing the powdering resistance. If the plating bath temperature is lower than 445° C., there will remain an η layer (pure zinc). More preferably, the plating bath temperature is not lower than 450° C. On the other hand, a plating bath temperature exceeding 500° C. will result in a lowering of powdering resistance. More preferably, the plating bath temperature is not higher than 490° C.

(c) Alloying

It is recommended that alloying be carried out at a temperature of 400° to 470° C. for 5 to 100 seconds. If the alloying temperature is lower, the alloying will slow down, with consequent deterioration of productivity. On the other hand, if the alloying temperature is higher, $\gamma_R$ once produced will vanish. If the alloying time is shorter, alloying does not take place and there will remain an η layer (pure zinc) on the surface. Conversely, a longer alloying time will lead to a lowering of productivity.

Although reference has been made above to preferred modes which go through Fe pre-plating in the production of an alloyed, hot dip galvanized steel sheet, the Fe pre-plating is applicable not only to the production of an alloyed hot dip galvanized steel sheet but also to the production of a hot dip galvanized steel sheet. More specifically, in producing a hot dip galvanized steel sheet, if the foregoing (a) Fe pre-plating and (b) hot dip galvanizing are performed, an Fe plated layer not affected by surface concentration of Si is formed on the steel sheet surface, so that not only there is efficiently obtained $\gamma_R$ which is effective in obtaining a high elongation characteristic, but also the occurrence of disadvantages caused by the addition of a large amount of Si can be prevented. Thus, the application of the plating steps in question is extremely useful.

(2) [Hot Rolling Process]→[Cold Rolling Process]→[First Continuous Annealing Process]→[Second Continuous Annealing Process or Plating Process]

Figure 9:
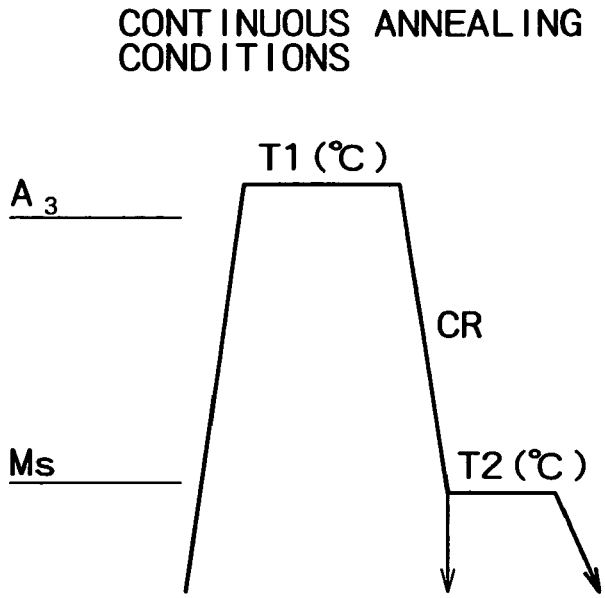
FIG. 9 illustrates the first continuous annealing process in the method (2), (6), or (10) in the case where a base phase structure is tempered martensite.
Figure 10:
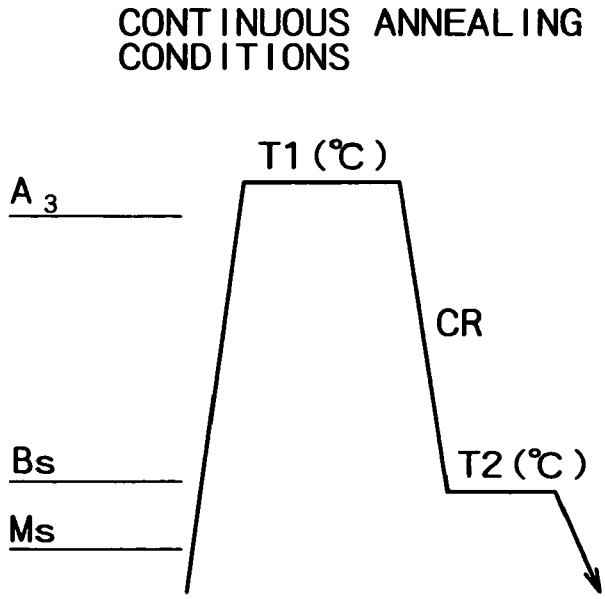
FIG. 10 illustrates the first continuous annealing process in the method (2), (6), or (10) in the case where a base phase structure is tempered bainite.

This method produces a desired steel sheet through a hot rolling process, a cooling process, a first continuous annealing process, and a second annealing process or a plating process. Of these processes, the first continuous annealing process which features this method is illustrated in FIG. 9 (in case of a base phase structure being quenched martensite) and FIG. 10 (in case of a base phase structure being quenched bainite).

First, the hot rolling process and the cooling process are carried out. Conditions for these processes are not specially limited, but there may be selected suitable working conditions. This is because in this method (2) it is not that a desired structure is ensured through the hot rolling process and the cooling process, but this method is characteristic in that the desired structure is obtained by controlling the subsequent first continuous annealing process and second continuous annealing process or plating process.

To be more specific, in the hot rolling process there may be adopted for example conditions such that after the end of hot rolling at a temperature of not lower than $A_{r3}$ point, cooling is performed at an average cooling rate of about 30° C./s, followed by winding at a temperature of about 500° to 600° C. In the cooling process it is recommended that cold rolling be carried out at a cooling rate of about 30% to 70%. Of course, no limitation is made thereto.

Next, a description will be given below about the first continuous annealing process ③ and the second continuous annealing process or plating process ④ as processes which feature the method (2).

③ First Continuous Annealing Process (First Continuous Annealing Process)

This process comprises a step of holding the steel sheet in a heated state at a temperature of not lower than $A_3$ point and a step of cooling the steel sheet to a temperature of not higher than Ms point or a temperature of not lower than Ms point and not higher than Bs point at an average cooling rate of 10° C./s. These conditions have been set for obtaining a desired base phase structure (quenched martensite or quenched bainite).

First, after soaking to a temperature of not lower than $A_3$ point (T1 in FIGS. 9 and 10) (preferably 1300° C. or lower), cooling is performed to a temperature of not higher than Ms point (T2 in FIG. 9) or a temperature of not lower than Ms point and not higher than Bs point (T2 in FIG. 10) while controlling an average cooling rate (CR) to a 20° C./s or higher (preferably 30° C./s or higher), whereby a desired quenched martensite or quenched bainite is obtained while avoiding ferrite transformation or pearlite transformation.

If the average cooling rate (CR) is lower than the above cooling rate, there will be produced ferrite and pearlite and the desired structure will not be obtained. An upper limit of the average cooling rate is not specially limited. The higher, the better. However, it is recommended to control the upper limit appropriately in relation to the actual operation level.

④ Second Continuous Annealing Process (Subsequent Continuous Annealing Process) or Plating Process This process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range from 1 second or more.

This process is the same as the continuous annealing process or plating process ② described in the foregoing method (1). This process has been established for tempering the base phase structure (quenched martensite or quenched bainite) produced in the first continuous annealing process ③ to obtain not only a desired tempered martensite but also a fine, second phase structure.

For producing an alloyed, hot dip galvanized steel sheet it is recommended to adopt the foregoing series of methods (a) to (c). This is because the number of "coarse crystal grains" present on the surface of the alloyed, hot dip galvanized layer is decreased, so that there is obtained a steel sheet superior also in the sliding property of the plated surface while ensuring the ductility improving effect based on $\gamma_R$. The details thereof will become apparent by reference to the above methods.

(B) Steel Sheet with a Base Phase Structure Being a Mixed Structure of (Tempered Martensite and Ferrite) or (Tempered Bainite and Ferrite)

The following methods (3) and (4) are mentioned as typical methods for producing this steel sheet.

(3) [Hot Rolling Process]→[Continuous Annealing Process or Plating Process]

This method produces a desired steel sheet through ① a hot rolling process and ② a continuous annealing process or a plating process. The hot rolling process ① is illustrated in FIG. 6 in case of a base phase structure comprising quenched martensite and ferrite and in FIG. 7 in case of a base phase structure comprising quenched bainite and ferrite. The continuous annealing process or plating process ② is illustrated in FIG. 8.

① Hot Rolling Process

The hot rolling process comprises a step of terminating finish rolling at a temperature of not lower than $(A_{r3}-50)$° C. and a step of cooling the rolled steel sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s and winding up the steel sheet These hot rolling conditions have been established for obtaining a desired base phase structure (a mixed structure of quenched martensite and ferrite or of quenched bainite and ferrite), of which the hot rolling finish condition is as described in the hot rolling process ① in connection with the foregoing method (1).

The hot rolling finish is followed by cooling. In the method according to the present invention, by controlling the cooling rate (CR), ferrite is partially produced during cooling to provide a two phase region ($\alpha+\gamma$), followed by cooling to a temperature of not higher than Ms point or a temperature of not lower than Ms point and not higher than Bs point, whereby it is possible to obtain a desired mixed structure.

The following methods (a) and (b), preferably (b), are mentioned as methods for the above cooling. (a) A one-step cooling method in which, at an average cooling rate of not lower than 10° C./s (preferably not lower than 20° C./s), cooling is made to a temperature of not higher than Ms point or a temperature of not lower than Ms point and not higher than Bs point while avoiding pearlite transformation. At this time, by controlling the average cooling rate appropriately, there can be obtained a desired mixed structure (quenched martensite and ferrite, or quenched bainite and ferrite). In the present invention it is recommended that the content of ferrite be controlled to a value of not lower than 5% and lower than 30% in terms of a space factor relative to the whole structure. In this case, it is preferred that the average cooling rate be controlled to 30° C./s or higher.

The average cooling rate after hot rolling exerts an influence on not only the formation of ferrite but also the final form of $\gamma_R$. If the average cooling rate is high (preferably 50° C./s or higher), there will be obtained a lath form. An upper limit of the average cooling rate is not specially limited. The higher, the better. However, in relation to the actual operation level it is recommended to control the upper limit appropriately.

Further, for allowing a desired mixed structure to be produced more efficiently during cooling, it is recommended to adopt (b) a two-step cooling method which comprises ① a step of cooling the steel sheet to a temperature in the range of 700±100° C. (preferably 700±50° C.) at an average cooling rate (CR1) of not lower than 30° C./s, ② a step of cooling the steel sheet with air in the said temperature range for 1 to 30 seconds, and ③ a subsequent step of cooling the steel sheet to a temperature of not higher than Ms point or a temperature of not lower than Ms point and not higher than Bs point at an average cooling rate (CR2) of not lower than 30° C./s and winding up the steel sheet. By such stepwise cooling, polygonal ferrite low in dislocation density can be produced in a more positive manner.

In both temperature ranges ① and ③ it is recommended that cooling be done at an average cooling rate of not lower than 30° C./s, preferably not lower than 40° C./s. An upper limit of the average cooling rate is not specially limited. The higher, the better. But it is recommended to control the upper limit appropriately in relation to the actual operation level.

In the above temperature range ② it is preferable that air cooling be done for 1 second or more, more preferably 3 seconds or more, whereby a predetermined amount of ferrite can be obtained efficiently. However, if the air cooling time exceeds 30 seconds, ferrite will be produced in an amount exceeding a preferred quantitative range thereof, resulting in that not only it is impossible to obtain a desired strength, but also the stretch flange formability is deteriorated. Preferably, the air cooling time is not longer than 20 seconds.

The winding temperature (CT) is as described in the foregoing (1)-①.

In the hot rolling process it is recommended that the constituent steps be controlled appropriately in order to obtain a desired base phase structure. But as to other conditions, including heating temperature, there may be adopted conventional conditions (e.g., about 1000 to 1300° C.) as necessary.

② Continuous Annealing Process or Plating Process

After the hot rolling process ① there is performed continuous annealing or plating. But if the shape after hot rolling is unsatisfactory, then for the purpose of correcting the shape there may be performed cooling after the hot rolling ① and before the continuous annealing or plating ②. It is recommended that the cooling rate be set in the range of 1% to 30%.

This continuous annealing or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more. These conditions have been established for tempering the base phase structure produced in the hot rolling process to afford not only a desired mixed structure (tempered martensite and ferrite, or tempered bainite and ferrite) but also a desired second phase structure. The details thereof are as described above in the continuous annealing process or plating process ② in connection with the foregoing method (1).

The above cooling is followed by austempering, the details of which are as described above in the continuous annealing process or plating process ② in connection with the foregoing method (1).

For producing an alloyed, hot dip galvanized steel sheet it is recommended to adopt the series of methods (a) to (c) described above. This is because by adopting those methods the number of "coarse grain particles" present on the surface of the alloyed, hot dip galvanized layer is decreased, so that there is obtained a steel sheet superior also in the sliding property of the plated surface while ensuring the ductility improving effect based on $\gamma_R$. The details thereof will become apparent by reference to the foregoing method.

(4) [Hot Rolling Process]→[Cold Rolling Process]→[First Continuous Annealing Process]→[Second Continuous Annealing Process or Plating Process]

Figure 11:
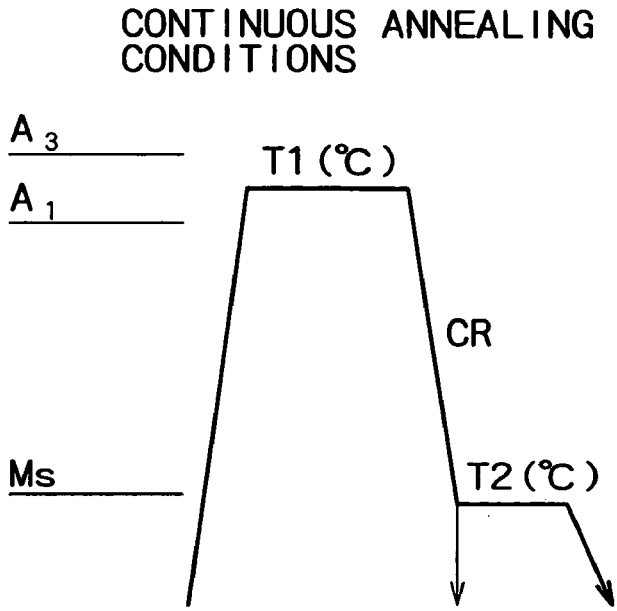
FIG. 11 illustrates the first continuous annealing process in the method (4), (8), or (12) in the case where a base phase structure comprises tempered martensite and ferrite.
Figure 12:
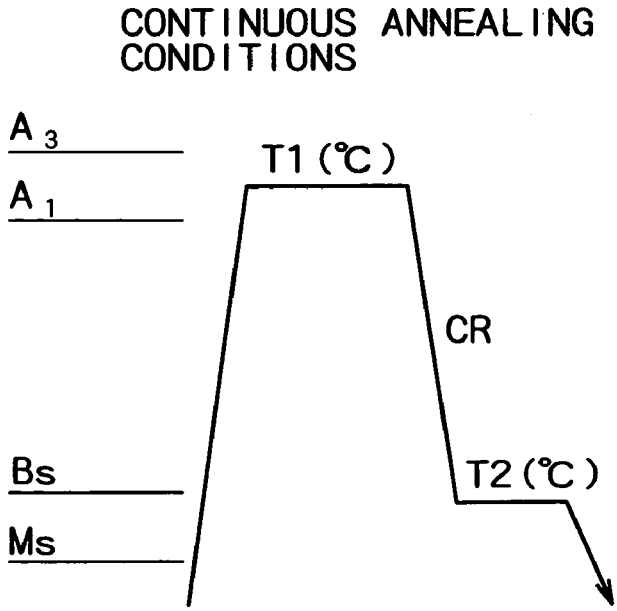
FIG. 12 illustrates the first continuous annealing process in the method (4), (8), or (12) in the case where a base phase structure comprises tempered bainite and ferrite.

This method (4) produces a desired steel sheet through a hot rolling process, a cooling process, a first continuous annealing process, and a second continuous annealing process or a plating process. Of these processes, the first continuous annealing process which features the method (4) is illustrated in FIG. 11 in case of a base phase structure comprising quenched marternsite and ferrite and in FIG. 12 in case of a base phase structure comprising quenched bainite and ferrite.

First, hot rolling and cooling are carried out. These processes are not specially limited. Usually, suitable working conditions may be selected and adopted, the details of which are as described in connection with the foregoing method (2).

Next, a description will be given below about ③ the first continuous annealing process and ④ the second continuous annealing process or the plating process as processes which feature the method (4).

③ First Continuous Annealing Process (Initial Continuous Annealing Process)

This process comprises a step of holding the steel sheet in a heated state at a temperature of not lower than $A_1$ point and not higher than $A_3$ point and a step of cooling the steel sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s. These conditions have been established for obtaining a desired base phase structure.

First, soaking is performed to a temperature of not lower than $A_1$ point and not higher than $A_3$ point (T1 in FIGS. 11 and 12) (preferably 1300° or lower). Ferrite is produced partially during soaking if the soaking temperature is in the range of $A_1$ to $A_3$ or during cooling if the soaking temperature is not lower than $A_3$ point to provide two phases of [ferrite ($\alpha$)+$\gamma$], followed by cooling to a temperature of not higher than Ms point or a temperature of not lower than Ms point and not higher than Bs point to obtain desired ($\alpha$+quenched martensite) or ($\alpha$+quenched bainite).

After the above soaking, an average cooling rate (CR) is controlled to 10° C./s or higher (preferably 20° C./s or higher) and cooling is allowed to proceed to a temperature of not higher than Ms point (T2 in FIG. 11) or a temperature of not lower than Ms point and not higher than Bs point (T2 in FIG. 12) to obtain a desired mixed structure (quenched martensite and ferrite, or quenched bainite and ferrite) while avoiding pearlite transformation. In the present invention it is recommended that the content of ferrite be controlled to a value of not less than 5% and less than 30%. In this case, it is preferable that the average cooling rate be controlled to 30° C./s or higher.

The average cooling rate exerts an influence not only on the formation of ferrite but also on the final form of $\gamma_R$, and a high average cooling rate (preferably 50° C./s or higher) will result in a lath form. An upper limit of the average cooling rate is not specially limited. The higher, the better. But it is recommended to control the upper limit appropriately in relation to the actual operation level.

④ Second Continuous Annealing Process (Subsequent Continuous Annealing Process)

This process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more. This process is the same as the second continuous annealing process or plating process ④ in the foregoing method (2) and has been established for tempering the base phase structure produced in the first continuous annealing process ③ to afford not only a desired structure but also a desired second phase structure.

For producing an alloyed, hot dip galvanized steel sheet it is recommended to adopt the foregoing series of methods (a) to (c). With those methods, the number of "coarse crystal grains" present on the surface of the alloyed, hot dip galvanized layer is decreased, so that there is obtained a steel sheet superior also in sliding property of the plated surface while ensuring the ductility improving effect based on $\gamma_R$. The details thereof will become apparent by reference to the foregoing methods.

Next, the following description is provided about the second high strength steel sheet according to the present invention.

Having made studies earnestly for producing a low alloyed TRIP steel sheet having high stretch flange formability and elongation and yet superior in fatigue characteristic, we found out that the expected object could be achieved by making control to predetermined base phase structure and second phase structure described in connection with the above first high strength steel sheet and by suppressing the formation of a coarse second phase structure, and accomplished the present invention on the basis of that finding. More particularly, a most important point of the present invention resides in the finding that the foregoing phase structure containing tempered martensite or tempered bainite is extremely useful in improving the stretch flange formability and total elongation and that suppressing the formation of coarse crystal grains in the second phase structure which contains retained austenite is effective in improving the stretch flange formability and fatigue characteristic. With this finding, we were the first to provide a low alloyed TRIP steel sheet having both a remarkably improved stretch flange formability and a satisfactory fatigue characteristic while ensuring such a good strength-ductility balance as in the conventional retained austenite steel sheet.

A detailed reason why such excellent characteristics are obtained is not clear, but it is presumed that if there is used as the base phase structure a soft lath structure containing tempered martensite or tempered bainite, martensite is produced between the laths in the course of formation of the structure, thus affording a very fine structure, with consequent improvement of stretch flange formability and further improvement of elongation, and that since the method according to the present invention includes a step for precipitating a carbide (cementite) between the laths of quenched martensite or quenched bainite, the formation of a coarse second phase structure is suppressed, resulting in not only the stretch flange formability but also fatigue characteristic being improved.

Reference will first be made below to the second phase structure which features the second steel sheet to the greatest extent. The base phase structure in the second steel sheet is the same as that in the first steel sheet described above.

It is necessary for the second phase structure to satisfy the structure of the first steel sheet described above and further satisfy the following expression (1):

$$(S1/S)\times 100 \leqq 20 \quad (1)$$

where S stands for a total area of the second phase structure and S1 stands for a total area of coarse second phase structure crystal grains (Sb) present in the second phase structure, the Sb occupying three times or more of an average crystal grain area (Sm) of the second phase structure.

The above expression (1) means that the ratio of coarse crystal grains [those three times or more as large as an average crystal grain area (Sm) of the second phase structure] to the whole of the second phase structure which contains retained austenite is to be suppressed to 20% or less in terms of an area ratio. With this expression, it is intended to improve fatigue characteristic. According to the results of our studies it has turned out that the lowering in fatigue characteristic of the TRIP steel sheet is attributable to the formation of coarse $\gamma_R$ and the fatigue characteristic is improved if the coarse $\gamma_R$ is diminished and that, for example, such a tempering process as will be described later [allowing a carbide (cementite) to be precipitated between laths of the base phase structure] is effective for that purpose.

A specific calculating method in connection with the foregoing expression (1) is as follows.

First, a steel sheet is subjected to Lepera etching and is then observed through an optical microscope (×1000) to provide two pictures of steel sheet structure. Then, an area of 50 μm×50 μm is selected and cut out arbitrarily from each of the photographs. With respect to the two pictures thus cut out there are determined a total area of the second phase structure ($\gamma_R$, martensite as necessary) relative to the total area of the two pictures (50 μm×50 μm×2), as well as an average crystal grain area (Sm) of the second phase structure.

Next, there is calculated a total area of coarse second phase crystal grains (Sb) present in the second phase structure. To be more specific, crystal grains having an average area three times as large as the average crystal grain area (Sm) of the second phase structure determined by the above method are defined to be "coarse second phase crystal grains (Sb)," then the coarse second phase crystal grains (Sb) are totaled and the result is assumed to be a total area (S1) of Sb.

If (S1/S)×100 is 20 or less, the steel sheet concerned is superior in fatigue characteristic [fatigue endurance ratio (fatigue strength $\sigma_w$/yield strength YP)]. As to the said ratio, the smaller, the better, and it is recommended to control it to 15 or less, more preferably 10 or less.

Next, a description will be given below of basic components which constitute the second steel sheet. All of the following chemical components are in mass %.

C: 0.06 to 0.25%

C is an element essential for ensuring a high strength and for ensuring $\gamma_R$. More particularly, C is an element important for ensuring a sufficient amount of C in γ phase and for allowing a desired γ phase to remain even at room temperature. However, if C is added in an amount exceeding 0.25%, the weldability will be deteriorated and cementite will become coarse in a tempering process which will be described later, leading finally to coarsening of the second phase structure.

As to the other components than C, they are the same as in the first steel sheet described previously.

How to produce the second steel sheet will be described below structure by structure.

(A) Steel Sheet with a Base Phase Structure Being Tempered Martensite or Tempered Bainite The following methods (5) and (6) are mentioned as typical methods for producing the second steel sheet. These methods are substantially the same as the method (1) and (2) described previously in connection with the first steel sheet. A difference resides in that in the following methods (5) and (6) there is provided a predetermined tempering process between the hot rolling process and the continuous annealing process or the plating process or between the first continuous annealing process and the second continuous annealing process or the plating process.

The methods (5) and (6) will be described below in detail.

(5) [Hot Rolling Process]→[Tempering Process]→[Continuous Annealing Process or Plating Process]

This method produces a desired steel sheet through ① hot rolling process, ② tempering process, and ③ continuous annealing process or plating process. Of these processes, the annealing process ① is illustrated in FIG. 6 (in case of a base phase structure being quenched martensite) and FIG. 7 (in case of a base structure being quenched bainite), and the continuous annealing or plating process ③ is illustrated in FIG. 8.

① Hot Rolling Process

The hot rolling process comprises a step of terminating finish rolling at a temperature of not lower than $(A_{r3}-50)$° C. and a step of cooling the rolled steel sheet to a temperature of not higher than Ms point (in case of abase phase structure being tempered martensite) or a temperature of not lower than Ms point and not higher than Bs point (in case of the base phase structure being tempered bainite) at an average cooling rate of not lower than 20° C./s and winding up the steel sheet. These hot rolling conditions are established for obtaining a desired base phase structure (quenched martensite or quenched bainite).

No matter which base phase structure is to be obtained, it is recommended that a hot rolling finish temperature (FDT) be set at a temperature of not lower than $(A_{r3}-50)$° C., preferably not lower than $A_{r3}$ point. This is for obtaining a desired quenched martensite or quenched bainite in cooperation with subsequent "cooling to a temperature of not higher than Ms point" or "cooling to a temperature of not lower than Ms point and not higher than Bs point."

The hot rolling described above is followed by cooling. As to cooling conditions (CR), it is recommended that cooling be performed to a temperature of not higher than Ms point while avoiding ferrite transformation and pearlite transformation at an average cooling rate of not lower than 20° C./s (preferably not lower than 30° C./s). This permits to obtain a desired quenched martensite or quenched bainite without formation of polygonal ferrite. The average cooling rate after the hot rolling also exerts an influence on the final form of $\gamma_R$, and if the average cooling rate is high, a lath form will result. An upper limit of the average cooling rate is not specially limited. The higher, the better. But it is recommended to control the upper limit appropriately in relation to the actual operation level.

For obtaining quenched martensite it is necessary to set the winding temperature (CT) at a temperature of not higher than Ms point [calculating expression: Ms=561−474×[C]−33×[Mn]−17×[Ni]−17×[Cr]−21×[Mo] where [ ] represents mass % of each element. This is because, if the winding temperature exceeds Ms point, a desired tempered martensite will not be obtained and bainite will be formed.

On the other hand, for obtaining quenched bainite it is necessary to set the winding temperature (CT) at a temperature of not lower than Ms point and not higher than Bs point [calculating expression: Ms is the same as in the above expression; Bs=830−270×[C]−90×[Mn]−37×[Ni]−70×[Cr]−80×[Mo] where [ ] represents mass % of each element. This is because, if the winding temperature exceeds Bs point, a desired quenched bainite will not be obtained, while if the winding temperature is lower than Ms point, tempered martensite will be produced.

In the hot rolling process, it is recommended to control the above constituent steps appropriately in order to obtain a desired quenched martensite or quenched bainite. But as to other conditions, including heating temperature, there may be adopted conventional conditions (e.g., about 1000 to 1300° C.) suitably.

② Tempering Process

The above hot rolling process ① is followed by a tempering process. However, if the shape after the hot rolling is unsatisfactory, then for the purpose of correcting the shape, cooling may be performed after the hot rolling ① and before the tempering ②. In this case, it is recommended to set the cooling rate at 1 to 30%. This is because, if cold rolling is performed at a cooling rate exceeding 30%, the rolling load will increase, making it difficult to carry out cold rolling.

The annealing process comprises carrying out tempering at a temperature of not lower than 400° C. and not higher than $A_{c1}$ point for a period of time of not shorter than 10 minutes and shorter than 2 hours. This tempering process has been established for obtaining a desired $\gamma_R$ (fine $\gamma_R$) which is effective in improving the fatigue characteristic. By going through this tempering process, cementite is precipitated in the lath boundary of the base phase structure (quenched martensite or quenched bainite), and in the subsequent continuous annealing process or plating process ② there is formed a fine $\gamma_R$ with the cementite as nucleus, so that it becomes possible to diminish coarse $\gamma_R$ produced in the pre-austenite grain boundary and block boundary. Further, there accrues an advantage that, since the strength of the steel sheet having been subjected to the above tempering process decreases, a sheet passing load for passage of the sheet to the subsequent continuous annealing process ③ decreases.

More specifically, tempering is carried out at a temperature of not lower than 400° C. and not higher than $A_{c1}$ point (about 700° C.) for a period of time of not shorter than 10 minutes and shorter than 2 hours. This is because if the tempering temperature exceeds this temperature, there will occur an inverse transformation, preventing sufficient precipitation of cementite. Preferably, the tempering temperature is not higher than 650° C. On the other hand, the lower limit of the tempering temperature has been determined so as to permit cementite to be precipitate as short a time as possible, taking productivity into account. Preferably, the lower limit is 450° C. The tempering time is also important for obtaining a desired structure, and if it is shorter than 10 minutes, the precipitation of cementite will be insufficient. Preferably, the tempering time is 15 minutes or longer. On the other hand, if the tempering time is 2 hours or longer, cementite will become coarse to a remarkable extent, not affording the effect of microstructurization of $\gamma_R$. Preferably, the tempering time is not longer than 1 hour.

In case of obtaining a base phase structure of quenched bainite and if, in the above hot rolling process ①, cooling is made to a temperature of not lower than 400° C. and not higher than $A_{c1}$ point at an average cooling rate of not lower than 20° C./s, the tempering process ② is not needed. This is because the foregoing hot rolling process is the same as this tempering process ①. In this case, therefore, the hot rolling process may be immediately followed by continuous annealing or plating ③ which will be described below.

③ Continuous Annealing Process or Plating Process

The above tempering process ② is followed by continuous annealing or plating. This continuous annealing or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in this temperature range for 1 second or more. These conditions have been established for tempering the base phase structure (quenched martensite or quenched bainite) produced in the hot rolling process to obtain not only a desired tempered martensite but also a fine, second phase.

First, soaking is performed at a temperature of not lower than $A_1$ point and not higher than $A_3$ point (T3 in FIG. 8) for 10 to 600 seconds (t3 in FIG. 8) to produce a desired structure (tempered martensite and $\gamma_R$, or tempered bainite and $\gamma_R$) (annealing in two phase region). This is because if the soaking temperature exceeds the above temperature, the resulting structure will all become $\gamma$, while the soaking temperature is lower than the above temperature, a desired $\gamma$ will not be obtained. Further, controlling the heating holding time (t3) is particularly important for obtaining a desired structure. This is because if the holding time is shorter than 10 seconds, tempering will be insufficient and a desired base phase structure (tempered martensite or tempered bainite) will not be obtained. Preferably, the holding time is not less than 20 seconds, more preferably not less than 30 seconds. If the holding time exceeds 600 seconds, it becomes impossible to retain the lath structure which is a feature of tempered martensite or tempered bainite, with consequent deterioration of mechanical characteristics. Preferably, the holding time is not more than 500 seconds, more preferably not more than 400 seconds.

Next, an average cooling rate (CR) is controlled to a rate of not lower than 3° C./s (preferably not lower than 5° C./s) and cooling is made to a temperature of not lower than 300° C. (preferably not lower than 350° C.) while avoiding pearlite transformation, followed by holding in this temperature range for 1 second or more (preferably 5 seconds or more: t4 in FIG. 8) (austempering), whereby the concentration of C to $\gamma_R$ can be done in a large quantity and in an extremely short time.

If the average cooling rate is lower than the above range, there will not be obtained a desired structure and pearlite will be produced. No special limitation is placed on its upper limit. The higher, the better. But it is recommended to control the upper limit appropriately in relation to the actual operation level.

Of the above conditions, particularly the austempering temperature (T4) is important for ensuring the desired structure and allowing the operation of the present invention to be exhibited. If the austempering temperature is controlled to the above temperature range, $\gamma_R$ will be obtained stably in a large quantity, whereby there is exhibited TRIP effect based on $\gamma_R$. An austempering temperature of lower than 300° C. will lead to the presence of martensite phase, while an austempering temperature exceeding 480° C. will result in a largely increased amount of bainite phase.

An upper limit of the holding time (t4) is not specially limited, but when the time taken for transformation of austenite into bainite is considered, it is recommended to control the holding time to a time of not longer than 3000 seconds, preferably not longer than 2000 seconds.

In the above process, in addition to the desired base phase structure (tempered martensite or tempered bainite) and martensite, there may be produced bainite structure insofar as it does not impair the operation of the present invention. Further, plating and alloying may be conducted insofar as the desired structure is not decomposed remarkably nor does the application of plating and alloying impair the operation of the present invention.

(6) [Hot Rolling Process]→[Cold Rolling Process]→[First Continuous Annealing Process]→[Tempering Process]→[Second Continuous Annealing Process or Plating Process]

This method produces a desired steel sheet through a hot rolling process, a cold rolling process, a first continuous annealing process, a tempering process, and a second annealing process or a plating process. Of these processes, the first annealing process which features this method is illustrated in FIG. 9 (in case of a base phase structure being quenched martensite) and FIG. 10 (in case of a base phase structure being quenched bainite).

First, the hot rolling process and the cooling process are carried out. These processes are not specially limited, but conventional conditions may be selected and adopted suitably. This is because in this method (6) the hot rolling process and the cooling process are not for ensuring a desired structure, but a feature of this method resides in controlling the subsequent first continuous annealing process, tempering process, and second continuous annealing process or plating process to obtain a desired structure.

More specifically, as conditions for the hot rolling process there may be adopted such conditions as cooling at an average cooling rate of about 30° C./s after the end of hot rolling conducted at a temperature of not lower than $A_{r3}$ point and winding at a temperature of about 500° to 600° C. In the cooling process it is recommended to perform cold rolling at a cooling rate of about 30% to 70%. It goes without saying that no limitation is made thereto.

Next, the following description is now provided about the first continuous annealing process ④, the tempering process ⑤, and the second continuous annealing process or plating process ⑥, all of which feature this method (6).

④ First Continuous Annealing Process (Initial Continuous Annealing Process)

This process comprises a step of holding the steel sheet in a heated state at a temperature of not lower than $A_3$ point and a step of cooling the steel sheet to a temperature of not higher than Ms point or a temperature of not lower than Ms point and not higher than Bs point at an average cooling rate of not lower than 10° C./s. These conditions have been established for obtaining a desired base phase structure (quenched martensite or quenched bainite).

First, soaking is performed at a temperature of not lower than $A_3$ point (T1 in FIGS. 9 and 10) (preferably not higher than 1300° C.), then an average cooling rate (CR) is controlled to a temperature of not lower than 20° C./s (preferably not lower than 30° C./s) and cooling is made to a temperature of not higher than Ms point (T2 in FIG. 9) or a temperature of not lower than Ms point and not higher than Bs point (T2 in FIG. 10), whereby a desired quenched martensite or quenched bainite is obtained while avoiding ferrite transformation and pearlite transformation.

If the average cooling rate (CR) is lower than the above range, there will be produced ferrite and pearlite and it will be impossible to obtain the desired structure. An upper limit of the average cooling rate is not specially limited. The higher, the better. But it is recommended to control the upper limit appropriately in relation to the actual operation level.

⑤ Tempering Process

This process is the same as the tempering process ② in the foregoing method (5) and has been established for forming a desired fine $\gamma_R$.

In the case where a base phase structure of quenched bainite is to be obtained and if, in the first continuous annealing process ④, cooling is performed to a temperature of not lower than 400° C. and not higher than $A_{c1}$ point at an average cooling rate of not lower than 10° C./s, followed by holding at this temperature for not shorter than 10 minutes and shorter than 2 hours, this tempering process ⑤ becomes unnecessary. This is because the above continuous annealing process is the same as the tempering process ⑤. In this case, the foregoing continuous annealing process may be immediately followed by the second continuous annealing or plating ⑥ which will be described below.

⑥ Second Continuous Annealing Process (Subsequent Continuous Annealing Process) or Plating Process This process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in this temperature range for 1 second or more.

This process is the same as the continuous annealing process or plating process ③ in the foregoing method ⑤ and has been established for tempering the base phase structure (quenched martensite or quenched bainite) produced in the first continuous annealing process ④ to obtain not only a desired tempered martensite but also a desired fine, second phase structure.

(B) Steel Sheet with a Base Phase Structure Being a Mixed Structure of (Tempered Martensite and Ferrite) or (Tempered Bainite and Ferrite)

The following methods (7) and (8) are mentioned as typical methods for producing the second steel sheet according to the present invention. These methods are substantially the same as the foregoing methods (3) and (4) described in connection with the first steel sheet. A difference resides in that in these methods a predetermined tempering process is provided between the hot rolling process and the continuous annealing process or the plating process or between the first continuous annealing process and the second continuous annealing process or the plating process in the methods (3) and (4).

(7) [Hot Rolling Process]→[Tempering Process]→[Continuous Annealing Process or Plating Process]

This method produces a desired steel sheet through ① a hot rolling process, ② a tempering process, and ③ a continuous annealing process or a plating process. Of these processes, the hot rolling process ① is illustrated in FIG. 6 in case of a base phase structure comprising quenched martensite and ferrite and in FIG. 7 in case of a base phase structure comprising quenched bainite and ferrite, and the continuous annealing or plating process ③ is illustrated in FIG. 8.

① Hot Rolling Process

The hot rolling process comprises a step of terminating finish rolling at a temperature of not lower than $(A_{r3}-50)$° C. and a step of cooling the rolled steel sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s and winding up the steel sheet. These hot rolling conditions have been established for obtaining a desired base phase structure (a mixed structure of quenched martensite and ferrite or quenched bainite and ferrite). Of these conditions, the hot rolling finish condition is as described in the hot rolling process ① in connection with the foregoing method (5).

Cooling is performed after the above hot rolling finish. According to the present invention, by controlling the cooling rate (CR), ferrite is partially produced during cooling to provide a two phase region of ($\alpha+\gamma$), and by cooling to a temperature of not higher than Ms point or a temperature of not lower than Ms point and not higher than Bs point there can be obtained a desired mixed structure.

The following methods (a) and (b) are mentioned as methods for the aforesaid cooling.

(a) One-step Cooling

At an average cooling rate of not lower than 10° C./s (preferably not lower than 20° C./s) there is made cooling to a temperature of not higher than Ms point or a temperature of not lower than Ms point and not higher than Bs point while avoiding pearlite transformation. At this time, by controlling the average cooling rate appropriately it is possible to obtain a desired mixed structure (quenched martensite+ferrite, or quenched bainite+ferrite). In the present invention it is recommended to control the ferrite content to not less than 5% and less than 30% in terms of a space factor relative to the whole structure. In this case, it is recommended to control the average cooling rate to 30° C./s or higher.

The average cooling rate after hot rolling exerts an influence not only on the formation of ferrite but also on the final form of $\gamma_R$, and if the average cooling rate is high (preferably 50° C./s or higher), a lath form will result. An upper limit of the average cooling rate is not specially limited. The higher, the better. But it is recommended to control the upper limit appropriately in relation to the actual operation level.

Further, for producing the desired mixed structure more efficiently during cooling, it is recommended to adopt (b) a two-step cooling method which comprises ① a step of cooling the steel sheet to a temperature in the range of 700±100° C. (preferably 700±50° C.) at an average cooling rate (CR1) of not lower than 30° C./s, ② a step of conducting air cooling in the said temperature range for 1 to 30 seconds, and ③ a step of subsequently cooling the steel sheet to a temperature of not higher than Ms point or a temperature of not lower than Ms point and not higher than Bs point at an average cooling rate (CR2) of not lower than 30° C./s and winding up the steel sheet. By thus cooling stepwise, polygonal ferrite low in dislocation density can be produced more positively.

In the temperature ranges ① and ③ it is recommended that cooling be done at an average cooling rate of not lower than 30° C./s, preferably not lower than 40° C./s. An upper limit of the average cooling rate is not specially limited. The higher, the better. But it is recommended to control the upper limit appropriately in relation to the actual operation level.

In the temperature range ② it is preferable that air cooling be done for 1 second or more, more preferably 3 seconds or more, whereby a predetermined ferrite quantity is attained efficiently. However, if the air cooling time exceeds 30 seconds, ferrite will be produced in an amount exceeding the preferred range, with the result that a desired strength is not attained and the stretch flange formability is deteriorated. Preferably, the air cooling time is not longer than 20 seconds.

The winding temperature (CT) is as described in the hot rolling process ① in connection with the foregoing method (5).

In the hot rolling process it is recommended to control each of the constituent steps appropriately in order to obtain a desired base phase structure. As to other conditions, including heating temperature, conventional conditions (e.g., about 1000 to 1300° C.) may be selected suitably.

② Tempering Process

The hot rolling ① described above is followed by tempering. However, if the shape after the hot rolling is unsatisfactory, then for the purpose of correcting the shape there may be performed cooling after the hot rolling ① and before the tempering ②. In this case, it is recommended to set the cold rolling rate at 1 to 30%.

The tempering process has been established for obtaining a desired fine $\gamma_R$ and the details thereof are as described in the tempering process ② in connection with the foregoing method (5).

In the case where a mixed base phase structure of quenched bainite and ferrite is to be obtained and if, in the hot rolling process ①, cooling is made to a temperature of not lower than 400° C. and not higher than $A_{c1}$ point at a predetermined average cooling rate and is followed by holding at this temperature for a period of time of not shorter than 10 minutes and shorter than 2 hours, the tempering process ② becomes unnecessary. This is because the above hot rolling process is the same as this tempering process ②. In this case, the above hot rolling process maybe immediately followed by ③ continuous annealing or plating which will be described later.

③ Continuous Annealing Process or Plating Process

The above tempering process ② is followed by continuous annealing or plating. The continuous annealing or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in this temperature range for 1 second or more. These conditions have been established for tempering the base phase structure produced in the hot rolling process to obtain not only a desired mixed structure (tempered martensite+ferrite, or tempered bainite+ferrite) but also a fine, second phase structure. The details thereof are as described in the continuous annealing process or plating process ③ in connection with the foregoing method (5).

For producing a desired amount of Cγ more efficiently during cooling it is recommended to adopt, for the above cooling step, a two-step cooling method comprising ① a step of cooling the steel sheet to a temperature (Tq) of ($A_1$ point to 600° C.) at an average cooling rate of not higher than 15° C./s and ② a step of cooling the steel sheet to a temperature of not lower than 300° C. and not higher than 480° C. at an average cooling rate of not lower than 20° C./s.

If cooling is made to the above temperature range ① at an average cooling rate of not higher than 15° C./s (preferably not higher than 10° C./s), ferrite is the first to be produced and C contained in the ferrite is concentrated to γ. If cooling is subsequently performed to the above temperature range ② at an average cooling rate of not lower than 20° C./s (preferably not lower than 30° C./s, more preferably not lower than 40° C./s), the transformation of γ into pearlite is suppressed and γ remains even at a low temperature, thus affording the desired $\gamma_R$ structure.

An upper limit of the average cooling rate is not specially limited. The higher, the better. But it is recommended to control the upper limit appropriately in relation to the actual operation level.

The above cooling process is followed by austempering, the details of which are as described in the continuous annealing or plating process ③ in connection with the foregoing method (5).

(8) [Hot Rolling Process]→[Cold Rolling Process]→[First Continuous Annealing Process]→[Tempering Process]→[Second Continuous Annealing Process or Plating Process]

This method (8) produces a desired steel sheet through a hot rolling process, a cooling process, a first continuous annealing process, a tempering process, and a second continuous annealing process or a plating process. Of these processes, the first continuous annealing process which features the method (8) is illustrated in FIG. 11 in case of a base phase structure comprising quenched martensite and ferrite and in FIG. 12 in case of a base phase structure comprising quenched bainite and ferrite.

First, the hot rolling process and the cooling process are executed. These processes are not specially limited. Usually, suitable working conditions may be selected and adopted, the details of which are as described in the foregoing method (6).

A description will be given below about ④ the first continuous annealing process, ⑤ the tempering process, and ⑥ the second continuous annealing process, all of which feature the above method (8).

④ First Continuous Annealing Process (Initial Continuous Annealing Process)

This process comprises a step of holding the steel sheet in a heated state at a temperature of not lower than $A_1$ point and not higher than $A_3$ point and a step of cooling the steel sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s. These conditions have been established for obtaining a desired base phase structure.

First, soaking is performed at a temperature of not lower than $A_1$ point and not higher than $A_3$ point (T1 in FIGS. 11 and 12) (preferably 1300° C. or higher). If soaking is conducted at a temperature of A1 to A3, ferrite is partially produced during soaking, while if soaking is conducted at a temperature of not lower than $A_3$ point, ferrite is partially produced during cooling, to provide two phases of [ferrite (α)+γ], followed by cooling to a temperature of not higher than Ms point or a temperature of not lower than Ms point and not higher than Bs point to obtain desired (α+quenched martensite) or (α+quenched bainite).

After the above soaking step, an average cooling rate (CR) is controlled to a rate of not lower than 10° C./s (preferably not lower than 20° C./s) and cooling is performed to a temperature of not higher than Ms point (T2 in FIG. 11) or a temperature of not lower than Ms point and not higher than Bs point (T2 in FIG. 12) to afford a desired mixed structure (quenched martensite+ferrite, or quenched bainite+ferrite) while avoiding pearlite transformation. In the present invention it is recommended to control the ferrite content to a value of not less than 5% and less than 30%. In this case, it is preferable that the average cooling rate be controlled to 30° C./s or higher.

The average cooling rate exerts not only on the formation of ferrite but also on the final form of $\gamma_R$, and if the average cooling rate is high (preferably 50° C./s or higher), a lath form will result. An upper limit of the average cooling rate is not specially limited. The higher, the better. But it is recommended to control the upper limit appropriately in relation to the actual operation level.

⑤ Tempering Process

This process has been established for obtaining a desired fine $\gamma_R$ and the details of tempering conditions are as described in the tempering process ⑤ in connection with the foregoing method (6).

In the case where a mixed base phase structure of quenched bainite and ferrite is to be obtained and if, in the above continuous annealing process ④, cooling is performed to a temperature of not lower than 400° C. and not higher than $A_{c1}$ point at an average cooling rate of not lower than 10° C./s, followed by holding at this temperature for not shorter than 10 minutes and shorter than 2 hours, the tempering process ⑤ becomes unnecessary. This is because the foregoing first continuous annealing process is the same as the tempering process ⑤. In this case, the first continuous annealing process may be immediately followed by the second continuous annealing or plating process ⑥ which will be described below.

⑥ Second Continuous Annealing Process (Subsequent Continuous Annealing Process) or Plating Process This process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in this temperature range for 1 second or more. This process is the same as the second continuous annealing or plating process Ax in the foregoing method (6) and has been established for tempering the base phase structure produced in the foregoing first continuous annealing process ④ to obtain not only a desired structure but also a fine, second phase structure.

Lastly, reference will be made below to the foregoing third high strength steel sheet.

We have made earnest studies for providing a low alloy TRIP steel sheet having high stretch flange formability and elongation and superior in bake hardening (BH) property, especially a TRIP steel sheet capable of exhibiting an excellent bake hardening property even in a very large strain-loaded area such as an area where suspension members are mounted. As a result we found out the following points and accomplished the present invention.

(1) If control is made so that ① a tempered martensite structure, ② a mixed structure of tempered martensite and ferrite, ③ a tempered bainite structure, and ④ a mixed structure of tempered bainite and ferrite, as soft lath structures low in dislocation density, are each produced as a base phase structure and a structure having a retained austenite ($\gamma_R$) phase is produced as a second phase structure, there is obtained a high strength steel sheet which satisfies the condition of BH(2%)≧70 MPa due to an excellent bake hardening property which each of those structures possesses.

(2) In addition to the above structure control, if retained austenite as a second phase structure is dispersed uniformly and finely (shortening the diffusion distance up to dislocation) in pre-austenite grain boundaries, as well as block and packet boundaries, in the (quenched martensite or quenched bainite) structure prior to tempering, there is obtained a high strength steel sheet which further satisfies the following condition:

$$BH(10\%) \geqq BH(2\%)/2$$

and a very excellent bake hardening property can be ensured even in a very large strain area.

(3) Such a finely dispersed, retained austenite as referred to above can be obtained by controlling the heating temperature (SRT) within a low range before hot rolling to a rather low temperature, allowing rolling to proceed in the austenite region.

In the present invention, a detailed reason why BH property is improved, especially why excellent BH property is obtained even in a large strain area, by more finely dispersing the retained austenite as the second phase, is not clear, but is presumed to be as follows. As noted previously, BH property is obtained by an interaction (fixing of dislocation by C) between dislocation and solid solution C, but particularly in a large strain area there occurs a phenomenon that solid solution C is insufficient, although sufficient dislocation is obtained. However, when the retained austenite as the second phase, which is a supply source of solid solution C, is finely dispersed, the diffusion distance up to dislocation becomes shorter, so that a decrease of BH quantity due to the lack of solid solution C can be prevented. This is presumed to be the reason why an extremely excellent BH property is exhibited.

In connection with the mechanism of "BH property" it is presumed that dislocation which has been introduced into the base phase by working is fixed to C (solid solution C) in steel by heat treatment after working, giving rise to hardening, resulting in an increase of tensile yield stress.

Description is now directed to "BH (2%) quantity" as referred to herein. When a tensile test piece (usually a JIS No. 5 test piece) is pulled up to 2% in terms of a nominal strain, a deformation stress σ1 is measured, then after the removal of load, the test piece is held at 170° C. for 20 minutes, then tensile test is again conducted and an upper yield stress σ2 (a stress corresponding to 0.2% proof stress in the case where a yield point does not appear) is measured. The BH (2%) quantity in question is represented by the difference between σ1 and σ2. (In the working Examples to be described later it will be referred to as BH2.)

"BH (10%) quantity" as referred to herein is measured in the same way as is the case with the above BH (2%) quantity except that in the above measurement of BH (2%) quantity a tensile test piece (usually a JIS No. 5 test piece) is pulled up to 10% in terms of a nominal strain and the resulting deformation stress is measured. In the working Examples to be described later it will be referred to as BH10.

Thus, the BH (2%) quantity defines BH property in an ordinary strain region, while the BH (10%) defines BH property in a large strain region.

The steel sheet according to the present invention satisfies the condition that the BH (2%) quantity should be not less than 70 MPa (preferably not less than 80 MPa, more preferably not less than 90 MPa) and that the BH (10%) quantity should be not less than half of the BH (2%) quantity, (not less than 35 MPa), preferably not less than 40 MPa, more preferably not less than 45 MPa.

As to the base phase structure and the second phase structure both featuring the above steel sheet, they are as described above in connection with the first steep sheet.

A description will be given below about basic components which constitute the above third steel sheet. All of the following chemical components are in mass %.

C: 0.06 to 0.25%

C is an element for ensuring a high strength and for ensuring $\gamma_R$. More particularly, C is an element important for providing a sufficient content of C in $\gamma$ phase and for allowing a desired $\gamma$ phase to remain even at room temperature. However, if C is added in an amount exceeding 0.25%, the weldability will be deteriorated.

Other components than the above C are as described above in connection with the first steel sheet.

How to produce the third steel sheet will be described below structure by structure.

(A) Steel Sheet with a Base Phase Structure Being Tempered Martensite or Tempered Bainite The following methods (9) and (10) are mentioned as typical methods for producing the third steel sheet. These methods are the same as the methods (1) and (2) which have been described above in connection with the first steel sheet except that in these methods the heating temperature (SRT) prior to hot rolling in the methods (3) and (4) is controlled to a temperature of 950 to 1100° C.

A detailed description will be given below about each of the methods.

(9) [Hot Rolling Process]→[Continuous Annealing Process or Plating Process]

This method produces a desired steel sheet through ① a hot rolling process and ② a continuous annealing process or a plating process. The hot rolling process ② is illustrated in FIG. 6 (in case of a base phase structure being quenched martensite) and in FIG. 7 (in case of a base phase structure being quenched bainite) and the continuous annealing process or plating process ② is illustrated in FIG. 8.

① Hot Rolling Process

This process comprises a step of controlling a heating temperature (SRT) before hot rolling to a temperature of 950° to 1100° C. and terminating finish rolling at a temperature of not lower than $(A_{r3}-50)$° C. and a step of cooling the resulting steel sheet to a temperature of not higher than Ms point (in case of a base phase structure being tempered martensite) or a temperature of not lower than Ms point and not higher than Bs point (in case of a base phase structure being tempered bainite) at an average cooling rate of not lower than 20° C./s and winding up the steel sheet. These hot rolling conditions (especially SRT condition) have been established for obtaining a desired base phase structure (quenched martensite or quenched bainite before tempering), also for making the pre-austenite grain diameter fine in (during) hot rolling, and for reducing the block and packet size as a more specific structure size relative to the pre-austenite grain diameter in the (quenched martensite or quenched bainite) structure, to thereby disperse $\gamma_R$ of the second phase structure finely and uniformly in the pre-austenite grain region and block and packet boundaries.

First, the heating temperature (SRT) before hot rolling is controlled to a temperature of 950° to 1100° C. and a hot rolling finish temperature (FDT) is set at a temperature of not lower than $(A_{r3}-50)$° C.

The control of the heating temperature (SRT) before hot rolling is extremely important for obtaining a desired second phase structure (finely dispersed $\gamma_R$) and it is not until controlling the heating temperature to a temperature in the range of 950° to 1100° C. that the above structure can be obtained. A heating temperature lower than 950° C. substantially overlaps the hot rolling finish temperature (FDT) which will be described later. On the other hand, if the heating temperature exceeds 1100° C., it will become impossible to obtain the desired BH property [especially BH (10%)]. Preferably, the heating temperature is not lower than 975° C. and not higher than 1075° C.

In the present invention the SRT is controlled lower than that in the conventional TRIP steel sheet. In the conventional steel sheet the SRT is controlled generally to the range of 1100° C. exclusive to 1300° C. inclusive. However, we have confirmed experimentally that in this temperature range the desired finely dispersed, retained austenite phase is not obtained and an excellent bake hardening property cannot be ensured particularly in a large strain region (see the working Examples to be described later).

Controlling the hot rolling finish temperature (FDT) is important for obtaining a desired quenched martensite or quenched bainite in cooperation with "cooling to a temperature of not higher than Ms point" or "cooling to a temperature of not lower than Ms point and not higher than Bs point" which follows the finish rolling. It is recommended to control the FDT to a temperature of not lower than $(A_{r3}-50)$° C., preferably not lower than $A_{r3}$ point. Like the foregoing SRT, the FDT plays an important role also for obtaining a desired second structure, so in addition to the foregoing control of SRT, if FDT is controlled to a temperature of not lower than $(A_{r3}-50)$° C. and not higher than $A_{r3}$ point, a desired second phase can be obtained more efficiently. That is, by controlling both SRT and FDT to lower values than those for the conventional steel sheet it is possible to ensure an extremely superior BH property.

The above hot rolling process is followed by cooling. It is recommended that cooling be performed at an average cooling rate (CR) of not lower than 20° C./s (preferably not lower than 30° C./s) to a temperature of not higher than Ms point while avoiding ferrite transformation and pearlite transformation. With this cooling, a desired quenched martensite or quenched bainite can be obtained. The average cooling rate after hot rolling exerts an influence also on the final form of $\gamma_R$, and if the average cooling rate is high, a lath form will result. An upper limit of the average cooling rate is not specially limited, and the higher, the better. But it is recommended to control the upper limit appropriately in relation to the actual operation level.

For obtaining quenched martensite it is necessary that the winding temperature (CT) be not higher than Ms point [calculating expression: Ms=561−474×[C]−33×[Mn]−17×

[Ni]−17×(Cr]−21×[Mo] where [ ] represents mass % of each element]. This is because if the winding temperature exceeds Ms point, a desired quenched martensite is not obtained and there are formed bainite, etc.

On the other hand, for obtaining quenched bainite it is necessary to set the winding temperature (CT) at a temperature of not lower than Ms point and not higher than Bs point [calculating expression: Ms is the same as the above expression; Bs=830−270×[C]−90×[Mn]−37×[Ni]−70×[Cr]−80×[Mo] where [ ] represents mass % of each element]. This is because if the winding temperature exceeds Bs point, a desired quenched bainite is not obtained, while if it is lower than Ms point, quenched martensite is produced.

In the hot rolling process it is recommended to control each of the above constituent steps appropriately in order to obtain desired quenched martensite or quenched bainite. But as to other conditions, including heating temperature, conventional conditions (e.g. about 1000 to 1300° C.) may be selected suitably.

② Continuous Annealing Process or Plating Process

The above hot rolling process ① is followed by continuous annealing or plating. However, if the shape after hot rolling is unsatisfactory, then for the purpose of correcting the shape, cooling may be done after the hot rolling ① and before the continuous annealing or plating. In this case it is recommended to set the cold rolling rate at 1 to 30%. This is because if cold rolling is carried out at a cooling rate exceeding 30%, the rolling load will increase, making it difficult to effect cold rolling.

The continuous annealing process or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s and a step of holding the steel sheet in the temperature range for 1 second or more. These conditions have been established for tempering the base phase structure (quenched martensite or quenched bainite) produced in the hot rolling process to afford not only a desired tempered martensite but also a fine, second phase ($\gamma_R$)

First, soaking is performed at a temperature of not lower than $A_1$ point and not higher than $A_3$ point (T3 in FIG. 8) for 10 to 600 seconds (t3 in FIG. 8) to produce a desired structure (tempered martensite and $\gamma_R$, or tempered bainite and $\gamma_R$) (annealing in two phase region). This is because if the soaking temperature exceeds the above temperature, the resulting structure will also become γ, while if it is lower than the above temperature, the desired $\gamma_R$ will not be obtained. Further, controlling the heating holding time (t3) is particularly important for obtaining the desired structure. This is because if the holding time is shorter than 10 seconds, tempering will be insufficient, not affording the desired base phase structure (tempered martensite or tempered bainite). Preferably the holding time is 20 seconds or longer, more preferably 30 seconds or longer. If the holding time exceeds 600 seconds, it becomes impossible to retain the lath structure which is a feature of tempered martensite or tempered bainite, and mechanical properties are deteriorated. Preferably the holding time is not longer than 500 seconds, more preferably not longer than 400 seconds.

Next, the average cooling rate (CR) is controlled to a rate of not lower than 3° C./s (preferably not lower than 5° C./s) and cooling is performed to a temperature (bainite transformation: T4 in FIG. 4) of not lower than 300° C. (preferably not lower than 350° C.) and not higher than 480° C. (preferably not higher than 450° C.) while avoiding pearlite transformation, followed by holding in this temperature range for 1 second or more (preferably 5seconds or more: t4 in FIG. 8) (austempering), whereby the concentration of C to $\gamma_R$ can be obtained in a large quantity and in an extremely short time.

If the average cooling rate is lower than the above range, the desired structure will not be obtained, with formation of pearlite, etc. An upper limit of the average cooling rate is not specially limited, and the higher, the better. But it is recommended to control the upper limit appropriately in relation to the actual operation level.

For producing a desired amount of Cγ more efficiently during cooling, it is recommended that the above cooling step be carried out by a two-step cooling method which comprises ① a step of cooling the steel sheet up to a temperature (Tq) of ($A_1$ point to 600° C.) at an average cooling rate of not higher than 15° C./s and ② a step of cooling the steel sheet to a temperature of not lower than 300° C. and not higher than 480° C. at an average cooling rate of not lower than 20° C./s.

If cooling is performed to the above temperature range ① at an average cooling rate of not higher than 15° C./s (preferably not higher than 10° C./s), C will be concentrated in a larger quantity to γ. If cooling is subsequently performed to the above temperature range ② at an average cooling rate of not lower than 20° C./s (preferably not lower than 30° C./s, more preferably not lower than 40° C./s), the transformation of γ into pearlite is suppressed and there remains γ even at a low temperature, resulting in that the desired $\gamma_R$ structure is obtained. An upper limit of the average cooling rate is not specially limited. The higher, the better. But it is recommended to control the upper limit appropriately in relation to the actual operation level.

The cooling described above is followed by austempering. The austempering temperature (T4) is important for ensuring the desired structure and allowing the operation of the present invention to be exhibited. If control is made to the foregoing temperature range, a stable and large amount of $\gamma_R$ will be obtained, whereby TRIP effect based on $\gamma_R$ is exhibited. If the austempering temperature is lower than 300° C., martensite phase will exist, while if it exceeds 480° C., bainite phase will increase in a large amount.

An upper limit of the holding time (t4) is not specially limited, but when the time taken for transformation of austenite into bainite is considered, it is recommended to control the holding time to a time of not longer than 3000 seconds, preferably not longer than 2000 seconds.

In the above process, in addition to the desired base phase structure (tempered martensite or tempered bainite) and martensite there also maybe produced bainite structure insofar as the operation of the present invention is not impaired. Further, plating and alloying may be performed insofar as the desired structure is not decomposed markedly nor is impaired the operation of the present invention.

(10) [Hot Rolling Process]→[Cold Rolling Process]→[First Continuous Annealing Process]→[Second Continuous Annealing Process or Plating process]

This method (10) produces a desired steel sheet through a hot rolling process, a cold rolling process, a first continuous annealing process, and a second continuous annealing process or plating process. Of these processes, the first continuous annealing process which features this method is illustrated in FIG. 9 (in case of a base phase structure being quenched martensite) and in FIG. 10 (in case of a base phase structure being quenched bainite).

First, the hot rolling process and the cold rolling process are carried out. As noted earlier, controlling the heating temperature (SRT) before hot rolling is extremely important for obtaining a desired second phase structure (finely dispersed $\gamma_R$) It is not until controlling the heating temperature to a temperature in the range of 950° to 1100° C. that the desired structure can be obtained. If the heating temperature is lower than 950° C., it substantially overlaps a hot rolling finish temperature (FDT) which will be described later, while if it exceeds 1100° C., a desired BH property [especially BH (10%)] is not attained. Preferably the heating temperature in question is not lower than 975° C. and not higher than 1075° C.

In the present invention, the SRT is controlled to a lower temperature than in the conventional TRIP sheet. In the conventional steel sheet, the SRT is controlled generally to a temperature in the range of 1100° C. exclusive to 1300° C. inclusive. However, we have confirmed experimentally that with such a temperature range, a desired, finely dispersed, retained austenite phase is not obtained and that it is impossible to ensure an excellent bake hardening property particularly in a large strain region (see the working Examples to be described later).

Other hot rolling and cold rolling conditions are not specially limited, but there may be adopted conventional conditions. To be more specific, for the above hot rolling process there may be adopted such conditions as, after the end of hot rolling at a temperature of not lower than $A_{r3}$ point, cooling the steel sheet at an average cooling rate of about 30° C./s and winding up the steel sheet at a temperature of about 500° to 600° C. In the cold rolling process it is recommended to carry out cold rolling at a cold rolling rate of about 30% to 70%. Of course, no limitation is made thereto.

Next, reference will be made below to ③ the first continuous annealing process and ④ the second continuous annealing process or plating process, both featuring the method (10).

③ First Continuous Annealing Process (Initial Continuous Annealing Process)

This process comprises a step of holding the steel sheet at a temperature of not lower than $A_3$ point and a step of cooling the steel sheet to a temperature of not higher than Ms point or a temperature of not lower than Ms point and not higher than Bs point at an average cooling rate of not lower than 10° C./s. These conditions have been established for obtaining a desired structure (quenched martensite or quenched bainite).

First, soaking is performed at a temperature of not lower than $A_3$ point (T1 in FIGS. 9 and 10) (preferably not higher than 1300° C.), then an average cooling rate (CR) is controlled to a rate of not lower than 20° C./s (preferably not lower than 30° C./s) and cooling is performed to a temperature of not higher than Ms point (T2 in FIG. 9) or a temperature of not lower than Ms point and not higher than Bs point (T2 in FIG. 10), whereby desired quenched martensite or quenched bainite is obtained while avoiding ferrite transformation and pearlite transformation.

If the average cooling rate (CR) is lower than the above range, ferrite and pearlite will be produced and the desired structure will not be obtained. An upper limit of the average cooling rate (CR) is not specially limited. The higher, the better. But it is recommended to control the upper limit appropriately in relation to the actual operation level.

④ Second Continuous Annealing Process (Subsequent Continuous Annealing Process) or Plating Process This process comprises a step of holding the steel sheet at a temperature of not lower than $A_1$ point and not higher than $A_3$ point for 10 to 600 seconds, a step of cooling the steel sheet to a temperature of not lower than 300° C. and not higher than 480° C., and a step of holding the steel sheet in this temperature range for 1 second or more.

This process is the same as the continuous annealing process or plating process ③ in the foregoing method (9) and has been established for tempering the base phase structure (quenched martensite or quenched bainite) produced in the first continuous annealing process ④ to obtain not only a desired tempered martensite but also a fine, second phase-structure.

(B) Steel Sheet with a Base Phase Structure Being a Mixed Structure of (Tempered Martensite and Ferrite) or (Tempered Bainite and Ferrite)

The following methods (11) and (12) are mentioned as typical methods for producing this steel sheet. These methods are the same as the methods (3) and (4) which have been described above in connection with the first steel sheet except that in these methods the heating temperature (SRT) before hot rolling in the methods (3) and (4) is controlled to a temperature of 950° to 1100° C.

(11) [Hot Rolling Process]→[Continuous Annealing Process or Plating Process]

This method produces a desired steel sheet through ① a hot rolling process and ② a continuous annealing process or a plating process. The hot rolling process ① is illustrated in FIG. 6 in case of a base phase structure comprising quenched martensite and ferrite and in FIG. 7 in case of a base phase structure being quenched bainite and ferrite. The continuous annealing process or plating process ② is illustrated in FIG. 8.

① Hot Rolling Process

The hot rolling process comprises a step of controlling the heating temperature (SRT) before hot rolling to a temperature in the range of 950° to 1100° C., a step of terminating finish rolling at a temperature of not lower than $(A_{r3}-50)$° C., and a step of cooling the sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s and winding up the steel sheet. These hot rolling conditions have been established for obtaining a desired base phase structure (quenched martensite and ferrite, or quenched bainite and ferrite) and a second phase structure. Of these conditions, hot rolling start and finish conditions are as described in the hot rolling process ① in the foregoing method (9).

The hot rolling finish step is followed by cooling. According to this method, by controlling the cooling rate (CR), ferrite is partially produced during cooling to provide a two-phase region ($\alpha+\gamma$), and by cooling to a temperature of not higher than Ms point or a temperature of not lower than Ms point and not higher than Bs point it is possible to obtain a desired mixed structure.

For effecting the above cooling step there may be adopted the following method (a) or (b), preferably (b).

(a) A one-step cooling method involving cooling the steel sheet at an average cooling rate of not lower than 10° C./s (preferably not lower than 20° C./s) to a temperature of not higher than Ms point or a temperature of not lower than Ms point and not higher than Bs point while avoiding pearlite transformation. At this time, by controlling the average cooling rate appropriately it is possible to obtain a desired mixed structure (quenched martensite+ferrite, or quenched bainite+ferrite). In the present invention it is recommended to control the ferrite content to not less than 5% and less than 30% in terms of a space factor relative to the whole structure. In this case it is preferable to control the average cooling rate to a rate of not lower than 30° C./s.

The average cooling rate after hot rolling exerts an influence not only on the formation of ferrite but also on the final form of $\gamma_R$, and if the average cooling rate is high (preferably 50° C./s or higher), a lath form will result. An upper limit of the average cooling rate is not specially limited. The higher, the better. But it is recommended to control the upper limit appropriately in relation to the actual operation level.

Further, for producing the desired mixed structure more efficiently during cooling, it is recommended to adopt (b) a two-step cooling method which comprises ① a step of cooling the steel sheet to a temperature in the range of 700±100° C. (preferably 700±50° C.) at an average cooling rate (CR1) of not lower than 30° C./s, ② a step of cooling the steel sheet with air in the said temperature range for 1 to 30 seconds, and ③ a step of subsequently cooling the steel sheet to a temperature of not higher than Ms point or a temperature of not lower than Ms point and not higher than Bs point at an average cooling rate (CR2) of not lower than 30° C./s and winding up the steel sheet. By such stepwise cooling, polygonal ferrite low in dislocation density can be produced more positively.

In both the temperature ranges in the above steps ① and ③ it is recommended to conduct cooling at an average cooling rate of not lower than 30° C./s, preferably not lower than 40° C./s. An upper limit of the average cooling rate is not specially limited, and the higher, the better. But it is recommended to control the upper limit appropriately in relation to the actual operation level.

In the temperature range in the above step ② it is preferable that air cooling be done for 1 second or more, preferably 3 seconds or more, whereby a predetermined ferrite quantity is obtained efficiently. However, if the air cooling time exceeds 30 seconds, the ferrite quantity will exceed a preferred range, making it impossible to attain a desired strength and leading to deterioration of the stretch flange formability. Preferably, the air cooling time is not longer than 20 seconds.

The winding temperature (CT) is as described in the rolling process ① in the foregoing method (9).

In the hot rolling process it is recommended to control each of the above constituent steps appropriately in order to obtain a desired base phase structure. But as to other conditions, including heating temperature, conventional conditions (e.g., about 1000 to 1300° C.) may be selected suitably.

② Continuous Annealing Process or Plating Process

The above hot rolling process ① is followed by continuous annealing or plating. But if the shape after hot rolling is unsatisfactory, then for the purpose of correcting the shape, cooling may be performed after the hot rolling ① and before the continuous annealing or plating ②. In this case, it is recommended that the cooling be done at a cold rolling rate of 1 to 30%.

The continuous annealing or plating process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in the said temperature range for 1 second or more. These conditions have been established for tempering the base phase structure produced in the hot rolling process to afford not only a desired mixed structure (tempered martensite+ferrite, or tempered bainite+ferrite) but also a fine, second phase structure. The details thereof are as described in the continuous annealing process or plating process ③ in connection with the foregoing method (1).

For producing a desired amount of Cγ more efficiently during cooling it is recommended that the above cooling step be carried out by a two-step cooling method which comprises ① a step of cooling the steel sheet to a temperature (Tq) of ($A_1$ point to 600° C.) at an average cooling rate of not higher than 15° C./s and ② a step of cooling the steel sheet to a temperature of not lower than 300° C. and not higher than 480° C. at an average cooling rate of not lower than 20° C./s.

If cooling is made to the temperature range in the above step ① at an average cooling rate of not higher than 15° C./s (preferable not higher than 10° C./s), first ferrite is produced and C contained in the ferrite is concentrated into γ. Subsequently, if cooling is conducted to the temperature range in the above step ② at an average cooling rate of not lower than 20° C./s (preferably not lower than 30° C./s, more preferably not lower than 40° C./s), the transformation of γ into pearlite is suppressed and γ remains even at a low temperature, resulting in that the desired $\gamma_R$ structure is obtained. An upper limit of the average cooling rate is not specially limited. The higher, the better. But it is recommended to control the upper limit appropriately in relation to the actual operation level.

The above cooling step is followed by austempering, the details of which are as described in the continuous annealing or plating process ② in connection with the foregoing method (9).

(12) [Hot Rolling Process]→[Cold Rolling Process]→[First Continuous Annealing Process]→[Tempering Process]→[Second annealing process or Plating process]

This method (12) produces a desired steel sheet through a hot rolling process, a cold rolling process, a first continuous annealing process, a tempering process, and a second annealing process or a plating process. Of these processes, the first continuous annealing process, which features this method (12) is illustrated in FIG. 11 in case of a base phase structure comprising quenched martensite and ferrite and in FIG. 12 in case of a base phase structure comprising quenched bainite and ferrite.

First, the hot rolling process and the cold rolling process are carried out. The details of these processes are as described in the foregoing method (10).

A description will be given below about the first continuous annealing process ③ and the second continuous annealing process or plating process ④, both featuring the method (12).

③ First Continuous Annealing Process (Initial Continuous Annealing Process)

This process comprises a step of holding the steel sheet in a heated state at a temperature of not lower than $A_1$ point and not higher than $A_3$ point and a step of cooling the steel sheet to a temperature of not higher than Ms point (in case of a base phase structure comprising quenched martensite and ferrite) or a temperature of not lower than Ms point and not higher than Bs point (in case of a base phase structure comprising quenched bainite and ferrite) at an average cooling rate of not lower than 10° C./s. These conditions have been established for obtaining a desired base phase structure.

First, soaking is performed at a temperature of not lower than $A_1$ point and not higher than $A_3$ point (T1 in FIGS. 11 and 12) (preferably 1300° C. or lower). Ferrite is partially produced during soaking when soaking is done at a temperature of $A_1$ to $A_3$ or during cooling when soaking is done at a temperature of not lower than $A_3$ point, to provide two phases of [ferrite ($\alpha$)+$\gamma$], followed by cooling to a temperature of not higher than Ms point or a temperature of not lower than Ms point and not higher than Bs point, whereby there is obtained desired ($\alpha$+quenched martensite) or ($\alpha$+quenched bainite).

After the above soaking step, an average cooling rate (CR) is controlled to a rate of not lower than 10° C./s (preferably not lower than 20° C./s) and cooling is performed to a temperature of not higher than Ms point (T2 in FIG. 11) or a temperature of not lower than Ms point and not higher than Bs point (T2 in FIG. 12), whereby a desired mixed structure (quenched martensite+ferrite, or quenched bainite+ferrite) while avoiding pearlite transformation. In the present invention it is recommended to control the ferrite content to a value of not less than 5% and less than 30%. In this case, it is preferable to control the average cooling rate to 30° C./s or higher.

The average cooling rate exerts an influence not only on the formation of ferrite but also on the final form of $\gamma_R$, and if the average cooling rate is high (preferably 50° C./s or higher), a lath form will result. An upper limit of the average cooling rate is not specially limited. The higher, the better. But it is recommended to control the upper limit appropriately in relation to the actual operation level.

④ Second Continuous Annealing Process (Subsequent Continuous Annealing Process) or Plating Process This process comprises a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in this temperature range for 1 second or more. This process is the same as the second continuous annealing process or plating process ⑥ in the foregoing method (2) and has been established for tempering the base phase structure produced in the first continuous annealing process ③ to afford not only a desired structure but also a fine, second phase structure.

The present invention will be described in detail below by way of working Examples thereof. It is to be understood that the following Examples do not restrict the present invention and that changes and execution thereof within a scope not departing from the above and later-described gists of the invention are all included in the technical scope of the invention.

EXAMPLES

Example 1

A Study (Part 1) of Components Compositions in the First High Strength Steel Sheet (Base Phase Structure: Tempered Martensite)

In this Example a check was made about the influence of varying components' compositions on mechanical properties mainly with respect to low C steels having a C content of not higher than 0.25% [steels high in strength (TS)× stretch flange formability ($\lambda$) and taking weldability into account]. More specifically, steel samples comprising components' compositions described intablel (unit in the table is mass %) were vacuum-melted into slabs for experiment and thereafter hot-rolled steel sheets having a thickness of 2.0 mm were produced in accordance with the foregoing method (1) (hot rolling→continuous annealing).

More particularly, each of the slabs was heated at 1150° C. for 30 minutes, then the finish temperature (FDT) was set at 900° C. and cooling was performed to room temperature at an average cooling rate of 50° C./s (hot rolling process), followed by annealing in two phase region for 120 seconds, subsequent cooling to 400° C. at an average cooling rate of 30° C./s, and holding at this temperature for 30 seconds (austempering). These conditions were used as basic conditions.

Steel sheets thus produced were then measured for tensile strength (TS), elongation [total elongation (El)], yield strength (YP), and stretch flange formability (hole expanding property: $\lambda$), in the following manner.

In a tensile test, using a JIS No. 5 test piece, there were measured tensile strength (TS), elongation (El), and yield strength (YP). A strain rate in the tensile test was set at 1 mm/sec.

In a stretch flange formability test there was used a disc-like test piece having a diameter of 100 mm and a thickness of 2.0 mm. More specifically, a hole 10 mm in diameter was formed by punching and was subjected to a hole expanding work on burr with a 60° conical punch, then a hole expanding rate ($\lambda$) upon crack penetration was measured (Japan Steel Federation JFST 1001).

As to an area fraction of structure in each of the above steel sheets, each steel sheet was subjected to Lepera etching, then the structure thereof was identified by observation under a transmission electron microscope (TEM; magnification 15000×), and thereafter a space factor of the structure was measured by observation through an optical microscope (magnification 1000×). The space factor of $\gamma_R$ and the concentration of C in $\gamma_R$ were measured by an X-ray diffraction method after chemical polishing, following grinding the steel sheet to a quarter thickness thereof (ISIJ Int. Vol.33.(193,3), No. 7, P.776).

The results obtained are shown in Table 2.

[See Tables 1, 2]

The following can be seen from the results thus obtained (all of the following No. mean Run No. in Table 2).

First, No. 2 to 5 and 7 to 15, which satisfy the components specified in the present invention, afforded steel sheets of satisfactory characteristics.

Figure 13:
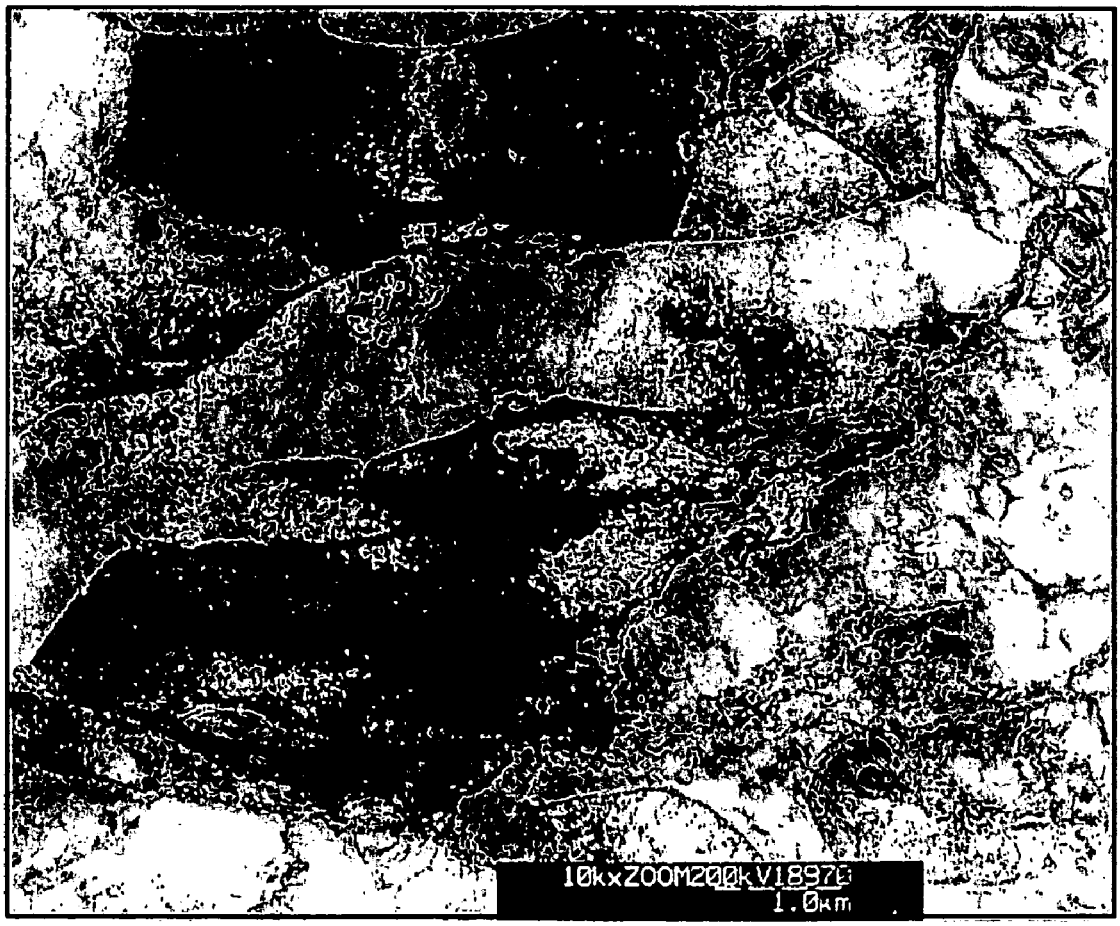
FIG. 13 is a TEM photograph of No. 3 in Example 1.

For reference, a TEM photograph (magnification: 15000×) of a steel sheet (No. 3) according to the present invention is shown in FIG. 13. From this photograph it is seen that the steel sheet according to the present invention has tempered martensite of a clear lath structure.

In contrast therewith, the following steel sheets not satisfying any of the components specified in the present invention have the following disadvantages.

First, No. 1, which is an example of a small amount of C, is low in both TS and El because desired tempered martensite and $\gamma_R$ are not obtained.

No. 6, which is an example of a small total amount of (Si+Al) and a small amount of Mn, is as low as 20% in El because a desired $\gamma_R$ is not obtained.

For reference, results of characteristic evaluation on conventional TRIP steel sheets are shown in Table 3. Of these steel sheets, No. 1 is a DP steel sheet of ferrite and martensite using No. 2 steel sample shown in Table 1, No. 2 is a TRIP steel sheet using No. 3 steel sample in Table 1 and with polygonal ferrite as a base phase, and No. 3 is a two phase steel sheet of ferrite and bainite, using No. 2 steel sample shown in Table 1.

[See Tables 3]

Reference to Table 3 shows that No. 1 is deteriorated in both elongation and stretch flange formability, No. 2 is deteriorated in stretch flange formability, and No. 3 is deteriorated in elongation.

Example 2

A Study (Part 2) of Components' Compositions in the First High Strength Steel Sheet (Base Phase Structure: Tempered Martensite)

In this Example a check was made about the influence of varying components' compositions on mechanical properties mainly with respect to high C steels having a C content of 0.25 to 0.6% [steels high in strength (TS)×stretch flange formability (λ) and also high in TS×elongation (El)]. More specifically, steel samples comprising components' compositions shown in Table 4 (unit in the table is mass %) were vacuum-melted, then hot rolled steel sheets were produced in the same way as in Example 1 and were evaluated for characteristics.

The results obtained are shown in Table 5.

[See Tables 4, 5]

The following can be seen from these results (all of the following No. mean Run No. in Table 5).

First, all of No. 3 to 6, 8 to 15 and 17, which satisfy the composition of a high C steel specified in the present invention, afforded steel sheets of satisfactory characteristics.

Figure 14:
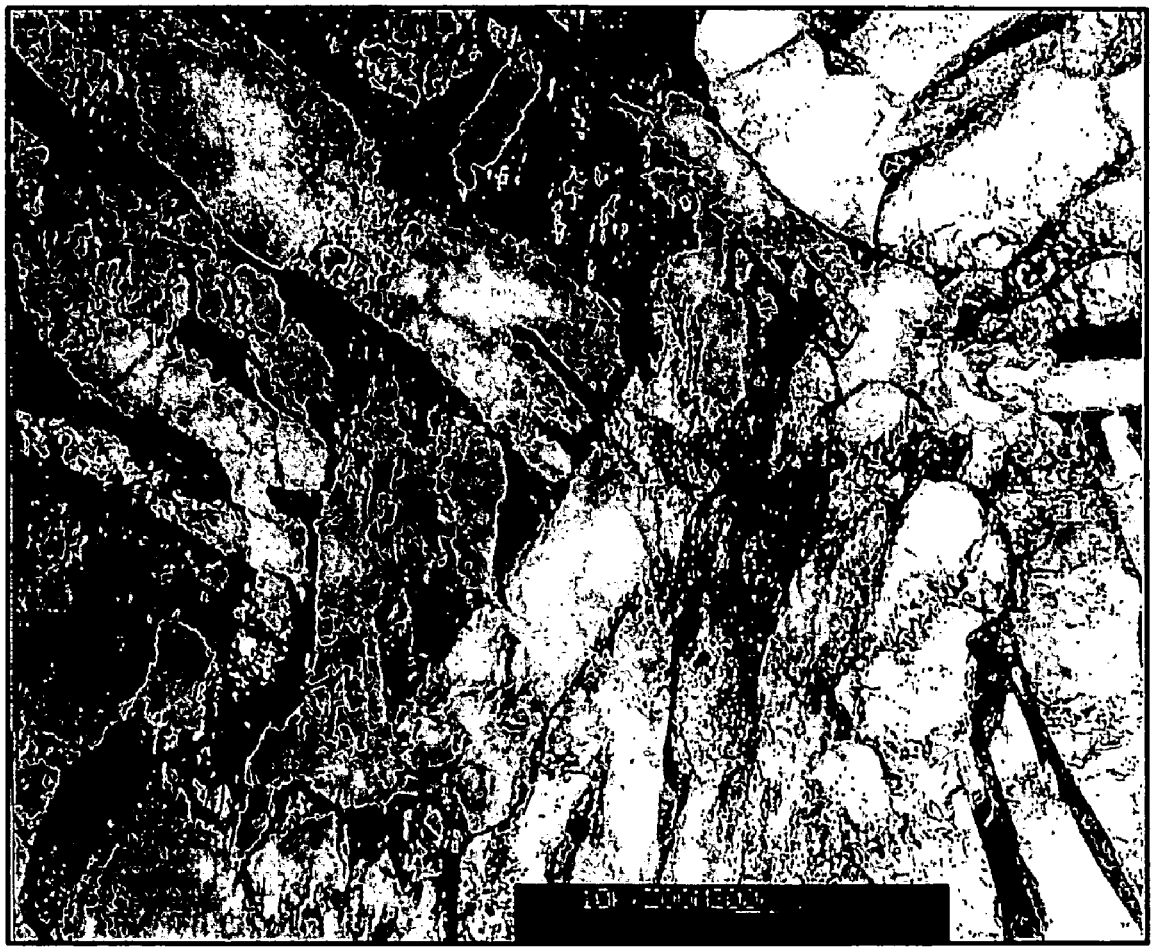
FIG. 14 is a TEM photograph of No. 3 in Example 2.

For reference, a TEM photograph (magnification: 15000×) of a steel sheet (No. 3) according to the present invention is shown in FIG. 14. From this photograph it is seen that the steel sheet according to the present invention has tempered martensite of a clear lath structure.

On the other hand, No. 1 and 2 are low in El because their C contents, which are 0.15% and 0.20%, are smaller than in the other examples (all being not less than 0.4% in the amount of C).

No. 7, which is an example of a small amount of Mn and a small total amount of (Si+Al), is as low as 20% in El because a desired $\gamma_R$ is not obtained.

No. 16 is an example of having produced a large amount of pearlite structure as a second phase structure due to adoption of a somewhat low cooling rate, in which both El and λ are low.

For reference, Table 6 shows the results of having evaluated characteristics of a conventional TRIP steel sheet using No. 3 steel sample shown in Table 1 and with polygonal ferrite as a base phase.

[See Table 6]

From Table 6 it is seen that the conventional steel sheet is high in El but low in λ.

Example 3

A Study of Manufacturing Conditions for the First High Strength Steel Sheet (Base Phase Structure: Tempered Martensite)

In this Example, various manufacturing conditions shown in Tables 7 and 8 were adopted using No. 3 and No. 4 slabs for experiment shown in Tables 1 and 4, respectively. The thickness of each hot rolled steel sheet was set at 2.0 mm and with this as a base there were conducted experiments.

Next, the structure of each of the steel sheets was checked in the same way as in Example 1. The results obtained are also shown in Tables 7 and 8. The steels used in this Example are different in only the amount of C (C of No. 3 in Table 1 is 0.15% and that of No. 4 in Table 4 is 0.48%) but are substantially the same in the contents of other components, so that all of the structures obtained were the same.

[See Tables 7, 8]

No. 1 to 24 in Table 7 were produced by the foregoing method (1). More specifically, No. 1 to 23 were subjected to hot rolling→continuous annealing and No. 24 was subjected to hot rolling→plating (further, alloying)

In Table 7, No. 1, 3, 6, 9 to 11, 13, 14, 16, 18, 19, and 22 to 24 are examples of production carried out using conditions specified in the present invention, in which desired structures were obtained.

For making sure the effect of improvement in plating characteristics by Fe pre-plating, No. 24 in Table 7 was used and heat-treated under the conditions shown in the same table with the proviso that pre-plating was applied thereto, to afford an alloyed, hot dip galvanized steel sheet. More specifically, after hot rolling had been conducted under the conditions shown in Table 7, Fe pre-plating was conducted under the following conditions (amount of Fe pre-plating deposited: 4.0 g/m$^2$, amount of hot dip Zn plating: 52 g/m$^2$), followed by plating [plating bath: Zn-010% Al (effective Al concentration), bath temperature: 460° C.] and subsequent alloying (alloying temperature: 450° C., alloying time: 45 seconds).

[Fe Pre-Plating Conditions]

Plating bath: $FeSO_4.7H_2O$ (400 g/L)

Liquid pH: 2.0

Liquid temp.: 60° C.

Current density: 50 A/dm$^2$

As is the case with the omission of pre-plating, the alloyed, hot dip galvanized steel sheet thus Fe pre-plated afforded a satisfactory structure and was extremely superior in plating characteristics (not shown in the table) such as excellent sliding property and powdering resistance of the plated surface without the lack of plating.

In contrast therewith, the following examples lacking in any of the conditions specified in the present invention have the following disadvantages.

No. 2 is an example of a low hot rolling finish temperature (FDT), in which a desired structure was not obtained, but ferrite structure was produced.

No. 4 is an example of a low average cooling rate (CR) in hot rolling, in which ferrite and pearlite were produced.

No. 5 is an example of a high winding temperature (CT) in hot rolling, in which bainite was produced in a large quantity.

No. 7 is an example of using a conventional TRIP steel (with a base phase being polygonal ferrite), in which a desired structure was not obtained.

No. 8 is an example of a high two phase region temperature (T3) in continuous annealing, in which a desired structure was not obtained, but bainite structure was obtained as a base phase structure.

No. 12 is an example of a low T3, in which $\gamma_R$ structure was not obtained.

No. 15 is an example of a short holding time (t3) at a two phase region temperature in continuous annealing, in which tempering was insufficient and a desired tempered martensite was not obtained.

No. 17 is an example of a low average cooling rate (CR) in continuous annealing, in which pearlite was produced.

No. 20 and 21 are examples low in austempering temperature (T4) (i.e., austempering is not performed), in which a desired structure was not obtained, but martensite was produced.

Next, No. 25 to 27 in Table 7 are examples in which cold rolling was performed in the foregoing method (1). More specifically, No. 25 and 26 are examples of having gone through hot rolling→cold rolling→continuous annealing and No. 27 is an example having gone through hot rolling→cold rolling→plating (further, alloying).

In No. 25 and 27, conditions specified in the present invention were adopted to afford desired structures.

On the other hand, in No. 26 there was adopted a high cooling rate and a desired tempered martensite was not obtained, with formation of polygonal ferrite.

Lastly, No. 28 to 52 in Table 8 followed the foregoing method (2). More specifically, No. 28 to 51 have gone through hot rolling→cold rolling→first continuous annealing→second continuous annealing, while No. 52 has gone through hot rolling→cold rolling→first continuous annealing→plating (further, alloying).

In No. 28, 31, 32, 34, 36 to 38, 41 to 42, 44, 46 to 47, and 50 to 52 in Table 8 there were adopted conditions specified in the present invention to afford desired structures.

For making sure the effect of improvement in plating characteristics by Fe pre-plating, No. 52 in Table 8 was subjected to Fe pre-plating and alloying under the same conditions as No. 24. The thus Fe pre-plated, alloyed, hot dip galvanized steel sheet proved to have a good structure equal to that obtained without going through pre-plating, and also proved to have extremely superior plating characteristics (not shown in the table) such as superior sliding property and powdering resistance of the plated surface without the lack of plating.

In contrast therewith, the following examples lacking in any of the conditions specified in the present invention have the following disadvantages.

No. 29 and 30 are examples of low γ region temperatures (T1) in the first continuous annealing process, in which ferrite was produced.

No. 33 is an example of a low average cooling rate (CR) in the first continuous annealing process, in which polygonal ferrite and pearlite were produced.

No. 35 is an example of a high two phase region temperature (T3) in the second continuous annealing process, in which bainite structure was obtained as a base phase structure.

No. 39 is an example of a low T3, in which a desired γR structure was not obtained.

No. 40 is an example of a long holding time (t3) in a two phase temperature region in the second continuous annealing process, in which ferrite structure was obtained as a base phase structure.

No. 43 is an example of a short t3, in which tempering was insufficient and a desired tempered martensite was not obtained.

No. 45 is an example of a low average cooling rate (CR) in the second continuous annealing process, in which pearlite was produced.

No. 48 and 49 are examples low in austempering temperature (T4) (i.e., austempering is not performed), in which martensite was produced and a desired structure was not obtained.

Example 4

A Study (Part 1) of Components' Compositions in the First High Strength Steel (Base Phase Structure: Tempered Bainite)

In this Example a check was made about the influence of varying components' compositions on mechanical properties mainly with respect to low C steels having a C content of 0.25% or less [steels high in strength (TS)×stretch flange formability (λ) and taking weldability into account]. More specifically, steel samples comprising components' compositions shown in Table 1 (unit in the table is mass %) were vacuum-melted into slabs for experiment, followed by the same procedure as in Example 1 in accordance with the foregoing method (1) (hot rolling→continuous annealing) to afford hot rolled steel sheets each having a thickness of 2.0 mm.

Then, in the same way as in Example 1 the steel sheets thus obtained were measured for tensile strength (TS), elongation [total elongation (El)], yield strength (YP), and stretch flange formability (hole expanding property: λ), and in each of the steel sheets there were measured an area fraction of structure, a space factor of $\gamma_R$, and the concentration of C in $\gamma_R$.

The results obtained are shown in Table 9.

[See Table 9]

The following can be seen from these results (all of the following No. mean Run NO. in Table 9).

First, all of No. 2 to 5 and 7 to 15, which satisfy the components specified in the present invention, afforded steel sheets of good characteristics.

Figure 15:
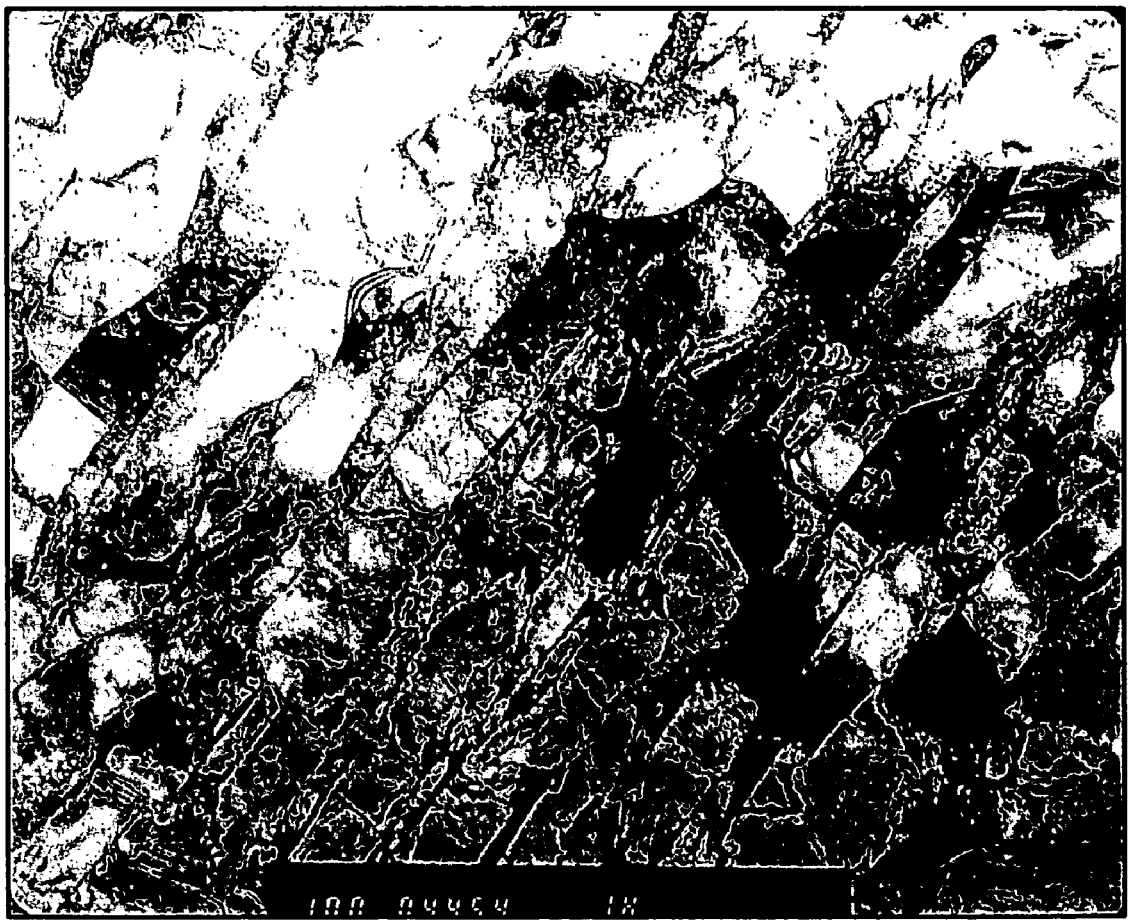
FIG. 15 is a TEM photograph of No. 3 in Example 3.

For reference, a TEM photograph (magnification: 15000×) of a steel sheet (No. 3) according to the present invention is shown in FIG. 15. From this picture it is seen that the steel sheet according to the present invention has tempered bainite of a clear lath structure.

In contrast therewith, the following examples lacking in any of the components specified in the present invention have the following disadvantages.

First, No. 1 is an example of a small amount of C, in which TS and El are low because desired tempered bainite and $\gamma_R$ are not obtained.

No. 6 is an example of a small total amount of (Si+Al) and a small amount of Mn, in which El is as low as 10% because a desired $\gamma_R$ is not obtained.

Example 5

A Study (Part 2) of Components' Compositions in the First High Strength Steel (Base Phase Structure: Tempered Bainite)

In this Example a check was made about the influence of varying components' compositions on mechanical properties mainly with respect to high C steels having a C content of 0.25 to 0.6% [steels high in strength (TS)×stretch flange formability (λ) and also high in TS×elongation (El)]. More specifically, steel samples comprising components' compositions shown in Table 4 (unit in the table is mass %) were vacuum-melted and hot rolled steel sheets were produced in the same way as in Example 1 and then evaluated for various characteristics.

The results obtained are shown in Table 10.

[See Table 10]

The following can be seen from these results (all of the following No. mean Run No. in Table 10).

First, all of No. 3 to 6, 8 to 15, and 17, which satisfy the composition of a high C steel specified in the present invention, afforded steel sheets of good characteristics.

Figure 16:
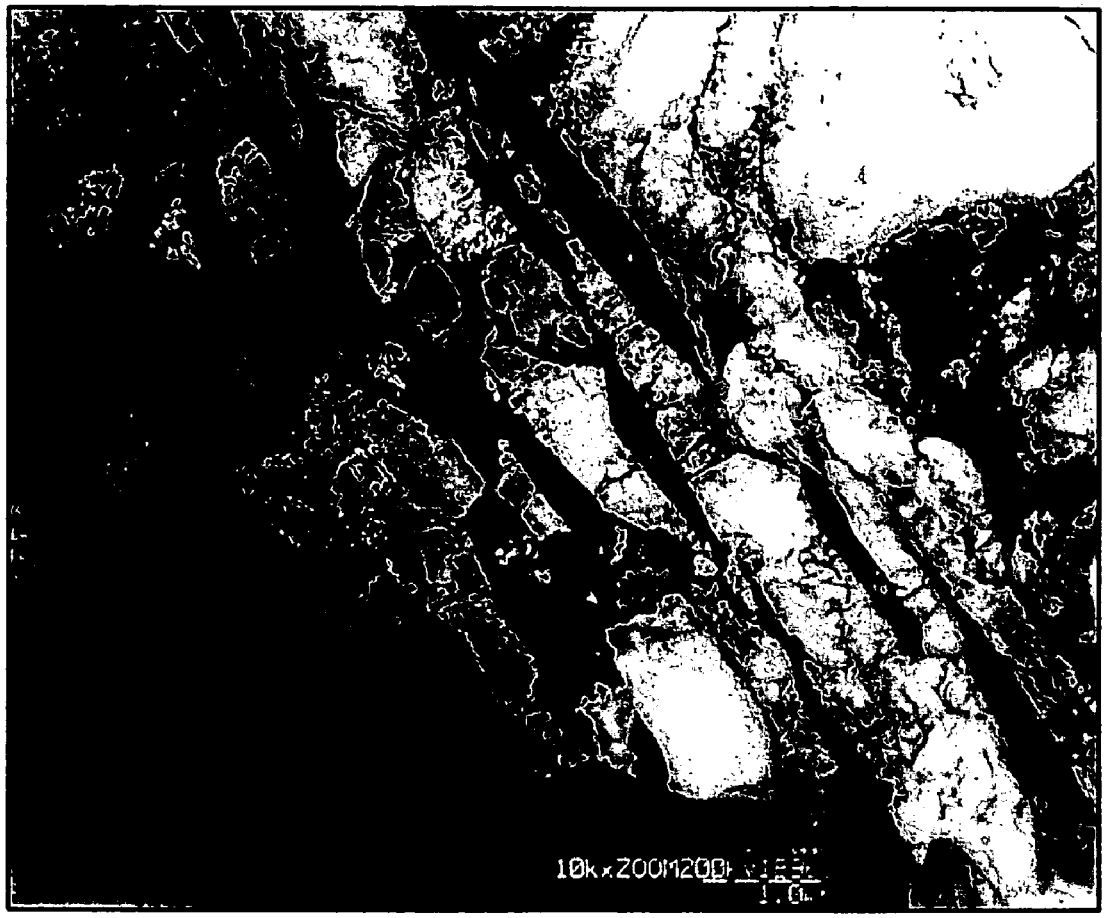
FIG. 16 is a TEM photograph of No. 3 in Example 4.

For reference, a TEM photograph (magnification: 15000×) of a steel sheet (No. 3) according to the present invention is shown in FIG. 16. From this photograph it is seen that the steel sheet according to the present invention has tempered bainite of a clear lath structure.

On the other hand, No. 1 and 2 are low in El because their C quantities are smaller than in the other examples (all being not less than 0.4% in the amount of C).

No. 7 is an example of a small amount of Mn and a small total amount of (Si+Al), in which El is as low as 12% because a desired $\gamma_R$ is not obtained.

No. 16 is an example of having produced a large amount of pearlite structure as a second phase structure due to adoption of a somewhat low cooling rate, in which both El and λ are low.

For reference, Table 11 shows the results of having evaluated characteristics of a conventional TRIP steel sheet using No. 3 steel sample shown in Table 1 and with polygonal ferrite as a base phase.

[See Table 11]

From Table 11 it is seen that the conventional steel sheet is high in El but low in λ.

Example 6

A Study of Manufacturing Conditions for the First High Strength Steel Sheet (Base Phase Structure: Tempered Bainite)

In this Example, various manufacturing conditions shown in Tables 12 and 13 were adopted using No. 3 and No. 4 slabs for experiment shown in Tables 1 and 4, respectively (thickness of each hot rolled steel sheet was set at 2.0 mm).

Next, the structure of each of the steel sheets was checked in the same way as in Example 1. The results obtained are as shown in Tables 12 and 13. The steels used in this Example are different in only the amount of C (C of No. 3 in Table 1 is 0.15% and that of No. 3 in Table 4 is 0.41%) but are substantially the same in the contents of other components, so that all of the structures obtained were the same.

[See Tables 12, 13]

First, No. 1 to 23 were produced by the foregoing method (1). More specifically, No. 1 to 22 were subjected to hot rolling→continuous annealing and No. 23 was subjected to hot rolling→plating (further, alloying)

No. 1, 3, 8 to 10, 12, 13, 15, 17, 18, and 21 to 23 are examples of production carried out using conditions specified in the present invention, in which desired structures were obtained.

For making sure the effect of improvement in plating characteristics by Fe pre-plating, No. 23 in Table 12 was used and heat-treated under the conditions shown in Table 12 with the proviso that pre-plating was applied thereto, to afford an alloyed, hot dip galvanized steel sheet. The details of the pre-plating are as described in Example 3.

As is the case with the omission of pre-plating, the alloyed, hot dip galvanized steel sheet thus Fe pre-plated afforded a satisfactory structure and was extremely superior in plating characteristics (not shown in the table) such as excellent sliding property and powdering resistance of the plated surface without the lack of plating.

In contrast therewith, the following examples lacking in any of the conditions specified in the present invention have the following disadvantages.

No. 2 is an example of a low hot rolling finish temperature (FDT), in which a desired structure was not obtained, but ferrite structure was produced.

No. 4 is an example of a low average cooling rate (CR) in hot rolling, in which ferrite and pearlite were produced.

No. 5 is an example of a low winding temperature (CT) in hot rolling, in which tempered martensite was produced.

No. 6 is an example of a high CT, in which a desired structure was not obtained, but there was obtained the same structure as that of a conventional TRIP steel (with a base phase being polygonal ferrite).

No. 7 is an example of a high two phase region temperature (T3) in continuous annealing, in which a desired structure was not obtained, but bainite structure was obtained as a base phase structure.

No. 11 is an example of a low T3, in which a retained austenite ($\gamma_R$) structure was not obtained.

No. 14 is an example of a short holding time (t3) at a two phase region temperature in continuous annealing, in which tempering was insufficient and a desired tempered bainite was not obtained.

No. 16 is an example of a low average cooling rate (CR) in continuous annealing, in which pearlite was produced.

No. 19 and 20 are examples low in austempering temperature (T4) (i.e., austempering is not performed), in which a desired structure was not obtained, but martensite was produced.

Next, No. 24 to 26 in Table 12 are examples in which cold rolling was performed in the foregoing method (1). More specifically, No. 24 and 25 are examples of having gone through hot rolling→cold rolling→continuous annealing and No. 26 is an example having gone through hot rolling→cold rolling→plating (further, alloying).

In No. 24 and 26, conditions specified in the present invention were adopted to afford desired structures.

On the other hand, in No. 25 there was adopted a high cold rolling rate and a desired tempered bainite was not obtained, with formation of polygonal ferrite.

Lastly, No. 27 to 51 in Table 13 followed the foregoing method (2). More specifically, No. 27 to 50 have gone through hot rolling→cold rolling→first continuous annealing→second continuous annealing, and No. 51 have gone through hot rolling→cold rolling→first continuous annealing→plating (further, alloying).

In No. 27, 30, 31, 33, 35 to 37, 40 to 41, 43, 45 to 46, and 49 to 51 there were adopted conditions specified in the present invention to afford desired structures.

For making sure the effect of improvement in plating characteristics by Fe pre-plating, No. 51 in Table 13 was subjected to Fe pre-plating and alloying under the same conditions as No. 23 in Table 7. The thus Fepre-plated, alloyed, hot dip galvanized steel sheet proved to have a good structure equal to that obtained without going through pre-plating, and also proved to have extremely superior plating characteristics (not shown in the table) such as superior sliding property and powdering resistance of the plated surface without the lack of plating.

In contrast therewith, the following examples lacking in any of the conditions specified in the present invention have the following disadvantages.

No. 28 and 29 are examples of low γ region temperatures (T1) in the first continuous annealing process, in which ferrite was produced.

No. 32 is an example of a low average cooling rate (CR) in the first continuous annealing process, in which polygonal ferrite and pearlite were produced.

No. 34 is an example of a high two phase region temperature (T3) in the second continuous annealing process, in which all of the structure obtained was not a tempered bainite structure, but was an ordinary bainite structure.

No. 38 is an example of a low T3, in which a desired $\gamma_R$ was not obtained.

No. 39 is an example of a long holding time t3) in a two phase temperature region in the second continuous annealing process, in which ferrite structure was obtained as a base phase structure.

No. 42 is an example of a short t3, in which tempering was insufficient and a desired tempered bainite was not obtained.

No. 44 is an example of a low average cooling rate (CR) in the second continuous annealing process, in which pearlite was produced.

No. 47 and 48 are examples low in austempering temperature (T4) (i.e., austempering is not performed), in which martensite was produced and a desired structure was not obtained.

Example 7

A Study (Part 1) of Components' Compositions in the First High Strength Steel Sheet (Base Phase Structure: a Mixed Structure of Tempered Martensite and Ferrite)

In this Example a check was made about the influence of varying components' compositions on mechanical properties mainly with respect to low C steels having a C content of 0.25% or less [steels high in strength (TS)×stretch flange formability (λ) and taking weldability into account]. More specifically, steel samples comprising components' compositions shown in Table 1 (unit in the table is mass %) were vacuum-melted into slabs for experiment and thereafter the procedure of Example 1 was repeated in accordance with the foregoing method (3) (hot rolling→continuous annealing) to afford hot rolled steel sheets having a thickness of 2.0 mm.

Then in the same manner as in Example 1 the steel sheets thus obtained were measured for tensile strength (TS), elongation [total elongation (El)], yield strength (YP), and stretch flange formability (hole expanding property: λ), and also there were measured an area fraction of structure in each of the steel sheets, a space factor of $\gamma_R$, and the concentration of C in $\gamma_R$.

The results obtained are shown in Table 14.

[See Table 14]

The following can be seen from these results (all of the following No. mean Run No. in Table 14).

First, all of No. 3 to 6, 8 to 18, and 20, which satisfy the conditions specified in the present invention, afforded steel sheets of good characteristics.

Figure 17:
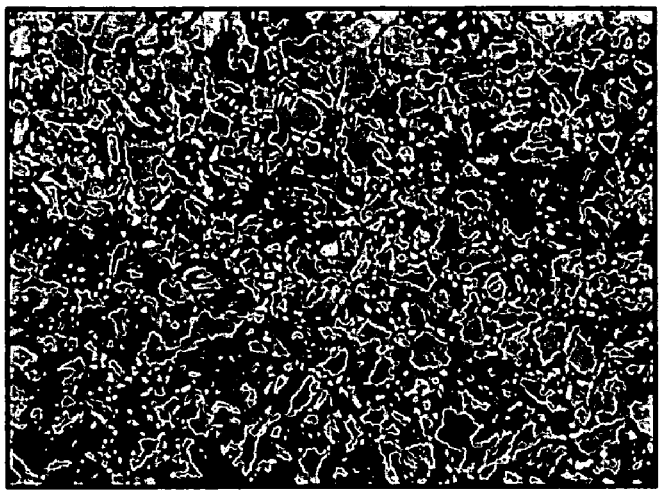
FIG. 17 is an optical microphotograph of No. 3 in Example 5.

For reference, an optical microphotograph (magnification: 1000×) of a steel sheet (No. 3) according to the present invention is shown in FIG. 17. From this photograph it is seen that the steel sheet according to the present invention has tempered martensite of a lath structure.

In contrast therewith, the following examples lacking in any of the conditions specified in the present invention have the following disadvantages.

First, No. 1 is an example of a small amount of C, in which $\gamma_R$ was not obtained and it was impossible to ensure a desired El.

No. 2 is an example of a $C\gamma_R$ content of less than 0.8%, in which it was impossible to ensure a desired El.

No. 7 is an example of a small amount of Mn and a small total amount of (Si+Al), in which a desired $\gamma_R$ was not obtained and hence El was low.

No. 19 is an example of having adopted a somewhat low cooling rate and a consequent large proportion of pearlite structure, in which a predetermined tempered martensite was not obtained and both El and λ were deteriorated.

Example 8

A Study (Part 2) of Components' Compositions in the First High Strength Steel Sheet (Base Phase Structure: a Mixed Structure of Tempered Martensite and Ferrite)

In this Example a check was made about the influence of varying components' compositions on mechanical properties mainly with respect to high C steels having a C content of 0.25 to 0.6% [steels high in strength (TS)×stretch flange formability (λ) and also high in TS×elongation (El)]. More specifically, steel samples comprising components' compositions described in Table 15 (unit in the table is mass %) were vacuum-melted, then hot rolled steel sheets were produced in the same way as in Example 1 and were evaluated for characteristics.

The results obtained are shown in Table 16.

[See Tables 15, 16]

The following can be seen from these results (all of the following No. mean Run No. in Table 16).

First, all of No. 4 to 7, 9 to 19, and 21, which satisfy the conditions specified in the present invention, afforded steel sheets of good characteristics.

Figure 18:
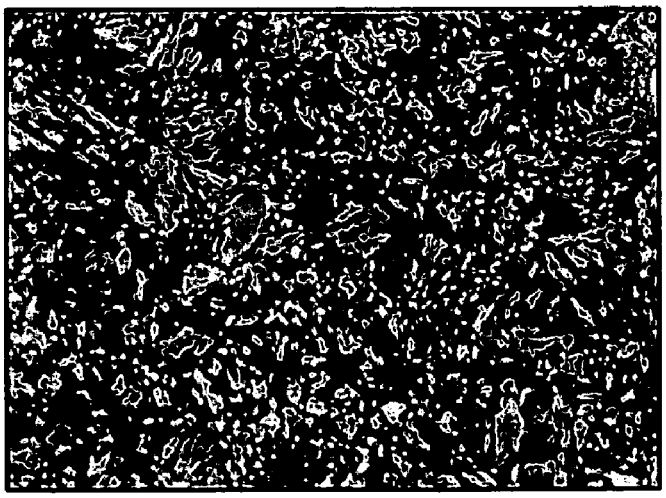
FIG. 18 is an optical microphotograph of No. 3 in Example 6.

For reference, an optical microphotograph (magnification: 1000×) of a steel sheet (No. 3) according to the present invention is shown in FIG. 18. From this photograph it is seen that the steel sheet according to the present invention has tempered martensite of a lath structure.

In contrast therewith, the following examples lacking in any of the conditions specified in the present invention have the following disadvantages.

First, No. 1 is smaller in the amount of C, which is 0.15%, than in the other examples (C: 0.4% or more) and is low in El.

No. 2 is also small in the amount of C, which is 0.15%, and is less than 0.8% in the amount of $C\gamma_R$, low in El.

No. 3 is less than 0.8% in the amount of $C\gamma_R$ and it was impossible to ensure a desired El.

No. 8 is an example of a small amount of Mn and a small total amount of (Si+Al), in which El is low because a desired $\gamma_R$ is not obtained.

No. 20 is an example of a large proportion of pearlite structure because of adoption of a somewhat low cooling rate, in which a predetermined tempered martensite was not obtained and both El and λ were deteriorated.

For reference, the results of having evaluated characteristics of conventional TRIP steel sheets are shown in Table 17. In the same table, No. 22 is a DP steel plate of ferrite and martensite using the steel sample of No. 3 in Table 1, No. 23 is a conventional TRIP steel sheet using the steel sample of No. 3 in Table 1 and with a base phase being polygonal ferrite, and No. 24 is a conventional two phase steel sheet of ferrite and bainite using the steel sample of No. 3 in Table 1.

[See Table 17]

From Table 17 it is seen that No. 22 is deteriorated in elongation and stretch flange formability, No. 23 is deteriorated in stretch flange formability, and No. 24 is deteriorated in elongation.

Example 9

A Study of Manufacturing Conditions for the First High Strength Steel Sheet (Base Phase Structure: a Mixed Structure of Tempered Martensite and Ferrite)

In this Example, various manufacturing conditions shown in Tables 18 and 19 were adopted using No. 4 slabs for experiment shown in Tables 1 and 15, respectively, (the thickness of each hot rolled steel sheet was set at 2.0 mm).

Next, the structure of each of the steel sheets was checked in the same manner as in Example 1. The results obtained are also shown in Tables 18 and 19. The steels used in this Example are different in only the amount of C (C of No. 4 in Table 1 is 0.20% and that of No. 4 in Table 15 is 0.48%) but are substantially the same in the contents of other components, so that all of the structural constructions (types of second phase) obtained were the same.

[See Tables 18, 19]

No. 1 to 25 in Table 18 were produced by the foregoing method (3). More specifically, No. 1 to 23 were subjected to hot rolling→continuous annealing. In No. 5 to 7 and No. 25 there was conducted one-step cooling in the hot rolling process, while in the other runs there was conducted two-step cooling in the same process. No. 24 and 25 were subjected to hot rolling→plating (further, alloying), of which No. 24 is an example of having conducted two-step cooling in the hot rolling process and No. 25 is an example of having conducted one-step cooling in the same process.

No. 1, 3 to 4, 7, 9 to 11, 13 to 14, 16, 18 to 19, and 22 to 25 are example of production carried out using conditions specified in the present invention, in which desired structures were obtained.

For making sure the effect of improvement in plating characteristics by Fe pre-plating, No. 24 in Table 18 was used and heat-treated under the conditions shown in the same table with the proviso that pre-plating was applied thereto, to afford an alloyed, hot dip galvanized steel sheet. The details of the pre-plating are as described in Example 3.

Thus, the alloyed, hot dip galvanized steel sheet having been subjected to Fe pre-plating proved to have a good structure equal to that obtained without going through pre-plating, and also proved to have extremely superior plating characteristics (not shown in the table) such as superior sliding property and powdering resistance of the plated surface without the lack of plating.

In contrast therewith, the following examples lacking in any of the conditions specified in the present invention have the following disadvantages.

No. 2 is an example of a high winding temperature (CT) in hot rolling, in which ferrite and tempered bainite were produced.

No. 5 is an example of a high CT, in which the same structure as in a conventional TRIP steel (TRIP steel with a base phase being polygonal ferrite) was obtained, but a desired structure was not obtained.

No. 6 is an example of a low average cooling rate (CR1) in hot rolling, in which, due to the absence of tempered martensite in the as-hot-rolled structure, a desired structure was not obtained and a conventional TRIP steel structure was produced.

No. 8 is an example of a high two phase region temperature (T3) in continuous annealing, in which a desired texture was not obtained and a conventional TRIP steel structure was produced.

No. 12 is an example of a low T3, in which desired $\gamma_R$ was not obtained.

No. 15 is an example of a short holding time (t3) at a two phase region temperature in continuous annealing, in which tempering was insufficient and desired tempered martensite was not obtained.

No. 17 is an example of a low average cooling rate (CR) in continuous annealing, in which pearlite was produced.

No. 20 and 21 are examples of a low austempering temperature (T4) (i.e., austempering was not performed), in which desired structure was not obtained and martensite was produced.

Next, No. 26 to 30 in Table 19 are example of having performed cold rolling in the foregoing method (3). More specifically, No. 26 to 28 are example of having gone through hot rolling→cold rolling→continuous annealing and No. 29 to 30 are examples of having gone through hot rolling→cold rolling→plating (further, alloying), of which No. 28 and 30 are examples in which one-step cooling was performed in the hot rolling process, and the other examples adopted two-step cooling.

No. 26 and 28 to 30 are examples using conditions specified in the present invention, in which desired structures were obtained.

On the other hand, No. 27 is an example of a high cold rolling rate, in which pre-structure was destroyed by cold rolling and a desired tempered martensite was not obtained.

Lastly, No. 31 to 57 in Table 19 followed the foregoing method (4). More specifically, No. 31 to 56 have gone through hot rolling→cold rolling→first continuous annealing→second continuous annealing, while No. 57 has undergone hot rolling→cold rolling→first continuous annealing→plating (further, alloying).

No. 31 to 34, 36, 37, 39, 41 to 43, 46 to 47, 49, 51 to 52, and 55 to 57 adopted conditions specified in the present invention, in which desired structures were obtained.

For making sure the effect of improvement in plating characteristics by Fe pre-plating, No. 57 in Table 19 was used and was subjected to Fe pre-plating and alloying under the same conditions as in No. 24 in Table 7 described previously. As a result, as is the case with the omission of pre-plating, the alloyed, hot dip galvanized steel sheet thus Fe pre-plated afforded a satisfactory structure and was extremely superior in plating characteristic (not shown in the table) such as excellent sliding property and powdering resistance of the plated surface without the lack of plating.

In contrast therewith, the following examples lacking in any of the conditions specified in the present invention have the following disadvantages.

No. 35 is an example of a low Ti, in which a desired $\gamma_R$ was not obtained.

No. 38 is an example of a low average cooling rate (CR) in the first continuous annealing process, in which polygonal ferrite and pearlite were produced.

No. 40 is an example of a high two phase region temperature (T3) in the second continuous annealing process, in which a conventional TRIP steel structure was obtained.

No. 44 is an example of a low T3, in which a desired $\gamma_R$ was not obtained.

No. 45 is an example of a long holding time (t3) in two phase region in the second continuous annealing process, in which ferrite structure was produced as a base phase and tempered martensite vanished.

No. 48 is an example of a short t3, in which tempering was insufficient and desired tempered martensite was not obtained.

No. 50 is an example of a low average cooling rate (CR) in the second continuous annealing process, in which pearlite was produced.

No. 53 and 54 are examples low in austempering temperature (T4) (i.e., austempering is not performed), in which martensite was produced and a desired structure was not obtained.

Example 10

A Study (Part 1) of Components' Compositions in the First High Strength Steel Plate (Base Phase Structure: a Mixed Structure of Tempered Bainite and Ferrite)

In this Example a check was made about the influence of varying components' compositions on mechanical properties mainly with respect to low C steels having a C content of 0.25% or less [steels high in strength (TS)×stretch flange formability (λ) and taking weldability into account]. More specifically, steel samples comprising components' compositions shown in Table 1 (unit in the table is mass %) were vacuum-melted into slabs for experiment and thereafter the procedure of Example 1 was repeated in accordance with the foregoing method (3) (hot rolling→continuous annealing) to afford hot rolled steel sheets having a thickness of 2.0 mm.

Then in the same manner as in Example 1 the steel sheets thus obtained were measured for tensile strength (TS), elongation [total elongation (El)], yield strength (YP), and stretch flange formability (hole expanding property: λ), and also there were measured an area fraction of structure in each of the steel sheets, a space factor of $\gamma_R$, and the concentration of C in $\gamma_R$.

The results obtained are shown in Table 20.

[See Table 20]

The following can be seen from these results (all of the following No. mean Run No. in Table 20).

First, all of No. 3 to 6, 8 to 18, and 20, which satisfy the conditions specified in the present invention, afforded steel sheets of good characteristics.

Figure 19:
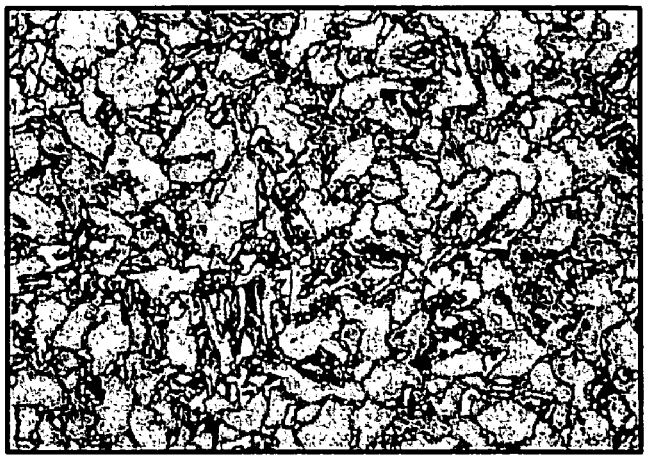
FIG. 19 is an optical microphotograph of No. 3 in Example 7.

For reference, an optical microphotograph (magnification: 1000×) of a steel sheet (No. 3) according to the present invention is shown in FIG. 19. From this photograph it is seen that the steel sheet according to the present invention has tempered bainite of a lath structure and ferrite.

In contrast therewith, the following examples lacking in any of the conditions specified in the present invention have the following disadvantages.

First, No. 1 is an example of small amount C, in which it was impossible to attain a desired El.

No. 2 is an example of a CγR quantity of less than 0.8%, in which it was impossible to attain a desired El.

No. 7 is an example of a small amount of Mn and a small total amount of (Si+Al), in which a desired $\gamma_R$ was not obtained and-therefore El was low.

No. 19 is an example of having adopted a low cooling rate and a consequent large proportion of pearlite structure, in which a predetermined tempered bainite was not obtained and both El and λ were deteriorated.

Example 11

A Study (Part 2) of Components' Compositions in the First High Strength Steel Sheet (Base Phase Structure: a Mixed Structure of Tempered Bainite and Ferrite)

In this Example a check was made about the influence of varying components' compositions on mechanical properties mainly with respect to high C steels having a C content of 0.25 to 0.6% [steels high in strength (TS)×stretch flange formability (λ) and also high in TS×elongation (El)]. More specifically, steel samples comprising components' compositions shown in Table 15 (unit in the table is mass %) were vacuum-melted, then hot rolled steel sheets were produced in the same way as in Example 1 and were evaluated for characteristics.

The results obtained are shown in Table 21.

[See Table 21]

The following can be seen from these results (all of the following No. mean Run No. in Table 21).

First, all of No. 3 to 6, 8 to 18, and 20, which satisfy the conditions specified in the present invention, afforded steel sheets of good characteristics.

Figure 20:
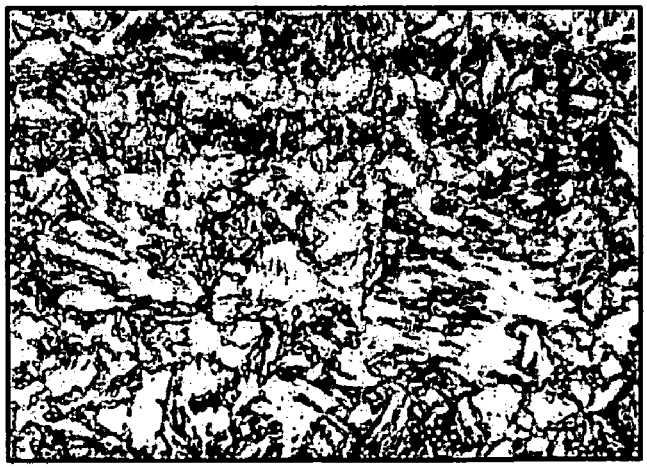
FIG. 20 is an optical microphotograph of No. 3 in Example 8.

For reference, an optical microphotograph (magnification: 1000×) of a steel sheet (No. 3) according to the present invention is shown in FIG. 20. From this photograph it is seen that the steel sheet according to the present invention has tempered bainite of a lath structure and ferrite.

In contrast therewith, the following examples lacking in any of the conditions specified in the present invention have the following disadvantages.

First, No. 1 is smaller in the amount of C, which is 0.15%, than the other examples (C: 0.4% or more) and is therefore low in El.

No. 2 is also as low as 0.20% in the amount of C and has a $C\gamma_R$ content of less than 0.8%, in which El is low.

No. 7 is an example of a small amount of Mn and a small total amount of (Si+Al), in which a desired $\gamma_R$ was not obtained and hence El was low.

No. 19 is an example of having adopted a somewhat low cooling rate and a consequent large proportion of pearlite structure, in which a predetermined tempered bainite was not obtained and both El and λ were deteriorated.

For reference, two types of steel sheets (a conventional TRIP steel sheet using polygonal ferrite as a base phase and a conventional two phase steel sheet of ferrite and bainite) were produced by using steel samples No. 2 and No. 3 shown in Table 1 and by suitably adjusting heat treatment conditions and were then evaluated for various characteristics, the results of which are set out in table 22.

[See Table 22]

Reference to Table 22 shows that the conventional TRIP steel sheet using No. 3 in Table 1 is high in El but low in λ and that the conventional ferrite-bainite two phase steel sheet using No. 2 in Table 1 is low in El.

Example 12

A Study of Manufacturing Conditions for the First High Strength Steel Sheet (Base Phase Structure: a Mixed Structure of Tempered Bainite and Ferrite)

In this Example, various manufacturing conditions shown in Tables 23 and 24 were adopted using No. 4 slabs for experiment shown in Tables 1 and 15, respectively, (the thickness of each hot rolled steel sheet is assumed to be 2.0 mm).

Next, the structure of each of the steel sheets was checked in the same way as in Example 1. The results obtained are also set out in Tables 23 and 24. The steels used in this Example are different in only the amount of C (C of No. 3 in Table 1 is 0.20% and that of No. 4 in Table 15 is 0.48%) but are substantially the same in the contents of other components, so that all of the structures obtained were the same.

[See Tables 23, 24]

First, No. 1 to 25 in Table 23 were produced by the foregoing method (3). More specifically, No. 1 to 23 were subjected to hot rolling→continuous annealing, of which No. 5 to 7 and No. 25 adopted one-step cooling in the hot rolling process and the others adopted two-step cooling. Further, No. 24 and 25 are examples of having been subjected to hot rolling→plating (further, alloying), of which No. 24 is an example of having adopted two-step cooling in the hot rolling process and No. 25 is an example of having adopted one-step cooling.

No. 1 to 3, 7, 9 to 11, 13, 14, 16, 18, 19, and 22 to 25 are examples of production carried out using conditions specified in the present invention, in which desired structures were obtained.

For making sure the effect of improvement in plating characteristics by Fe pre-plating, No. 24 in Table 23 was used and heat-treated under the conditions set out in Table 23 with the proviso that pre-plating was applied thereto, to afford an alloyed, hot dip galvanized steel sheet. The details of the pre-plating are as described in Example 3.

The alloyed, hot dip galvanized steel sheet thus Fe pre-plated afforded a satisfactory structure and was extremely superior in plating characteristics (not shown in the table) such as excellent sliding property and powdering resistance of the plated surface without the lack of plating.

In contrast therewith, the following examples lacking in any of the conditions specified in the present invention have the following disadvantages.

No. 4 is an example of a low winding temperature (CT) in hot rolling, in which ferrite and tempered martensite were produced.

No. 5 is an example of a high CT, in which there was obtained the same structure as that of a conventional TRIP steel (with a base phase being polygonal ferrite) and a desired structure was not obtained.

No. 6 is an example of a low average cooling rate (CR) in hot rolling, in which a desired structure was not obtained because of absence of tempered bainite in the as-hot-rolled structure, and a conventional TRIP steel structure was produced.

No. 8 is an example of a high two phase region temperature (T3) in continuous annealing, in which a desired structure was not obtained, but a conventional TRIP steel structure was produced.

No. 12 is an example of a low T3, in which $\gamma_R$ structure was not obtained.

No. 15 is an example of a short holding time (t3) at a two phase region temperature in continuous annealing, in which tempering was insufficient and desired tempered bainite was not obtained.

No. 17 is an example of a low average cooling rate (CR) in continuous annealing, in which pearlite was produced.

No. 20 and 21 are examples low in austempering temperature (T4) (i.e., austempering is not performed), in which a desired structure was not obtained, but martensite was produced.

Next, No. 26 to 30 in Table 23 are examples in which cold rolling was performed in the foregoing method (3). More specifically, No. 26 to 28 are examples which were subjected to hot rolling→cold rolling→continuous annealing and No. 29 and 30 are examples which were subjected to hot rolling→cold rolling→plating (further, alloying). In No. 28 and 30 there was adopted one-step cooling in the hot rolling process, while in the other examples there was adopted two-step cooling.

In No. 26 and 28 to 30 there were adopted conditions specified in the present invention to afford desired structures.

On the other hand, No. 27 is an example of a high cold rolling rate, in which a desired tempered bainite was not obtained.

Lastly, No. 31 to 57 in Table 24 followed the foregoing method (4). More specifically, No. 31 to 56 have gone through hot rolling→cold rolling→first continuous annealing→second continuous annealing, while No. 57 has gone through hot rolling→cold rolling→first continuous annealing→plating (further, alloying).

No. 32 to 34, 36, 37, 39, 41 to 43, 46 to 47, 49, 51 to 52, and 55 to 57 are examples of production carried out under conditions specified in the present invention, in which desired structures were obtained.

For making sure the effect of improvement in plating characteristics by Fe pre-plating, No. 57 in Table 24 was subjected to Fe pre-plating and alloying under the same conditions as No. 24. The thus Fe pre-plated, alloyed, hot dip galvanized steel sheet proved to have a good structure equal to that obtained without going through pre-plating, and also proved to have extremely superior plating characteristics (not shown in the table) such as superior sliding property and powdering resistance of the plated surface without the lack of plating.

In contrast therewith, the following examples lacking in any of the conditions specified in the present invention have the following disadvantages.

No. 31 is an example of a high γ region temperature (T1) in the continuous annealing process, in which not tempered bainite but ferrite and tempered martensite were produced.

No. 35 is an example of a low T1, in which a desired $\gamma_R$ structure was not obtained.

No. 38 is an example of a low average cooling rate (CR) in the first continuous annealing process, in which polygonal ferrite and pearlite were produced.

No. 40 is an example of a high two phase region temperature (T3) in the second continuous annealing process, in which a conventional TRIP steel structure was obtained.

No. 44 is an example of a low T3, in which a desired $\gamma_R$ was not obtained.

No. 45 is an example of a long holding time (t3) in a two phase temperature region in the second continuous annealing process, in which ferrite structure was obtained as a base phase structure, and tempered bainite vanished.

No. 48 is an example of a short t3, in which tempering was insufficient and a desired tempered bainite was not obtained.

No. 50 is an example of a low average cooling rate (CR) in the second continuous annealing process, in which pearlite was produced.

No. 53 and 54 are examples low in austempering temperature (T4) (i.e., austempering is not performed), in which martensite was produced and a desired structure was not obtained.

From the results of the above Examples 1 to 12 it is seen that in a high strength and ultra-high strength region of the order of about 500 to 1400 MPa the first high strength steel sheet according to the present invention exhibits both excellent stretch flange formability and excellent total elongation.

Example 13

A Study of Components' Compositions in the Second High Strength Steel Sheet

In this Example, steel samples comprising components' compositions described in Table 25 (unit in the table is mass %) were vacuum-melted into slabs for experiment, from which there were obtained cold rolled steel sheets having a thickness of 1.0 mm in accordance with the method described in Table 26 [the foregoing method (8) (hot rolling→cold rolling→first continuous annealing→tempering→second continuous annealing)].

Then, in the same way as in Example 1 the steel sheets thus obtained were measured for tensile strength (TS), elongation [total elongation (El)], yield strength (YP), and stretch flange formability (hole expanding property: λ). As to the fatigue characteristic [fatigue endurance ratio (fatigue strength/yield strength), a fatigue limit was determined by an endurance limit test under reverse stress and repeated bending, then a fatigue endurance ratio [fatigue strength $\sigma_w$ (MPa)/yield strength YP (MPa)] was calculated using the fatigue limit to evaluate the fatigue characteristic.

Further, in accordance with the foregoing method, a space factor of the structure in each of the steel sheets was measured and an area ratio [(S1/S)×100] of a coarse second phase structure was calculated. The amount of $\gamma_R$ and the concentration of C in $\gamma_R$ were measured by X-ray diffractometry after grinding to a quarter depth of each steel sheet and after subsequent chemical polishing (ISIJ Int. Vol.33 (1933), No. 7, P.776).

The results obtained are shown in Table 27.

In Table 27 and in the column of the ratio of a coarse second phase structure [(S1/S)×100], "-" means that $\gamma_R$ which constitutes the second phase structure is not present or the amount thereof is very small, with no martensite produced, and that therefore it was impossible to measure S1.

[See Tables 25, 26, 27]

The following can be seen from these results. All of the following No. mean Run No. in Table 27. The examples described in Table 27, which satisfy the condition of [S1/S]×100≦20], are for showing differences in other conditions (components and whether tempering is performed or not).

First, all of No. 3 to 5and7 to 14 satisfy the conditions specified in the present invention and are therefore 10% or more higher in stretch flange formability (λ) and fatigue characteristic ($\sigma_w$/YP) than in case of steel of the same components having been heat-treated without going through a predetermined tempering treatment (note: even when a tempering treatment is not performed, if a predetermined heat treatment capable of being regarded as equal to the tempering treatment is applied, it is regarded that tempering has been conducted).

On the other hand, No. 1 is an example of a low content of C, in which it was impossible to ensure a desired El, provided its fatigue characteristic is satisfactory because the second phase structure ($\gamma_R$/martensite) defined in the present invention was not produced.

No. 2 is an example of omission of a predetermined tempering treatment, in which it was impossible to ensure a desired El and the fatigue characteristic was deteriorated.

No. 6 is an example of a small total amount of (Si+Al), in which a desired El was not obtained.

No. 15 is an example of a low cooling rate and consequent production of a large amount of pearlite structure, in which El and λ were deteriorated.

For reference, evaluation results of various characteristics of conventional steel sheets are shown in Table 28. In the same table, No. 20 is a DP steel sheet of ferrite and martensite using No. 2 steel sample in Table 1, No. 21 is a conventional TRIP steel sheet using No. 2 steel sample in Table 1 and with polygonal ferrite as a base phase, and No. 22 is a conventional two phase steel sheet of ferrite and bainite using No. 2 steel sample in Table 1.

[See Table 28]

From Table 28 it is seen that No. 20 (conventional DP steel sheet) is inferior in all of elongation, stretch flange formability, and fatigue characteristic.

No. 21 (conventional TRIP steel sheet) contains a large proportion of a coarse second phase structure and is inferior in both stretch flange formability and fatigue characteristic.

No. 22 (conventional two phase steel sheet) is superior in fatigue characteristic but inferior in elongation because of absence of the second phase structure defined in the present invention.

Example 14

A Study (Part 1) of Manufacturing Conditions for the Second High Strength Steel Sheet In this Example a study was made about the foregoing manufacturing method (5) or (7), i.e., the method comprising hot rolling→tempering→continuous annealing. More specifically, No. 3 steel sample in Table 25 was vacuum-melted into a slab for experiment, from which there were produced hot rolled steel sheets 2.0 mm thick under the conditions set out in Table 29. The steel sheets were then checked for structure and characteristics in the same manner as in Example 13. In Table 29, No. 1, 2, and 5 are examples in which one-step cooling was conducted in the hot rolling process, while in the other examples there was conducted two-step cooling (after cooling to 700° C. at an average cooling rate of 40° C./s, air-cooling was performed in this temperature range for 10 seconds, followed by cooling to 200° C. or 450° C. at an average cooling rate of 40° C./s) The results obtained are shown in Table 30.

[See Tables 29, 30]

In Table 30, No. 2 is an example according to the present invention in which a desired base phase structure of tempered martensite was obtained through predetermined steps of hot rolling→tempering→continuous annealing, No. 4 is an example according to the present invention in which a desired mixed base phase structure of (tempered martensite+ferrite) was obtained through predetermined hot rolling→tempering→continuous annealing, No. 5 is an example according to the present invention in which a desired base phase structure of tempered bainite was obtained through predetermined steps of hot rolling (tempering can be omitted because a winding process is performed at a CT of 450° C. for 1 hour)→continuous annealing, and No. 6 is an example according to the present invention in which a desired mixed base phase structure of (tempered bainite+martensite) was obtained through predetermined steps of hot rolling (tempering can be omitted because a winding process is performed at a CT of 450° C. for 1 hour)→continuous annealing. All of these examples, due to formation of fine second phase structures, are 10% or more higher in stretch flange formability (λ) and fatigue characteristic ($\sigma_w$/YP) than in case of steel of the same components having been heat-treated without going through a predetermined tempering treatment (note: even when a tempering treatment is not performed, if a predetermined heat treatment capable of being regarded as equal to the tempering treatment is applied, it is regarded that tempering has been conducted).

On the other hand, No. 1 and 3 in Table 30 are examples of production carried out without going through tempering, which are low in fatigue characteristic or in both fatigue characteristic and stretch flange formability due to a large proportion of a coarse second phase structure.

Example 15

A Study (Part 2) of Manufacturing Conditions for the Second High Strength Steel Sheet In this Example a study was made about the foregoing method (6) or (8), i.e., hot rolling→cold rolling→first continuous annealing→tempering→second continuous annealing. More specifically, various steels shown in Tables 31 and 33 (the steel Nos. described in Tables 31 and 33 mean the steel Nos. in Table 25) were vacuum-melted into slabs for experiment. Using these slabs, cold rolled steel sheets 1.0 mm thick were produced under the heat treatment conditions shown in Tables 31 and 33 and were then checked for structure and characteristics in the same manner as in Example 13. No. 1 to 34 in Table 31 were subjected to hot rolling→cold rolling→first continuous annealing→(tempering)→second continuous annealing, while No. 1 to 6 were subjected to hot rolling→cold rolling→first continuous annealing→(tempering)→plating (further, alloying). The results obtained in Table 31 is shown in Table 32 and the results obtained in Table 33 are shown in Table 34.

In Table 32 and in the column of the proportion of a coarse second phase structure [(S1/S)×100], "-" means that $\gamma_R$ which constitutes the second phase structure is not present or the amount thereof is very small, with no martensite produced, and that therefore it was impossible to measure S1.

[See Tables 31, 32, 33, 34]

First, No. 4, 7 to 9, 13, 16, 20, 22, 24, 26, 28, 30, 32, and 34 in Table 32 are examples of production carried out under conditions defined in the present invention, which are 10% or more higher in stretch flange formability (λ) and fatigue characteristic ($\sigma_w$/YP) than in case of steel of the same components having been heat-treated without going through a predetermined tempering treatment (note: even when a tempering treatment is not performed, if a predetermined heat treatment capable of being regarded as equal to the tempering treatment is applied, it is regarded that tempering has been conducted).

In contrast therewith, the following examples lacking in any of the conditions specified in the present invention have the following disadvantages.

No. 1.and 2 in Table 32 are examples of production using steel 1 (low C steel) shown in Table 1, in which a predetermined base phase structure was obtained, but due to a small amount of C there was not obtained a desired $\gamma_R$ and TS×El were low.

No. 3, 5, 11 to 12, 14 to 15, 19, 21, 23, 25, 27, 29, 31, and 33, in Table 32, as well as No. 1, 3 to 4, and 6 in Table 34, are all examples of production performed without going through tempering, in which fatigue characteristic or both fatigue characteristic and stretch flange formability were deteriorated due to a large proportion of a coarse second phase structure.

No. 6 in Table 32 is an example of a low tempering temperature, in which stretch flange formability and fatigue characteristic were deteriorated.

No. 10 in Table 32 is an example of a long-time treatment conducted at a high tempering temperature, in which stretch flange formability and fatigue characteristic were deteriorated.

No. 17 and 18 in Table 32 are examples of production using steel 5 [steel having a small total amount of (Si+Al)] in Table 25, in which a desired $\gamma_R$ was not produced and elongation was deteriorated.

Figure 21:
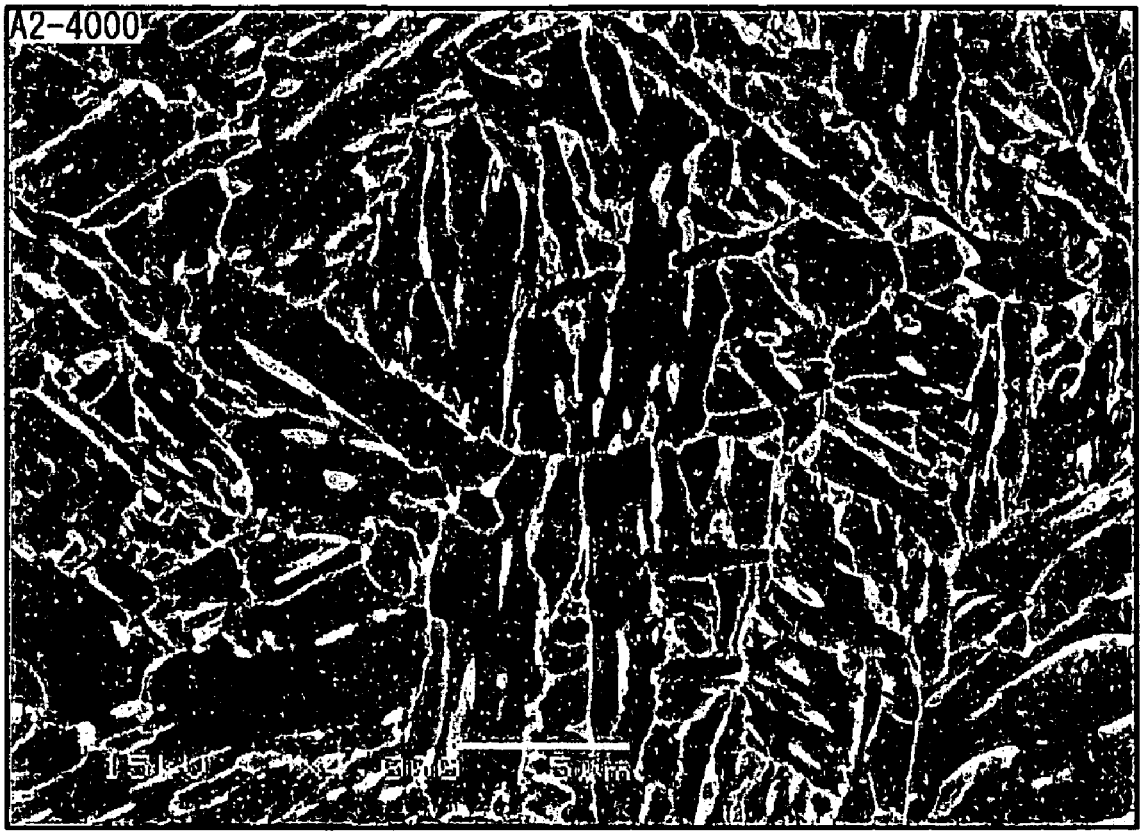
FIG. 21 is an SEM photograph (×4000) of No. 13 in Table 32.
Figure 22:
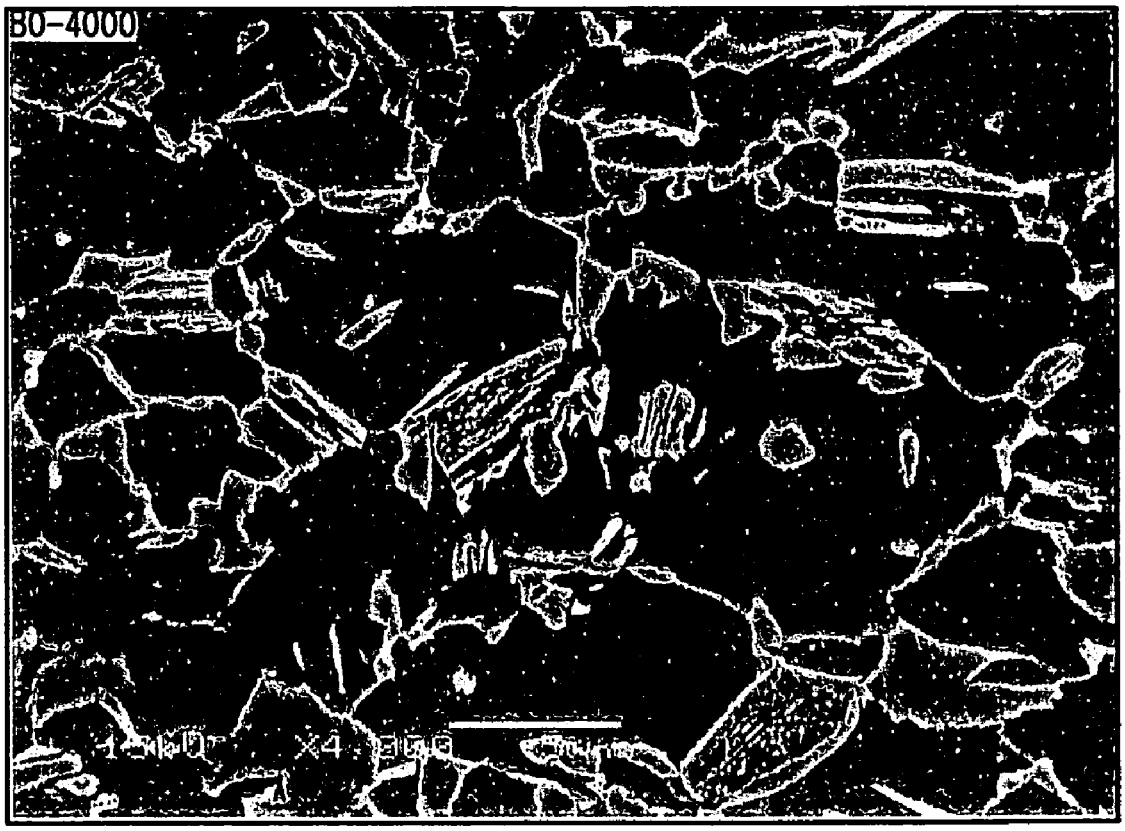
FIG. 22 is an SEM photograph (×4000) of No. 12 in Table 32.

For reference, a photograph (magnification: 4000×) taken through an SEM (scanning electron microscope) of a steel sheet according to the present invention (No. 13 in Table 32) and that of a comparative steel sheet (No. 12 in Table 32) are shown in FIGS. 21 and 22, respectively. From these photographs it is seen that the steel sheet according to the present invention afforded a desired structure [a base phase structure (tempered martensite) of a lath form and a fine second phase structure] because it was treated under conditions specified in the present invention, but that the comparative steel sheet of FIG. 22 cannot afford a desired structure (a coarse second phase structure was formed) due to omission of a predetermined tempering treatment.

From the above results obtained in Examples 13 to 15 it is seen that the second high strength steel sheet according to the present invention is superior in the balance of stretch flange formability, total elongation, and fatigue characteristic in a high strength and ultra-high strength region of the order of about 500 to 1400 MPa.

Example 16

A Study of Components' Compositions and Heating Temperature (SRT) Before Hot Rolling in the Third High Strength Steel Sheet In this Example, steel samples comprising components' compositions shown in Table 35 (unit in the table is mass %) were vacuum-melted into slabs for experiment. Thereafter, using the slabs, cold rolled steel sheets having a thickness of 1.0 mm were produced in accordance with the method described in Table 36 [the foregoing method (12) (hot rolling→cold rolling→first continuous annealing→second continuous annealing)].

Then, in the same manner as in Example 1, the steel sheets thus produced were measured for tensile strength (TS), elongation [total elongation (El)], and stretch flange formability (hole expanding property: λ).

The results obtained are shown in Table 37.

[See Tables 35, 36, 37]

The following can be seen from these results. All of the following No. mean Run No. in Table 37.

First, it is seen that all of No. 2 to 4, 6 to 13, and 15 to 20, which satisfy the conditions specified in the present invention, are superior in strength (TS), elongation (El), and stretch flange formability, and that they have a very excellent bake hardening property because they satisfy the conditions specified in the present invention also with respect to BH (2%) and BH (10%).

On the other hand, No. 1 is an example of a small amount of C, in which it was impossible to obtain desired BH characteristics.

No. 5 is an example of a small total amount of (Si+Al), in which a desired El is hot obtained and BH characteristics are also deteriorated markedly.

No. 14 is an example of a low cooling rate and a consequent formation of a large amount of pearlite structure as a second phase structure, in which El and λ are low and BH characteristics are also inferior.

Next, for the purpose of checking the influence of the heating temperature (SRT) before hot rolling on BH characteristics [especially BH (10%)], steel samples shown in Table 35 were used and cold rolled steel sheets having a thickness of 1.0 mm were produced in accordance with the method described in Table 38. Thesteel sheets thus obtained were then checked for predetermined mechanical characteristics in the same manner as above, the results of which are given in Table 39.

[See Tables 38, 39]

From these results it is seen that if steel sheets are produced at an SRT deviated from the range (950 to 1100° C.) defined in the present invention, BH (2%) is substantially the same or a little lower, but BH (10%) is markedly deteriorated, not affording a steel sheet meeting the conditions defined in the present invention, in comparison with the case of Table 37 in which SRT was controlled to the range defined in the present invention.

For reference, various characteristics of conventional steel sheets were evaluated, the results of which are shown in Table 40. In the same table, No. 1 is a DP steel sheet of ferrite and martensite produced using No. 2 steel sample in Table 35, No. 2 is a conventional steel sheet using No. 3 steel sample in Table 35 and with polygonal ferrite as a base phase, and No. 3 is a conventional two phase steel sheet of ferrite and bainite produced using No. 2 steel sample in Table 35.

[See Table 40]

A look at Table 40 shows that No. 1 (conventional DP steel sheet) is low in all of elongation, stretch flange formability, and BH characteristics, that No. 2 (conventional TRIP steel sheet) is low in both stretch flange formability and BH characteristics, and that No. 3 (conventional two phase steel sheet) is low in both elongation and BH characteristics.

Example 17

A Study (Part 1) of Manufacturing Conditions in the Third High Strength Steel Sheet In this Example a study was made about the foregoing manufacturing method (9) or (11), i.e., hot rolling→continuous annealing. More specifically, steel No. 3 in Table 35 was vacuum-melted into a slab for experiment. Thereafter, using the slab, 2.0 mm thick hot rolled steel sheets were produced under the conditions shown in Table 41 and were checked for structures and characteristics in the same manner as in Example 16. In Table 41, No. 1, 3, 5, and 7 are examples in which one-step cooling was adopted in the hot rolling process, while No. 2, 4, 6, and 8 are examples in which two-step cooling (cooling to 700° C. at an average cooling rate of 40° C./s is followed by air cooling in this temperature range for 10 seconds and subsequent cooling to 200° C. or 450° C. at an average cooling rate of 40° C./s) was adopted.

The results obtained are shown in Table 42.

[See Tables 41, 42]

In Table 42, No. 1 is an example of the present invention in which a desired base phase structure of tempered martensite was obtained through predetermined steps of hot rolling→continuous annealing, No. 2 is an example of the present invention in which a desired mixed base phase structure of (tempered martensite+ferrite) was obtained through predetermined steps of hot rolling→continuous annealing, No. 3 is an example of the present invention in which a desired base phase structure of tempered bainite was obtained through predetermined steps of hot rolling (winding at a CT of 450° C. for 1 hour)→continuous annealing, and No. 4 is an example of the present invention in which a desired mixed base phase structure of (tempered bainite+ferrite) was obtained through predetermined steps of hot rolling (winding at a CT of 450° C. for 1 hour). All of them are superior in stretch flange formability; besides, in all of them, a desired fine second phase structure is dispersed uniformly in pre-austenite grain boundaries and block and packet boundaries, and thus their BH characteristics also meet the conditions defined in the present invention.

On the other hand, No. 5 to 8 in Table 42 are examples of production carried out at a heating temperature (SRT) (before hot rolling) exceeding the range defined in the present invention, in which a desired fine second phase structure is not obtained and therefore BH (10%) does not satisfy the condition defined in the present invention although BH (2%) is satisfactory.

Example 18

A Study (Part 2) of Manufacturing Conditions in the Third High Strength Steel Sheet In this Example a study was made about the foregoing manufacturing method (10) or (12), i.e., hot rolling→cold rolling→first continuous annealing→second continuous annealing or plating. More specifically, various steels described in Tables 43 and 45 (all of steel Nos. described in these tables mean the steel Nos. described in Table 35) were vacuum-melted into slabs for experiment. Thereafter, using the slabs, cold rolled steel sheets having a thickness of 1.0 mm were produced under the heat treatment conditions shown in Tables 43 and 45 and were then checked for structures and characteristics in the same manner as in Example 1. No. 1 to 16 in Table 43 are examples of having studied hot rolling→cold rolling→first continuous annealing→second continuous annealing, while No. 1 to 4 in Table 45 are examples of having studied hot rolling→cold rolling→first continuous annealing→plating (further, alloying). The results obtained in Tables 43 and 45 are shown in Tables 44 and 46, respectively.

[See Tables 43, 44, 45]

No. 2 to 7 and 9 to 20 in Table 44 and No. 1 to 4 in Table 46 are examples of production carried out under the conditions defined in the present invention, which are superior not only in tensile strength (TS), elongation (EL), and stretch flange formability (λ), but also in both BH (2%) and BH (10%).

On the other hand, No. 1 in Table 44 is an example of production using steel 1 (low C steel) shown in Table 35, in which desired BH characteristics were not obtained because of a small amount of C although a predetermined base phase structure was produced.

No. 8 in Table 44 is an example of production using steel 5 {steel having a small total amount of (Si+Al)} shown in Table 35, in which desired BH characteristics were not obtained.

Next, in this embodiment, for the purpose of checking the influence of the heat treatment temperature (SRT) before hot rolling on BH characteristics [especially BH (10%)], as shown in Table 47, steel sheets were produced under the conditions given in Table 43 except that SRT was raised from 1050° C. to 1150° C. (exceeding the range defined in the present invention), and were then checked for various mechanical characteristics in the same manner as in Example 1, the results of which are set out in Table 48.

[See Tables 47, 48]

From a comparison in mechanical properties between Tables 44 and 48 it is seen that if SRT is set higher than in the present invention as in Table 48, BH (2%) is approximately the same, but BH (10%) is deteriorated markedly beyond the point of satisfaction for the condition defined in the present invention, and such characteristics as TS, El, and λ are also deteriorated to some extent.

Likewise, for the purpose of checking the influence of SRT, as shown in Table 49, steel sheets were produced under the conditions shown in Table 45 except that SRT was raised from 1050° C. to 1150° C. (exceeding the range defined in the present invention) and were measured for various mechanical properties in the same way as in Example 1, the results of which are shown in Table 50.

[See Tables 49, 50]

A comparison in mechanical properties between Tables 45 and 50 shows that if SRT is set higher than in the present invention, BH (2%) is approximately the same, but BH (10%) is deteriorated markedly beyond the point of satisfaction for the condition defined in the present invention, and such characteristics as TS, El, and λ are also somewhat deteriorated.

Thus, from the results obtained in the above Examples 16 to 18 it is seen that the third high strength steel according to the present invention is superior in the balance of stretch flange formability, total elongation, and bake hardening property in a high-strength and ultra-high strength region of the order of about 500 to 1400 MPa and that above all, in a large strain region, it exhibits an excellent bake hardening property.

INDUSTRIAL APPLICABILITY

According to the present invention it is possible to provide a high strength steel sheet superior in formability (stretch flange formability and total elongation), a high strength steel sheet also having an excellent fatigue characteristic, further, a high strength steel sheet further having a satisfactory bake hardening property, as well as a method which can produce those steel sheets efficiently. Thus, the present invention is extremely useful.

TABLE 1

| No. | C | Si | Mn | P | S | Al | Others |
|---|---|---|---|---|---|---|---|
| 1 | 0.03 | 1.5 | 1.5 | 0.02 | 0.005 | 0.03 | |
| 2 | 0.09 | 1.5 | 1.5 | 0.01 | 0.005 | 0.03 | |
| 3 | 0.15 | 1.5 | 1.5 | 0.03 | 0.006 | 0.03 | |
| 4 | 0.20 | 1.5 | 1.5 | 0.03 | 0.004 | 0.03 | |
| 5 | 0.15 | 0.5 | 1.5 | 0.03 | 0.004 | 1.0 | |
| 6 | 0.15 | 0.3 | 0.3 | 0.02 | 0.004 | 0.03 | |
| 7 | 0.15 | 1.5 | 1.5 | 0.01 | 0.005 | 0.03 | Mo: 0.2 |
| 8 | 0.15 | 1.5 | 1.5 | 0.02 | 0.006 | 0.03 | Ni: 0.2 |
| 9 | 0.15 | 1.5 | 1.5 | 0.02 | 0.006 | 0.03 | Cu: 0.2 |
| 10 | 0.15 | 1.5 | 1.5 | 0.02 | 0.005 | 0.03 | Cr: 0.2 |
| 11 | 0.15 | 1.5 | 1.5 | 0.01 | 0.006 | 0.03 | Ti: 0.03 |
| 12 | 0.15 | 1.5 | 1.5 | 0.02 | 0.005 | 0.03 | Nb: 0.03 |
| 13 | 0.15 | 1.5 | 1.5 | 0.03 | 0.006 | 0.03 | V: 0.03 |
| 14 | 0.15 | 1.5 | 1.5 | 0.01 | 0.005 | 0.03 | Ca: 10 ppm |

TABLE 2

| No. | Steel No. | TM (%) | B (%) | $\gamma_R$ (%) | Others (%) | $C_{\gamma R}$ (%) | TS (Mpa) | El (%) | λ (%) | YR (%) |
|---|---|---|---|---|---|---|---|---|---|---|
| 1 | 1 | 45 | 5 | 0 | 50(F) | — | 469 | 32 | 74 | 78 |
| 2 | 2 | 79 | 8 | 8 | 5(F) | 1.4 | 590 | 38 | 66 | 70 |
| 3 | 3 | 84 | 6 | 10 | 0 | 1.4 | 801 | 39 | 68 | 73 |
| 4 | 4 | 80 | 7 | 13 | 0 | 1.5 | 880 | 39 | 69 | 73 |
| 5 | 5 | 85 | 5 | 10 | 0 | 1.4 | 730 | 38 | 78 | 78 |
| 6 | 6 | 83 | 5 | 1 | 0 | 1.5 | 808 | 20 | 75 | 96 |
| 7 | 7 | 89 | 3 | 8 | 0 | 1.4 | 800 | 37 | 66 | 74 |
| 8 | 8 | 88 | 3 | 9 | 0 | 1.5 | 810 | 36 | 63 | 70 |
| 9 | 9 | 89 | 4 | 7 | 0 | 1.5 | 803 | 38 | 65 | 71 |
| 10 | 10 | 87 | 3 | 10 | 0 | 1.4 | 793 | 39 | 67 | 72 |
| 11 | 11 | 87 | 3 | 10 | 0 | 1.4 | 799 | 39 | 69 | 73 |
| 12 | 12 | 87 | 4 | 9 | 0 | 1.4 | 810 | 38 | 62 | 75 |
| 13 | 13 | 87 | 3 | 10 | 0 | 1.4 | 802 | 39 | 66 | 73 |
| 14 | 14 | 88 | 3 | 9 | 0 | 1.5 | 803 | 38 | 65 | 74 |
| 15 | 4 | 80 | 0 | 13 | 7(M) | 1.3 | 881 | 39 | 63 | 65 |

Notes:
F: ferrite,
M: martensite,
B: bainite,
TM: tempered martensite,
γR: retained austenite

TABLE 3

| No. | Steel No. | M (%) | B (%) | $\gamma_R$ (%) | F (%) | $C_{\gamma R}$ (%) | TS (Mpa) | El (%) | λ (%) | YR (%) |
|---|---|---|---|---|---|---|---|---|---|---|
| 1 | 2 | 23 | 3 | 0 | 74 | — | 850 | 22 | 43 | 52 |
| 2 | 3 | 0 | 4 | 12 | 84 | 1.4 | 788 | 37 | 41 | 67 |
| 3 | 2 | 0 | 83 | 0 | 17 | — | 830 | 15 | 59 | 93 |

Note:
M: martensite,
B: bainite,
γR: retained austenite

TABLE 4

| No. | C | Si | Mn | P | S | Al | Others |
|---|---|---|---|---|---|---|---|
| 1 | 0.15 | 1.5 | 1.5 | 0.02 | 0.005 | 0.03 | |
| 2 | 0.20 | 1.5 | 1.5 | 0.03 | 0.005 | 0.03 | |
| 3 | 0.41 | 1.5 | 1.5 | 0.02 | 0.005 | 0.03 | |
| 4 | 0.48 | 1.5 | 1.5 | 0.02 | 0.006 | 0.03 | |
| 5 | 0.57 | 1.5 | 1.5 | 0.01 | 0.004 | 0.03 | |
| 6 | 0.50 | 0.5 | 1.5 | 0.03 | 0.004 | 1.0 | |
| 7 | 0.42 | 0.3 | 0.3 | 0.01 | 0.004 | 0.03 | |
| 8 | 0.43 | 1.5 | 1.5 | 0.02 | 0.005 | 0.03 | Mo: 0.2 |

TABLE 4-continued

| No. | C | Si | Mn | P | S | Al | Others |
|---|---|---|---|---|---|---|---|
| 9 | 0.42 | 1.5 | 1.5 | 0.01 | 0.006 | 0.03 | Ni: 0.2 |
| 10 | 0.40 | 1.5 | 1.5 | 0.02 | 0.006 | 0.03 | Cu: 0.2 |
| 11 | 0.41 | 1.5 | 1.5 | 0.03 | 0.005 | 0.03 | Cr: 0.2 |
| 12 | 0.42 | 1.5 | 1.5 | 0.01 | 0.006 | 0.03 | Ti: 0.03 |
| 13 | 0.41 | 1.5 | 1.5 | 0.02 | 0.005 | 0.03 | Nb: 0.03 |
| 14 | 0.42 | 1.5 | 1.5 | 0.02 | 0.006 | 0.03 | V: 0.03 |
| 15 | 0.41 | 1.5 | 1.5 | 0.02 | 0.005 | 0.03 | Ca: 10 ppm |

TABLE 5

| No. | Steel No. | TM (%) | B (%) | $\gamma_R$ (%) | Others (%) | $C_{\gamma R}$ (%) | TS (Mpa) | El (%) | λ (%) | YR (%) |
|---|---|---|---|---|---|---|---|---|---|---|
| 1 | 1 | 84 | 6 | 10 | 0 | 1.2 | 801 | 39 | 48 | 73 |
| 2 | 2 | 82 | 7 | 11 | 0 | 1.3 | 830 | 39 | 49 | 73 |
| 3 | 3 | 73 | 7 | 20 | 0 | 1.4 | 860 | 51 | 50 | 75 |
| 4 | 4 | 67 | 9 | 24 | 0 | 1.6 | 910 | 55 | 51 | 74 |
| 5 | 5 | 67 | 5 | 28 | 0 | 1.5 | 940 | 49 | 49 | 73 |
| 6 | 6 | 65 | 10 | 25 | 0 | 1.6 | 850 | 45 | 48 | 75 |
| 7 | 7 | 79 | 20 | 1 | 0 | 0.2 | 890 | 20 | 50 | 95 |
| 8 | 8 | 75 | 4 | 21 | 0 | 1.6 | 870 | 51 | 49 | 76 |
| 9 | 9 | 74 | 5 | 21 | 0 | 1.7 | 870 | 50 | 53 | 74 |
| 10 | 10 | 75 | 5 | 20 | 0 | 1.8 | 860 | 52 | 51 | 75 |
| 11 | 11 | 75 | 5 | 20 | 0 | 1.7 | 860 | 49 | 52 | 75 |
| 12 | 12 | 74 | 5 | 21 | 0 | 1.8 | 850 | 50 | 49 | 73 |
| 13 | 13 | 74 | 6 | 20 | 0 | 1.7 | 860 | 51 | 51 | 74 |
| 14 | 14 | 75 | 5 | 20 | 0 | 1.8 | 858 | 50 | 50 | 73 |
| 15 | 15 | 73 | 7 | 20 | 0 | 1.7 | 850 | 49 | 49 | 74 |
| 16 | 3 | 34 | 5 | 20 | 41(P) | 0.6 | 780 | 21 | 33 | 83 |
| 17 | 4 | 68 | 0 | 27 | 5(M) | 1.5 | 910 | 54 | 50 | 65 |

Notes:
P: pearlite
M: martensite,
TM: tempered martensite,
B: bainite,
γR: retained austenite

TABLE 6

| No. | M (%) | B (%) | $\gamma_R$ (%) | F (%) | $C_{\gamma R}$ (%) | TS (Mpa) | El (%) | λ (%) | YR (%) |
|---|---|---|---|---|---|---|---|---|---|
| 3 | 0 | 4 | 12 | 84 | 1.4 | 788 | 37 | 41 | 67 |

Note:
M: martensite,
B: bainite,
F: ferrite,
γR: retained austenite

TABLE 7

| | No. | Hot rolling SRT ° C. | FDT ° C. | CR ° C./s | CT ° C. | Cold rolling Cold rolling rate % | Continuous annealing T1 ° C. | CR ° C./s | T2 ° C. | Continuous annealing or plating T3 ° C. | t3 sec | CR ° C./s | T4 ° C. | t4 sec | Zn→GA ° C. | Desired structure | Details of structure |
|---|---|---|---|---|---|---|---|---|---|---|---|---|---|---|---|---|---|
| Hot rolling → Continuous annealing | 1 | 1150 | 900 | 50 | 200 | — | — | — | — | 800 | 60 | 10 | 400 | 10 | — | ○ | |
| | 2 | 1150 | 750 | 50 | 200 | — | — | — | — | 800 | 60 | 10 | 400 | 10 | — | X | F |
| | 3 | 1150 | 900 | 60 | 200 | — | — | — | — | 800 | 60 | 10 | 400 | 10 | — | ○ | |
| | 4 | 1150 | 900 | 15 | 200 | — | — | — | — | 800 | 60 | 10 | 400 | 10 | — | X | F, P |
| | 5 | 1150 | 900 | 50 | 400 | — | — | — | — | 800 | 60 | 10 | 400 | 10 | — | X | B |

TABLE 7-continued

| | No. | Hot rolling SRT ° C. | FDT ° C. | CR ° C./s | CT ° C. | Cold rolling Cold rolling rate % | Continuous annealing T1 ° C. | CR ° C./s | T2 ° C. | Continuous annealing or plating T3 ° C. | t3 sec | CR ° C./s | T4 ° C. | t4 sec | Zn→ GA ° C. | Desired structure | Details of structure |
|---|---|---|---|---|---|---|---|---|---|---|---|---|---|---|---|---|---|
| | 6 | 1150 | 900 | 50 | RT | — | — | — | — | 800 | 60 | 10 | 400 | 10 | — | ○ | |
| | 7 | 1150 | 900 | 50 | 550 | — | — | — | — | 800 | 60 | 10 | 400 | 10 | — | X | Conventional TRIP |
| | 8 | 1150 | 900 | 50 | 200 | — | — | — | — | 900 | 60 | 10 | 400 | 10 | — | X | B |
| | 9 | 1150 | 900 | 50 | 200 | — | — | — | — | 850 | 60 | 10 | 400 | 10 | — | ○ | |
| | 10 | 1150 | 900 | 50 | 200 | — | — | — | — | 750 | 60 | 10 | 400 | 10 | — | ○ | |
| | 11 | 1150 | 900 | 50 | 200 | — | — | — | — | 700 | 60 | 10 | 400 | 10 | — | ○ | |
| | 12 | 1150 | 900 | 50 | 200 | — | — | — | — | 650 | 60 | 10 | 400 | 10 | — | X | γ-less |
| | 13 | 1150 | 900 | 50 | 200 | — | — | — | — | 800 | 180 | 10 | 400 | 10 | — | ○ | |
| | 14 | 1150 | 900 | 50 | 200 | — | — | — | — | 800 | 30 | 10 | 400 | 10 | — | ○ | |
| | 15 | 1150 | 900 | 50 | 200 | — | — | — | — | 800 | 5 | 10 | 400 | 10 | — | X | Insufficient tempering |
| | 16 | 1150 | 900 | 50 | 200 | — | — | — | — | 800 | 60 | 5 | 400 | 10 | — | ○ | |
| | 17 | 1150 | 900 | 50 | 200 | — | — | — | — | 800 | 30 | 1 | 400 | 10 | — | X | P |
| | 18 | 1150 | 900 | 50 | 200 | — | — | — | — | 800 | 60 | 10 | 450 | 10 | — | ○ | |
| | 19 | 1150 | 900 | 50 | 200 | — | — | — | — | 800 | 60 | 10 | 350 | 10 | — | ○ | |
| | 20 | 1150 | 900 | 50 | 200 | — | — | — | — | 800 | 60 | 10 | 200 | 10 | — | X | Austempering not performed, M obtained |
| | 21 | 1150 | 900 | 50 | 200 | — | — | — | — | 800 | 60 | 10 | RT | — | — | X | Austempering not performed, M obtained |
| | 22 | 1150 | 900 | 50 | 200 | — | — | — | — | 800 | 60 | 10 | 400 | 100 | — | ○ | |
| | 23 | 1150 | 900 | 50 | 200 | — | — | — | — | 800 | 60 | 10 | 400 | 1 | — | ○ | |
| Hot rolling → Plating | 24 | 1150 | 900 | 50 | 200 | — | — | — | — | 800 | 60 | 10 | 400 | 10 | 600 | ○ | |
| Hot rolling → Cold rolling → Continuous annealing | 25 | 1150 | 900 | 50 | 200 | 10 | — | — | — | 800 | 60 | 10 | 400 | 10 | — | ○ | |
| | 26 | 1150 | 900 | 50 | 200 | 40 | — | — | — | 800 | 60 | 10 | 400 | 10 | — | X | F (tempered M not obtained) |
| Hot rolling → Cold rolling → Plating | 27 | 1150 | 900 | 50 | 200 | 10 | — | — | — | 800 | 60 | 10 | 400 | 10 | 600 | ○ | |

Notes:
F: ferrite,
P: pearlite,
B: bainite,
M: martensite

TABLE 8

| | No. | Hot rolling SRT ° C. | FDT ° C. | CR ° C./s | CT ° C. | Cold rolling Cold rolling rate % | Continuous annealing T1 ° C. | CR ° C./s | T2 ° C. | Continuous annealing or plating T3 ° C. | t3 sec | CR ° C./s | T4 ° C. | t4 sec | Zn→ GA ° C. | Desired structure | Details of structure |
|---|---|---|---|---|---|---|---|---|---|---|---|---|---|---|---|---|---|
| Hot rolling → Cold rolling → First continuous annealing → Second continuous annealing | 28 | 1150 | 900 | 50 | 550 | 60 | 900 | 20 | RT | 800 | 60 | 10 | 400 | 10 | — | ○ | |
| | 29 | 1150 | 900 | 50 | 550 | 60 | 800 | 20 | RT | 800 | 60 | 10 | 400 | 10 | — | X | F |
| | 30 | 1150 | 900 | 50 | 550 | 60 | 700 | 20 | RT | 800 | 60 | 10 | 400 | 10 | — | X | F |
| | 31 | 1150 | 900 | 50 | 550 | 60 | 900 | 50 | RT | 800 | 60 | 10 | 400 | 10 | — | ○ | |
| | 32 | 1150 | 900 | 50 | 550 | 60 | 900 | 10 | RT | 800 | 60 | 10 | 400 | 10 | — | ○ | |
| | 33 | 1150 | 900 | 50 | 550 | 60 | 900 | 5 | RT | 800 | 60 | 10 | 400 | 10 | — | X | F, P |
| | 34 | 1150 | 900 | 50 | 550 | 60 | 900 | 20 | 200 | 800 | 60 | 10 | 400 | 10 | — | ○ | |
| | 35 | 1150 | 900 | 50 | 550 | 60 | 900 | 20 | RT | 900 | 60 | 10 | 400 | 10 | — | X | B |
| | 36 | 1150 | 900 | 50 | 550 | 60 | 900 | 20 | RT | 850 | 60 | 10 | 400 | 10 | — | ○ | |
| | 37 | 1150 | 900 | 50 | 550 | 60 | 900 | 20 | RT | 750 | 60 | 10 | 400 | 10 | — | ○ | |
| | 38 | 1150 | 900 | 50 | 550 | 60 | 900 | 20 | RT | 700 | 60 | 10 | 400 | 10 | — | ○ | |
| | 39 | 1150 | 900 | 50 | 550 | 60 | 900 | 20 | RT | 650 | 60 | 10 | 400 | 10 | — | X | γ-less |
| | 40 | 1150 | 900 | 50 | 550 | 60 | 900 | 20 | RT | 800 | 1000 | 10 | 400 | 10 | — | X | F |
| | 41 | 1150 | 900 | 50 | 550 | 60 | 900 | 20 | RT | 800 | 180 | 10 | 400 | 10 | — | ○ | |

TABLE 8-continued

| | No. | Hot rolling SRT ° C. | FDT ° C. | CR ° C./s | CT ° C. | Cold rolling Cold rolling rate % | Continuous annealing T1 ° C. | CR ° C./s | T2 ° C. | Continuous annealing or plating T3 ° C. | t3 sec | CR ° C./s | T4 ° C. | t4 sec | Zn→ GA ° C. | Desired structure | Details of structure |
|---|---|---|---|---|---|---|---|---|---|---|---|---|---|---|---|---|---|
| | 42 | 1150 | 900 | 50 | 550 | 60 | 900 | 20 | RT | 800 | 30 | 10 | 400 | 10 | — | ○ | |
| | 43 | 1150 | 900 | 50 | 550 | 60 | 900 | 20 | RT | 800 | 5 | 10 | 400 | 10 | — | X | Insufficient tempering |
| | 44 | 1150 | 900 | 50 | 550 | 60 | 900 | 20 | RT | 800 | 60 | 5 | 400 | 10 | — | ○ | |
| | 45 | 1150 | 900 | 50 | 550 | 60 | 900 | 20 | RT | 800 | 30 | 1 | 400 | 10 | — | X | P |
| | 46 | 1150 | 900 | 50 | 550 | 60 | 900 | 20 | RT | 800 | 60 | 10 | 450 | 10 | — | ○ | |
| | 47 | 1150 | 900 | 50 | 550 | 60 | 900 | 20 | RT | 800 | 60 | 10 | 350 | 10 | — | ○ | |
| | 48 | 1150 | 900 | 50 | 550 | 60 | 900 | 20 | RT | 800 | 60 | 10 | 200 | 10 | — | X | Austempering not performed, M obtained |
| | 49 | 1150 | 900 | 50 | 550 | 60 | 900 | 20 | RT | 800 | 60 | 10 | RT | — | — | X | Austempering not performed, M obtained |
| | 50 | 1150 | 900 | 50 | 550 | 60 | 900 | 20 | RT | 800 | 60 | 10 | 400 | 100 | — | ○ | |
| | 51 | 1150 | 900 | 50 | 550 | 60 | 900 | 20 | RT | 800 | 60 | 10 | 400 | 1 | — | ○ | |
| Hot rolling → Cold rolling → First continuous annealing → Plating | 52 | 1150 | 900 | 50 | 550 | 50 | 900 | 20 | RT | 800 | 60 | 10 | 400 | 10 | 600 | ○ | |

Notes:
F: ferrite,
P: pearlite,
M: martensite,
B: bainite

TABLE 9

| Run No. | Steel No. | TB (%) | B (%) | $\gamma_R$ (%) | Others (%) | $C_{\gamma R}$ (%) | TS (Mpa) | El (%) | λ (%) | YR (%) |
|---|---|---|---|---|---|---|---|---|---|---|
| 1 | 1 | 47 | 3 | 0 | 50 (F) | — | 458 | 38 | 68 | 83 |
| 2 | 2 | 82 | 5 | 8 | 5 (F) | 1.2 | 572 | 39 | 60 | 77 |
| 3 | 3 | 86 | 4 | 10 | 0 | 1.1 | 790 | 39 | 55 | 76 |
| 4 | 4 | 81 | 6 | 13 | 0 | 1.3 | 875 | 40 | 55 | 77 |
| 5 | 5 | 87 | 4 | 9 | 0 | 1.3 | 780 | 41 | 60 | 73 |
| 6 | 6 | 95 | 4 | 1 | 0 | 0.4 | 790 | 10 | 71 | 103 |
| 7 | 7 | 87 | 5 | 8 | 0 | 1.3 | 799 | 38 | 55 | 79 |
| 8 | 8 | 86 | 5 | 9 | 0 | 1.3 | 809 | 37 | 50 | 75 |
| 9 | 9 | 87 | 6 | 7 | 0 | 1.4 | 800 | 39 | 54 | 76 |
| 10 | 10 | 85 | 5 | 10 | 0 | 1.3 | 799 | 38 | 58 | 77 |
| 11 | 11 | 84 | 6 | 10 | 0 | 1.3 | 789 | 39 | 61 | 76 |
| 12 | 12 | 88 | 3 | 9 | 0 | 1.4 | 807 | 37 | 66 | 82 |
| 13 | 13 | 86 | 4 | 10 | 0 | 1.3 | 800 | 39 | 54 | 75 |
| 14 | 14 | 88 | 3 | 9 | 0 | 1.4 | 800 | 37 | 58 | 76 |
| 15 | 4 | 80 | 0 | 14 | 6(M) | 1.3 | 881 | 39 | 54 | 70 |

Notes:
F: ferrite,
M: martensite,
B: bainite,
TB: tempered bainite,
$\gamma R$: retained austenite

TABLE 10

| No. | Steel No. | TB (%) | B (%) | $\gamma_R$ (%) | Others (%) | $C_{\gamma R}$ (%) | TS (Mpa) | El (%) | λ (%) | YR (%) |
|---|---|---|---|---|---|---|---|---|---|---|
| 1 | 1 | 86 | 4 | 10 | 0 | 1.2 | 790 | 39 | 55 | 76 |
| 2 | 2 | 81 | 6 | 13 | 0 | 1.3 | 875 | 40 | 55 | 77 |
| 3 | 3 | 76 | 4 | 20 | 0 | 1.5 | 895 | 51 | 60 | 76 |
| 4 | 4 | 71 | 6 | 23 | 0 | 1.6 | 900 | 50 | 59 | 75 |

TABLE 10-continued

| No. | Steel No. | TB (%) | B (%) | $\gamma_R$ (%) | Others (%) | $C_{\gamma R}$ (%) | TS (Mpa) | El (%) | λ (%) | YR (%) |
|---|---|---|---|---|---|---|---|---|---|---|
| 5 | 5 | 75 | 4 | 25 | 0 | 1.7 | 910 | 49 | 58 | 73 |
| 6 | 6 | 72 | 5 | 23 | 0 | 1.8 | 870 | 48 | 59 | 72 |
| 7 | 7 | 84 | 15 | 1 | 0 | 0.5 | 880 | 12 | 58 | 72 |
| 8 | 8 | 81 | 5 | 21 | 0 | 1.7 | 890 | 53 | 61 | 74 |
| 9 | 9 | 81 | 6 | 20 | 0 | 1.8 | 900 | 51 | 62 | 76 |
| 10 | 10 | 83 | 5 | 20 | 0 | 1.6 | 905 | 50 | 60 | 77 |
| 11 | 11 | 81 | 6 | 20 | 0 | 1.7 | 895 | 49 | 59 | 71 |
| 12 | 12 | 86 | 3 | 21 | 0 | 1.6 | 890 | 53 | 57 | 70 |
| 13 | 13 | 82 | 5 | 20 | 0 | 1.7 | 860 | 51 | 58 | 69 |
| 14 | 14 | 82 | 6 | 20 | 0 | 1.8 | 880 | 50 | 61 | 73 |
| 15 | 15 | 82 | 4 | 21 | 0 | 1.7 | 890 | 48 | 60 | 70 |
| 16 | 3 | 32 | 12 | 20 | 45(P) | 0.7 | 695 | 21 | 43 | 75 |
| 17 | 4 | 70 | 0 | 25 | 5(M) | 1.6 | 900 | 50 | 50 | 65 |

Notes:
B: bainite,
P: pearlite
M: martensite,
TB: tempered bainite,
γR: retained austenite

TABLE 11

| No. | M (%) | B (%) | γR (%) | F (%) | $C_{\gamma R}$ (%) | TS (Mpa) | EI (%) | λ (%) | YR (%) |
|---|---|---|---|---|---|---|---|---|---|
| 3 | 0 | 4 | 12 | 84 | 1.4 | 788 | 37 | 41 | 67 |

Note:
B: bainite,
M: martensite,
γR: retained austenite

TABLE 12

| | | Hot rolling | | | | Cold rolling | Continuous annealing | | |
|---|---|---|---|---|---|---|---|---|---|
| | No. | SRT ° C. | FDT ° C. | CR ° C./s | CT ° C. | Cold rolling rate % | T1 ° C. | CR ° C./s | T2 ° C. |
| Hot rolling → Continuous annealing | 1 | 1150 | 900 | 50 | 480 | — | — | — | — |
| | 2 | 1150 | 750 | 50 | 480 | — | — | — | — |
| | 3 | 1150 | 900 | 60 | 480 | — | — | — | — |
| | 4 | 1150 | 900 | 15 | 200 | — | — | — | — |
| | 5 | 1150 | 900 | 50 | RT | — | — | — | — |
| | 6 | 1150 | 900 | 50 | 750 | — | — | — | — |
| | 7 | 1150 | 900 | 50 | 380 | — | — | — | — |
| | 8 | 1150 | 900 | 50 | 380 | — | — | — | — |
| | 9 | 1150 | 900 | 50 | 380 | — | — | — | — |
| | 10 | 1150 | 900 | 50 | 380 | — | — | — | — |
| | 11 | 1150 | 900 | 50 | 380 | — | — | — | — |
| | 12 | 1150 | 900 | 50 | 380 | — | — | — | — |
| | 13 | 1150 | 900 | 50 | 380 | — | — | — | — |
| | 14 | 1150 | 900 | 50 | 380 | — | — | — | — |
| | 15 | 1150 | 900 | 50 | 380 | — | — | — | — |
| | 16 | 1150 | 900 | 50 | 380 | — | — | — | — |
| | 17 | 1150 | 900 | 50 | 380 | — | — | — | — |
| | 18 | 1150 | 900 | 50 | 380 | — | — | — | — |
| | 19 | 1150 | 900 | 50 | 380 | — | — | — | — |
| | 20 | 1150 | 900 | 50 | 380 | — | — | — | — |
| | 21 | 1150 | 900 | 50 | 380 | — | — | — | — |
| | 22 | 1150 | 900 | 50 | 380 | — | — | — | — |
| Hot rolling → Plating | 23 | 1150 | 900 | 50 | 380 | — | — | — | — |
| Hot rolling → Cold rolling → Continuous annealing | 24 | 1150 | 900 | 50 | 380 | 10 | — | — | — |
| | 25 | 1150 | 900 | 50 | 380 | 40 | — | — | — |
| Hot rolling → Cold rolling → Plating | 26 | 1150 | 900 | 50 | 380 | 10 | — | — | — |

TABLE 12-continued

| | Continuous annealing or plating | | | | | | | |
|---|---|---|---|---|---|---|---|---|
| | T3 ° C. | t3 sec | CR ° C/s | T4 ° C. | t4 sec | Zn→GA ° C. | Desired structure | Details of structure |
| Hot rolling → Continuous annealing | 800 | 60 | 10 | 400 | 10 | — | ○ | |
| | 800 | 60 | 10 | 400 | 10 | — | X | F |
| | 800 | 60 | 10 | 400 | 10 | — | ○ | |
| | 800 | 60 | 10 | 400 | 10 | — | X | F, P |
| | 800 | 60 | 10 | 400 | 10 | — | X | Tempered martensite |
| | 800 | 60 | 10 | 400 | 10 | — | X | Conventional TRIP |
| | 900 | 60 | 10 | 400 | 10 | — | X | B |
| | 850 | 60 | 10 | 400 | 10 | — | ○ | |
| | 750 | 60 | 10 | 400 | 10 | — | ○ | |
| | 700 | 60 | 10 | 400 | 10 | — | ○ | |
| | 650 | 60 | 10 | 400 | 10 | — | X | γ-less |
| | 800 | 180 | 10 | 400 | 10 | — | ○ | |
| | 800 | 30 | 10 | 400 | 10 | — | ○ | |
| | 800 | 5 | 10 | 400 | 10 | — | X | Insufficient tempering |
| | 800 | 60 | 5 | 400 | 10 | — | ○ | |
| | 800 | 30 | 3 | 400 | 10 | — | X | P |
| | 800 | 60 | 10 | 450 | 10 | — | ○ | |
| | 800 | 60 | 10 | 350 | 10 | — | ○ | |
| | 800 | 60 | 10 | 200 | 10 | — | X | Austempering not performed |
| | 800 | 60 | 10 | RT | — | — | X | Austempering not performed |
| | 800 | 60 | 10 | 400 | 100 | — | ○ | |
| | 800 | 60 | 10 | 400 | 1 | — | ○ | |
| Hot rolling → Plating | 800 | 60 | 10 | 400 | 10 | 600 | ○ | |
| Hot rolling → Cold rolling → Continuous annealing | 800 | 60 | 10 | 400 | 10 | — | ○ | |
| | 800 | 60 | 10 | 400 | 10 | — | X | F (tempered M not obtained) |
| Hot rolling → Cold rolling → Plating | 800 | 60 | 10 | 400 | 10 | 600 | ○ | |

Notes:
F: ferrite,
P: pearlite,
B: bainite,
M: martensite

TABLE 13

| | | Hot rolling | | | | Cold rolling | Continuous annealing | | |
|---|---|---|---|---|---|---|---|---|---|
| | No. | SRT ° C. | FDT ° C. | CR ° C./s | CT ° C. | Cold rolling rate % | T1 ° C. | CR ° C./s | T2 ° C. |
| Hot rolling → rolling → First continuous annealing → Second continuous annealing | 27 | 1150 | 850 | 40 | 550 | 60 | 900 | 20 | 480 |
| | 28 | 1150 | 850 | 40 | 550 | 60 | 800 | 20 | 480 |
| | 29 | 1150 | 850 | 40 | 550 | 60 | 700 | 20 | 480 |
| | 30 | 1150 | 850 | 40 | 550 | 60 | 900 | 50 | 480 |
| | 31 | 1150 | 850 | 40 | 550 | 60 | 900 | 10 | 480 |
| | 32 | 1150 | 850 | 40 | 550 | 60 | 900 | 5 | 480 |
| | 33 | 1150 | 850 | 40 | 550 | 60 | 900 | 20 | 700 |
| | 34 | 1150 | 850 | 40 | 550 | 60 | 900 | 20 | 480 |
| | 35 | 1150 | 850 | 40 | 550 | 60 | 900 | 20 | 480 |
| | 36 | 1150 | 850 | 40 | 550 | 60 | 900 | 20 | 480 |
| | 37 | 1150 | 850 | 40 | 550 | 60 | 900 | 20 | 480 |
| | 38 | 1150 | 850 | 40 | 550 | 60 | 900 | 20 | 480 |
| | 39 | 1150 | 850 | 40 | 550 | 60 | 900 | 20 | 480 |
| | 40 | 1150 | 850 | 40 | 550 | 60 | 900 | 20 | 480 |
| | 41 | 1150 | 850 | 40 | 550 | 60 | 900 | 20 | 480 |
| | 42 | 1150 | 850 | 40 | 550 | 60 | 900 | 20 | 480 |
| | 43 | 1150 | 850 | 40 | 550 | 60 | 900 | 20 | 480 |
| | 44 | 1150 | 850 | 40 | 550 | 60 | 900 | 20 | 480 |
| | 45 | 1150 | 850 | 40 | 550 | 60 | 900 | 20 | 480 |
| | 46 | 1150 | 850 | 40 | 550 | 60 | 900 | 20 | 480 |
| | 47 | 1150 | 850 | 40 | 550 | 60 | 900 | 20 | 480 |
| | 48 | 1150 | 850 | 40 | 550 | 60 | 900 | 20 | 480 |

TABLE 13-continued

| | | | | | | | | | | |
|---|---|---|---|---|---|---|---|---|---|---|
| | | 49 | 1150 | 850 | 40 | 550 | 60 | 900 | 20 | 480 |
| | | 50 | 1150 | 850 | 40 | 550 | 60 | 900 | 20 | 480 |
| Hot rolling → Cold rolling → First continuous annealing → Plating | | 51 | 1150 | 850 | 40 | 550 | 50 | 900 | 20 | 480 |

| | Continuous annealing or plating | | | | | | | |
|---|---|---|---|---|---|---|---|---|
| | T3 ° C. | t3 sec | CR ° C/s | T4 ° C. | t4 sec | Zn→GA ° C. | Desired structure | Details of structure |
| Hot rolling → First continuous annealing → Second continuous annealing | 800 | 60 | 10 | 400 | 10 | — | ○ | |
| | 800 | 60 | 10 | 400 | 10 | — | X | F |
| | 800 | 60 | 10 | 400 | 10 | — | X | F |
| | 800 | 60 | 10 | 400 | 10 | — | ○ | |
| | 800 | 60 | 10 | 400 | 10 | — | ○ | |
| | 800 | 60 | 10 | 400 | 10 | — | X | F, P |
| | 800 | 60 | 10 | 400 | 10 | — | ○ | |
| | 900 | 60 | 10 | 400 | 10 | — | X | B |
| | 850 | 60 | 10 | 400 | 10 | — | ○ | |
| | 750 | 60 | 10 | 400 | 10 | — | ○ | |
| | 700 | 60 | 10 | 400 | 10 | — | ○ | |
| | 650 | 60 | 10 | 400 | 10 | — | X | γ-less |
| | 800 | ### | 10 | 400 | 10 | — | X | |
| | 800 | 180 | 10 | 400 | 10 | — | ○ | |
| | 800 | 30 | 10 | 400 | 10 | — | ○ | |
| | 800 | 5 | 10 | 400 | 10 | — | X | Insufficient tempering |
| | 800 | 60 | 5 | 400 | 10 | — | ○ | |
| | 800 | 30 | 3 | 400 | 10 | — | X | P |
| | 800 | 60 | 10 | 450 | 10 | — | ○ | |
| | 800 | 60 | 10 | 350 | 10 | — | ○ | |
| | 800 | 60 | 10 | 200 | 10 | — | X | Austempering not performed |
| | 800 | 60 | 10 | RT | — | — | X | Austempering not performed |
| | 800 | 60 | 10 | 400 | 100 | — | ○ | |
| | 800 | 60 | 10 | 400 | 1 | — | ○ | |
| Hot rolling → Cold rolling → First continuous annealing → Plating | 800 | 60 | 10 | 400 | 10 | 600 | ○ | |

Notes:
F: ferrite,
P: pearlite,
B: bainite

TABLE 14

| No. | Steel No. | TM (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 1 | 1 | 20 | 5 | 0 | 75 | 0 | — | 770 | 25 | 50 | 73 |
| 2 | 2 | 30 | 5 | 15 | 50 | 0 | 0.6 | 701 | 31 | 46 | 67 |
| 3 | 2 | 33 | 8 | 5 | 54 | 0 | 1.4 | 760 | 38 | 56 | 65 |
| 4 | 3 | 30 | 6 | 10 | 54 | 0 | 1.5 | 820 | 39 | 58 | 68 |
| 5 | 4 | 33 | 7 | 13 | 47 | 0 | 1.5 | 810 | 39 | 59 | 68 |
| 6 | 5 | 42 | 6 | 12 | 40 | 0 | 1.4 | 790 | 38 | 60 | 67 |
| 7 | 6 | 39 | 5 | 1 | 55 | 0 | 1.2 | 800 | 14 | 65 | 91 |
| 8 | 7 | 33 | 3 | 8 | 56 | 0 | 1.4 | 790 | 37 | 56 | 69 |
| 9 | 8 | 32 | 2 | 9 | 57 | 0 | 1.4 | 785 | 36 | 53 | 65 |
| 10 | 9 | 36 | 3 | 7 | 54 | 0 | 1.5 | 770 | 38 | 55 | 66 |
| 11 | 10 | 32 | 4 | 9 | 55 | 0 | 1.4 | 780 | 39 | 57 | 67 |
| 12 | 11 | 26 | 5 | 8 | 61 | 0 | 1.5 | 805 | 39 | 59 | 68 |
| 13 | 12 | 30 | 3 | 9 | 58 | 0 | 1.4 | 815 | 38 | 52 | 70 |
| 14 | 13 | 30 | 2 | 8 | 60 | 0 | 1.5 | 810 | 38 | 59 | 64 |

TABLE 14-continued

| No. | Steel No. | TM (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 15 | 14 | 26 | 6 | 9 | 59 | 0 | 1.5 | 790 | 39 | 58 | 68 |
| 16 | 2 | 72 | 5 | 8 | 15 | 0 | 1.3 | 750 | 40 | 66 | 70 |
| 17 | 3 | 69 | 4 | 9 | 18 | 0 | 1.5 | 740 | 41 | 65 | 69 |
| 18 | 4 | 66 | 4 | 10 | 20 | 0 | 1.5 | 800 | 42 | 65 | 71 |
| 19 | 3 | 24 | 4 | 10 | 44 | 18(P) | 1.3 | 770 | 29 | 43 | 78 |
| 20 | 4 | 33 | 0 | 13 | 49 | 5(M) | 1.5 | 810 | 38 | 57 | 61 |

Notes:
P: pearlite
M: martensite,
B: bainite,
TM: tempered martensite,
γR: retained austenite

TABLE 15

| No. | C | Si | Mn | P | S | AI | Others |
|---|---|---|---|---|---|---|---|
| 1 | 0.15 | 1.5 | 1.5 | 0.02 | 0.005 | 0.03 | |
| 2 | 0.20 | 1.5 | 1.5 | 0.03 | 0.005 | 0.03 | |
| 3 | 0.41 | 1.5 | 1.5 | 0.02 | 0.006 | 0.03 | |
| 4 | 0.48 | 1.5 | 1.5 | 0.02 | 0.004 | 0.03 | |
| 5 | 0.57 | 1.5 | 1.5 | 0.01 | 0.004 | 0.03 | |
| 6 | 0.50 | 0.5 | 1.5 | 0.03 | 0.004 | 1.0 | |
| 7 | 0.41 | 0.3 | 0.3 | 0.01 | 0.004 | 0.03 | |
| 8 | 0.42 | 1.5 | 1.5 | 0.02 | 0.005 | 0.03 | Mo: 0.2 |

TABLE 15-continued

| No. | C | Si | Mn | P | S | AI | Others |
|---|---|---|---|---|---|---|---|
| 9 | 0.40 | 1.5 | 1.5 | 0.01 | 0.006 | 0.03 | Ni: 0.2 |
| 10 | 0.41 | 1.5 | 1.5 | 0.02 | 0.006 | 0.03 | Cu: 0.2 |
| 11 | 0.40 | 1.5 | 1.5 | 0.03 | 0.005 | 0.03 | Cr: 0.2 |
| 12 | 0.41 | 1.5 | 1.5 | 0.01 | 0.006 | 0.03 | Ti: 0.03 |
| 13 | 0.40 | 1.5 | 1.5 | 0.02 | 0.005 | 0.03 | Nb: 0.03 |
| 14 | 0.41 | 1.5 | 1.5 | 0.02 | 0.006 | 0.03 | V: 0.03 |
| 15 | 0.40 | 1.5 | 1.5 | 0.02 | 0.005 | 0.03 | Ca: 10 ppm |

TABLE 16

| No. | Steel No. | TM (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 1 | 1 | 56 | 5 | 0 | 41 | 0 | — | 710 | 27 | 59 | 66 |
| 2 | 2 | 41 | 8 | 8 | 43 | 0 | 0.7 | 810 | 53 | 54 | 65 |
| 3 | 3 | 32 | 6 | 18 | 44 | 0 | 0.6 | 720 | 25 | 41 | 60 |
| 4 | 3 | 39 | 6 | 17 | 45 | 0 | 1.5 | 850 | 56 | 55 | 64 |
| 5 | 4 | 32 | 7 | 21 | 48 | 0 | 1.7 | 910 | 55 | 55 | 65 |
| 6 | 5 | 25 | 4 | 22 | 49 | 0 | 1.9 | 900 | 48 | 56 | 61 |
| 7 | 6 | 31 | 6 | 18 | 45 | 0 | 1.8 | 890 | 49 | 59 | 60 |
| 8 | 7 | 36 | 5 | 5 | 58 | 0 | 0.8 | 830 | 25 | 53 | 90 |
| 9 | 8 | 44 | 3 | 18 | 45 | 0 | 1.7 | 813 | 57 | 54 | 66 |
| 10 | 9 | 46 | 2 | 18 | 43 | 0 | 1.7 | 810 | 56 | 52 | 64 |
| 11 | 10 | 45 | 3 | 15 | 45 | 0 | 1.6 | 820 | 53 | 55 | 63 |
| 12 | 11 | 43 | 4 | 17 | 44 | 0 | 1.7 | 823 | 52 | 54 | 65 |
| 13 | 12 | 41 | 5 | 16 | 46 | 0 | 1.7 | 818 | 51 | 53 | 61 |
| 14 | 13 | 45 | 3 | 17 | 43 | 0 | 1.6 | 820 | 50 | 56 | 62 |
| 15 | 14 | 45 | 2 | 15 | 45 | 0 | 1.5 | 825 | 51 | 53 | 61 |
| 16 | 15 | 42 | 6 | 17 | 43 | 0 | 1.6 | 822 | 52 | 54 | 62 |
| 17 | 3 | 56 | 4 | 20 | 20 | 0 | 1.5 | 800 | 55 | 61 | 62 |
| 18 | 4 | 54 | 5 | 18 | 23 | 0 | 1.6 | 820 | 54 | 64 | 63 |
| 19 | 5 | 53 | 5 | 20 | 22 | 0 | 1.4 | 815 | 54 | 63 | 62 |
| 20 | 4 | 22 | 5 | 10 | 40 | 23(P) | 0.6 | 770 | 28 | 32 | 60 |
| 21 | 4 | 35 | 0 | 20 | 40 | 5(M) | 1.5 | 840 | 55 | 50 | 60 |

Notes:
P: pearlite
M: martensite,
F: ferrite,
TM: tempered martensite,
γR: retained austenite

TABLE 17

| No. | Steel No. | M (%) | B (%) | γR (%) | F (%) | $C_{\gamma R}$ (%) | TS (Mpa) | El (%) | λ (%) | YR (%) |
|---|---|---|---|---|---|---|---|---|---|---|
| 22 | 2 | 23 | 3 | 0 | 74 | — | 850 | 22 | 43 | 52 |
| 23 | 3 | 0 | 4 | 12 | 84 | 1.4 | 788 | 37 | 41 | 67 |
| 24 | 2 | 0 | 83 | 0 | 17 | — | 830 | 15 | 59 | 93 |

Note:
M: martensite,
B: bainite,
F: ferrite,
γR: retained austenite

TABLE 18

| | | Hot rolling | | | | | | | Cold rolling | Continuous annealing | | |
|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | Cold rolling rate % | T1 ° C. | CR ° C./s | T2 ° C. |
| Hot rolling → Continuous annealing | 1 | 1150 | 850 | 40 | 700 | 40 | 20 | 200 | — | — | — | — |
| | 2 | 1150 | 850 | 40 | 700 | 40 | 20 | 450 | — | — | — | — |
| | 3 | 1150 | 850 | 40 | 700 | 40 | 20 | RT | — | — | — | — |
| | 4 | 1150 | 850 | 40 | 700 | 40 | 20 | RT | — | — | — | — |
| | 5 | 1150 | 850 | 40 | — | — | 40 | 550 | — | — | — | — |
| | 6 | 1150 | 850 | 5 | — | — | 5 | 200 | — | — | — | — |
| | 7 | 1150 | 750 | 40 | — | — | 40 | 200 | — | — | — | — |
| | 8 | 1150 | 850 | 40 | 700 | 40 | 20 | 200 | — | — | — | — |
| | 9 | 1150 | 850 | 40 | 700 | 40 | 20 | 200 | — | — | — | — |
| | 10 | 1150 | 850 | 40 | 700 | 40 | 20 | 200 | — | — | — | — |
| | 11 | 1150 | 850 | 40 | 700 | 40 | 20 | 200 | — | — | — | — |
| | 12 | 1150 | 850 | 40 | 700 | 40 | 20 | 200 | — | — | — | — |
| | 13 | 1150 | 850 | 40 | 700 | 40 | 20 | 200 | — | — | — | — |
| | 14 | 1150 | 850 | 40 | 700 | 40 | 20 | 200 | — | — | — | — |
| | 15 | 1150 | 850 | 40 | 700 | 40 | 20 | 200 | — | — | — | — |
| | 16 | 1150 | 850 | 40 | 700 | 40 | 20 | 200 | — | — | — | — |
| | 17 | 1150 | 850 | 40 | 700 | 40 | 20 | 200 | — | — | — | — |
| | 18 | 1150 | 850 | 40 | 700 | 40 | 20 | 200 | — | — | — | — |
| | 19 | 1150 | 850 | 40 | 700 | 40 | 20 | 200 | — | — | — | — |
| | 20 | 1150 | 850 | 40 | 700 | 40 | 20 | 200 | — | — | — | — |
| | 21 | 1150 | 850 | 40 | 700 | 40 | 20 | 200 | — | — | — | — |
| | 22 | 1150 | 850 | 40 | 700 | 40 | 20 | 200 | — | — | — | — |
| | 23 | 1150 | 850 | 40 | 700 | 40 | 20 | 200 | — | — | — | — |
| Hot rolling → Plating | 24 | 1150 | 850 | 40 | 700 | 40 | 20 | 200 | — | — | — | — |
| | 25 | 1150 | 750 | 40 | — | — | 40 | 200 | — | — | — | — |
| Hot rolling → Cold rolling → Continuous annealing | 26 | 1150 | 850 | 40 | 700 | 40 | 20 | 200 | 30 | — | — | — |
| | 27 | 1150 | 850 | 40 | 700 | 40 | 20 | 200 | 60 | — | — | — |
| | 28 | 1150 | 750 | 40 | — | — | 40 | 200 | 30 | — | — | — |
| Hot rolling → Cold rolling → Plating | 29 | 1150 | 850 | 5 | 700 | 40 | 10 | 200 | 40 | — | — | — |
| | 30 | 1150 | 750 | 5 | — | — | 5 | 200 | 40 | — | — | — |

| | Continuous annealing or plating | | | | | | | | |
|---|---|---|---|---|---|---|---|---|---|
| | T3 ° C. | t3 sec | Tq ° C. | CR ° C./s | T4 ° C. | t4 sec | Zn→GA ° C. | Desired structure | Details of structure |
| Hot rolling → Continuous annealing | 800 | 60 | 700 | 25 | 400 | 10 | — | ○ | |
| | 800 | 60 | 700 | 25 | 400 | 10 | — | X | F + B |
| | 800 | 60 | — | 25 | 400 | 10 | — | ○ | $C_{\gamma R}$: 1.3% |
| | 800 | 60 | 700 | 25 | 400 | 10 | — | ○ | $C_{\gamma R}$: 1.7% |
| | 800 | 60 | 700 | 25 | 400 | 10 | — | X | Conventional TRIP |
| | 800 | 60 | 700 | 25 | 400 | 10 | — | X | Conventional TRIP |
| | 800 | 60 | 700 | 25 | 400 | 10 | — | ○ | Rolling in two phase region |
| | 900 | 60 | 700 | 25 | 400 | 10 | — | X | Conventional TRIP |
| | 850 | 60 | 700 | 25 | 400 | 10 | — | ○ | |
| | 750 | 60 | 700 | 25 | 400 | 10 | — | ○ | |
| | 700 | 60 | 700 | 25 | 400 | 10 | — | ○ | |
| | 650 | 60 | 700 | 25 | 400 | 10 | — | X | γ-less |
| | 800 | 180 | 700 | 25 | 400 | 10 | — | ○ | |
| | 800 | 30 | 700 | 25 | 400 | 10 | — | ○ | |
| | 800 | 5 | 700 | 25 | 400 | 10 | — | X | Insufficient tempering |
| | 800 | 60 | 700 | 20 | 400 | 10 | — | ○ | |
| | 800 | 30 | 700 | 3 | 400 | 10 | — | X | P |
| | 800 | 60 | 700 | 25 | 450 | 10 | — | ○ | |
| | 800 | 60 | 700 | 25 | 350 | 10 | — | ○ | |
| | 800 | 60 | 700 | 25 | 200 | 10 | — | X | Austempering not performed |
| | 800 | 60 | 700 | 25 | RT | — | — | X | Austempering not performed |

TABLE 18-continued

| | | | | | | | | | |
|---|---|---|---|---|---|---|---|---|---|
| | 800 | 60 | 700 | 25 | 400 | 100 | — | ○ | |
| | 800 | 60 | 700 | 25 | 400 | 1 | — | ○ | |
| Hot rolling → Plating | 800 | 60 | 700 | 25 | 400 | 10 | 600 | ○ | |
| | 800 | 60 | 700 | 25 | 400 | 10 | 600 | ○ | Rolling in two phase region |
| Hot rolling → Cold | 800 | 60 | 700 | 25 | 400 | 10 | — | ○ | |
| rolling → Continuous | 800 | 60 | 700 | 25 | 400 | 10 | — | X | Tempered M not obtained |
| annealing | 800 | 60 | 700 | 25 | 400 | 10 | — | ○ | |
| Hot rolling → Cold | 800 | 60 | 700 | 25 | 400 | 10 | 600 | ○ | |
| rolling → Plating | 800 | 60 | 700 | 25 | 400 | 10 | 600 | ○ | |

Note:
F: ferrite,
P: pearlite,
B: bainite

TABLE 19

| | | Hot rolling | | | | | | | Cold rolling | Continuous annealing | | |
|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | Cold rolling rate % | T1 ° C. | CR ° C./s | T2 ° C. |
| Hot rolling → | 31 | 1150 | 850 | 40 | — | — | 40 | 550 | 60 | 900 | 20 | RT |
| rolling → First | 32 | 1150 | 850 | 40 | — | — | 40 | 550 | 60 | 850 | 20 | RT |
| continuous annealing | 33 | 1150 | 850 | 40 | — | — | 40 | 550 | 60 | 800 | 20 | RT |
| → Second continuous | 34 | 1150 | 850 | 40 | — | — | 40 | 550 | 60 | 750 | 20 | RT |
| annealing | 35 | 1150 | 850 | 40 | — | — | 40 | 550 | 60 | 700 | 20 | RT |
| | 36 | 1150 | 850 | 40 | — | — | 40 | 550 | 60 | 800 | 50 | RT |
| | 37 | 1150 | 850 | 40 | — | — | 40 | 550 | 60 | 800 | 10 | RT |
| | 38 | 1150 | 850 | 40 | — | — | 40 | 550 | 60 | 800 | 5 | RT |
| | 39 | 1150 | 850 | 40 | — | — | 40 | 550 | 60 | 800 | 20 | 200 |
| | 40 | 1150 | 850 | 40 | — | — | 40 | 550 | 60 | 800 | 20 | RT |
| | 41 | 1150 | 850 | 40 | — | — | 40 | 550 | 60 | 800 | 20 | RT |
| | 42 | 1150 | 850 | 40 | — | — | 40 | 550 | 60 | 800 | 20 | RT |
| | 43 | 1150 | 850 | 40 | — | — | 40 | 550 | 60 | 800 | 20 | RT |
| | 44 | 1150 | 850 | 40 | — | — | 40 | 550 | 60 | 800 | 20 | RT |
| | 45 | 1150 | 850 | 40 | — | — | 40 | 550 | 60 | 800 | 20 | RT |
| | 46 | 1150 | 850 | 40 | — | — | 40 | 550 | 60 | 800 | 20 | RT |
| | 47 | 1150 | 850 | 40 | — | — | 40 | 550 | 60 | 800 | 20 | RT |
| | 48 | 1150 | 850 | 40 | — | — | 40 | 550 | 60 | 800 | 20 | RT |
| | 49 | 1150 | 850 | 40 | — | — | 40 | 550 | 60 | 800 | 20 | RT |
| | 50 | 1150 | 850 | 40 | — | — | 40 | 550 | 60 | 800 | 20 | RT |
| | 51 | 1150 | 850 | 40 | — | — | 40 | 550 | 60 | 800 | 20 | RT |
| | 52 | 1150 | 850 | 40 | — | — | 40 | 550 | 60 | 800 | 20 | RT |
| | 53 | 1150 | 850 | 40 | — | — | 40 | 550 | 60 | 800 | 20 | RT |
| | 54 | 1150 | 850 | 40 | — | — | 40 | 550 | 60 | 800 | 20 | RT |
| | 55 | 1150 | 850 | 40 | — | — | 40 | 550 | 60 | 800 | 20 | RT |
| | 56 | 1150 | 850 | 40 | — | — | 40 | 550 | 60 | 800 | 20 | RT |
| Hot rolling → Cold rolling → First continuous annealing → Plating | 57 | 1150 | 850 | 40 | — | — | 40 | 550 | 50 | 800 | 20 | RT |

| | Continuous annealing or plating | | | | | | | | |
|---|---|---|---|---|---|---|---|---|---|
| | T3 ° C. | t3 sec | Tq ° C. | CR ° C./s | T4 ° C. | t4 sec | Zn→GA ° C. | Desired structure | Details of structure |
| Hot rolling → Cold | 800 | 60 | 700 | 25 | 400 | 10 | — | ○ | |
| rolling → First | 800 | 60 | 700 | 25 | 400 | 10 | — | ○ | |
| continuous | 800 | 60 | 700 | 25 | 400 | 10 | — | ○ | |
| annealing → | 800 | 60 | 700 | 25 | 400 | 10 | — | ○ | |
| Second continuous | 800 | 60 | 700 | 25 | 400 | 10 | — | X | γ-less |
| annealing | 800 | 60 | 700 | 25 | 400 | 10 | — | ○ | |
| | 800 | 60 | 700 | 25 | 400 | 10 | — | ○ | |
| | 800 | 60 | 700 | 25 | 400 | 10 | — | X | F, P |
| | 800 | 60 | 700 | 25 | 400 | 10 | — | ○ | |
| | 900 | 60 | 700 | 25 | 400 | 10 | — | X | Conventional TRIP |
| | 850 | 60 | 700 | 25 | 400 | 10 | — | ○ | |
| | 750 | 60 | 700 | 25 | 400 | 10 | — | ○ | |
| | 700 | 60 | 700 | 25 | 400 | 10 | — | ○ | |
| | 650 | 60 | 700 | 25 | 400 | 10 | — | X | γ-less |
| | 800 | 1000 | 700 | 25 | 400 | 10 | — | X | Tempered M not obtained |
| | 800 | 180 | 700 | 25 | 400 | 10 | — | ○ | |
| | 800 | 30 | 700 | 25 | 400 | 10 | — | ○ | |
| | 800 | 5 | 700 | 25 | 400 | 10 | — | X | Insufficient tempering |

TABLE 19-continued

| | | | | | | | | | |
|---|---|---|---|---|---|---|---|---|---|
| | 800 | 60 | 700 | 20 | 400 | 10 | — | ○ | |
| | 800 | 30 | 700 | 3 | 400 | 10 | — | X | P |
| | 800 | 60 | 700 | 25 | 450 | 10 | — | ○ | |
| | 800 | 60 | 700 | 25 | 350 | 10 | — | ○ | |
| | 800 | 60 | 700 | 25 | 200 | 10 | — | X | Austempering not performed |
| | 800 | 60 | 700 | 25 | RT | — | — | X | Austempering not performed |
| | 800 | 60 | 700 | 25 | 400 | 100 | — | ○ | |
| | 800 | 60 | 700 | 25 | 400 | 1 | — | ○ | |
| Hot rolling → Cold rolling → First continuous annealing → Plating | 800 | 60 | 700 | 25 | 400 | 10 | 600 | ○ | |

Notes:
F: ferrite,
P: pearlite,
M: martensite

TABLE 20

| No. | Steel No. | TB (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 1 | 1 | 47 | 5 | 9 | 48 | 0 | — | 760 | 18 | 60 | 71 |
| 2 | 2 | 42 | 5 | 9 | 44 | 0 | 0.5 | 770 | 15 | 49 | 71 |
| 3 | 2 | 37 | 8 | 8 | 47 | 0 | 1.2 | 790 | 38 | 57 | 65 |
| 4 | 3 | 29 | 6 | 10 | 55 | 0 | 1.1 | 800 | 36 | 57 | 67 |
| 5 | 4 | 32 | 7 | 13 | 48 | 0 | 1.3 | 805 | 38 | 54 | 63 |
| 6 | 5 | 35 | 6 | 12 | 47 | 0 | 1.3 | 780 | 40 | 56 | 66 |
| 7 | 6 | 40 | 5 | 1 | 54 | 0 | 0.4 | 790 | 25 | 61 | 71 |
| 8 | 7 | 31 | 3 | 8 | 58 | 0 | 1.2 | 790 | 37 | 55 | 66 |
| 9 | 8 | 41 | 2 | 9 | 48 | 0 | 1.4 | 795 | 36 | 52 | 68 |
| 10 | 9 | 50 | 3 | 7 | 40 | 0 | 1.4 | 800 | 36 | 54 | 65 |
| 11 | 10 | 38 | 4 | 9 | 49 | 0 | 1.3 | 810 | 38 | 53 | 66 |
| 12 | 11 | 37 | 5 | 8 | 50 | 0 | 1.4 | 805 | 37 | 55 | 68 |
| 13 | 12 | 28 | 3 | 9 | 60 | 0 | 1.3 | 790 | 39 | 49 | 65 |
| 14 | 13 | 39 | 2 | 8 | 51 | 0 | 1.2 | 795 | 38 | 51 | 67 |
| 15 | 14 | 40 | 6 | 9 | 45 | 0 | 1.2 | 800 | 39 | 53 | 68 |
| 16 | 2 | 64 | 8 | 8 | 20 | 0 | 1.3 | 800 | 40 | 61 | 65 |
| 17 | 3 | 64 | 6 | 10 | 20 | 0 | 1.4 | 810 | 39 | 60 | 67 |
| 18 | 4 | 59 | 7 | 13 | 21 | 0 | 1.5 | 820 | 41 | 62 | 63 |
| 19 | 3 | 41 | 4 | 10 | 28 | 17(P) | — | 770 | 29 | 43 | 68 |
| 20 | 4 | 32 | 0 | 13 | 50 | 5(M) | 1.3 | 790 | 38 | 55 | 60 |

Notes:
P: pearlite
M: martensite,
TB: tempered bainite,
B: bainite,
γR: retained austenite

TABLE 21

| No. | Steel No. | TM (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 1 | 1 | 53 | 4 | 0 | 43 | 0 | — | 680 | 27 | 54 | 65 |
| 2 | 2 | 43 | 5 | 8 | 44 | 0 | 0.5 | 690 | 23 | 45 | 65 |
| 3 | 3 | 43 | 5 | 13 | 39 | 0 | 1.5 | 805 | 56 | 57 | 67 |
| 4 | 4 | 41 | 6 | 12 | 41 | 0 | 1.4 | 880 | 57 | 54 | 66 |
| 5 | 5 | 40 | 5 | 12 | 44 | 0 | 1.5 | 880 | 56 | 53 | 65 |
| 6 | 6 | 42 | 4 | 13 | 41 | 0 | 1.5 | 800 | 58 | 55 | 65 |
| 7 | 7 | 37 | 4 | 1 | 58 | 0 | 1.5 | 830 | 25 | 60 | 90 |
| 8 | 8 | 45 | 4 | 11 | 40 | 0 | 1.5 | 790 | 58 | 56 | 66 |
| 9 | 9 | 45 | 5 | 12 | 38 | 0 | 1.6 | 800 | 55 | 57 | 65 |
| 10 | 10 | 45 | 3 | 13 | 39 | 0 | 1.5 | 810 | 56 | 55 | 64 |
| 11 | 11 | 44 | 4 | 12 | 40 | 0 | 1.6 | 790 | 54 | 54 | 65 |
| 12 | 12 | 40 | 5 | 14 | 41 | 0 | 1.5 | 805 | 56 | 56 | 67 |
| 13 | 13 | 41 | 4 | 13 | 42 | 0 | 1.4 | 800 | 55 | 56 | 65 |
| 14 | 14 | 38 | 7 | 12 | 43 | 0 | 1.4 | 806 | 54 | 55 | 64 |
| 15 | 15 | 39 | 5 | 14 | 44 | 0 | 1.4 | 803 | 54 | 60 | 65 |
| 16 | 3 | 63 | 7 | 10 | 20 | 0 | 1.5 | 780 | 55 | 60 | 65 |
| 17 | 4 | 60 | 5 | 13 | 22 | 0 | 1.5 | 810 | 56 | 63 | 66 |
| 18 | 6 | 59 | 6 | 12 | 23 | 0 | 1.4 | 870 | 57 | 60 | 65 |

TABLE 21-continued

| No. | Steel No. | TM (%) | B (%) | γR (%) | F (%) | Others (%) | $C_{\gamma R}$ (%) | TS (Mpa) | EI (%) | λ (%) | YR (%) |
|---|---|---|---|---|---|---|---|---|---|---|---|
| 19 | 4 | 23 | 6 | 10 | 40 | 21(P) | 1.5 | 780 | 25 | 43 | 73 |
| 20 | 4 | 40 | 0 | 13 | 40 | 7(M) | 1.5 | 880 | 56 | 52 | 50 |

Notes:
P: pearlite,
M: martensite,
B: bainite,
F: ferrite,
TB: tempered bainite,
$\gamma_R$: retained austenite

TABLE 22

| No. | Steel No. | M (%) | B (%) | γR (%) | F (%) | $C_{\gamma r}$ (%) | TS (Mpa) | EI (%) | λ (%) | YR (%) |
|---|---|---|---|---|---|---|---|---|---|---|
| 21 | 3 | 0 | 4 | 12 | 84 | 1.4 | 788 | 37 | 41 | 67 |
| 22 | 2 | 0 | 83 | 0 | 17 | — | 830 | 15 | 59 | 93 |

Notes:
M: martensite,
B: bainite,
F: ferrite,
$\gamma_R$: retained austenite

TABLE 23

| | | Hot rolling | | | | | | | Cold rolling | Continuous annealing | | |
|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | Cold rolling rate % | T1 ° C. | CR ° C./s | T2 ° C. |
| Hot rolling → Continuous annealing | 1 | 1150 | 850 | 40 | 700 | 40 | 20 | 450 | — | — | — | — |
| | 2 | 1150 | 850 | 40 | 700 | 40 | 20 | 450 | — | — | — | — |
| | 3 | 1150 | 850 | 40 | 700 | 40 | 20 | 450 | — | — | — | — |
| | 4 | 1150 | 850 | 40 | 700 | 40 | 20 | RT | — | — | — | — |
| | 5 | 1150 | 850 | 40 | — | — | 40 | 550 | — | — | — | — |
| | 6 | 1150 | 850 | 5 | — | — | 5 | 450 | — | — | — | — |
| | 7 | 1150 | 750 | 40 | — | — | 40 | 450 | — | — | — | — |
| | 8 | 1150 | 850 | 40 | 700 | 40 | 20 | 450 | — | — | — | — |
| | 9 | 1150 | 850 | 40 | 700 | 40 | 20 | 450 | — | — | — | — |
| | 10 | 1150 | 850 | 40 | 700 | 40 | 20 | 450 | — | — | — | — |
| | 11 | 1150 | 850 | 40 | 700 | 40 | 20 | 450 | — | — | — | — |
| | 12 | 1150 | 850 | 40 | 700 | 40 | 20 | 450 | — | — | — | — |
| | 13 | 1150 | 850 | 40 | 700 | 40 | 20 | 450 | — | — | — | — |
| | 14 | 1150 | 850 | 40 | 700 | 40 | 20 | 450 | — | — | — | — |
| | 15 | 1150 | 850 | 40 | 700 | 40 | 20 | 450 | — | — | — | — |
| | 16 | 1150 | 850 | 40 | 700 | 40 | 20 | 450 | — | — | — | — |
| | 17 | 1150 | 850 | 40 | 700 | 40 | 20 | 450 | — | — | — | — |
| | 18 | 1150 | 850 | 40 | 700 | 40 | 20 | 450 | — | — | — | — |
| | 19 | 1150 | 850 | 40 | 700 | 40 | 20 | 450 | — | — | — | — |
| | 20 | 1150 | 850 | 40 | 700 | 40 | 20 | 450 | — | — | — | — |
| | 21 | 1150 | 850 | 40 | 700 | 40 | 20 | 450 | — | — | — | — |
| | 22 | 1150 | 850 | 40 | 700 | 40 | 20 | 450 | — | — | — | — |
| | 23 | 1150 | 850 | 40 | 700 | 40 | 20 | 450 | — | — | — | — |
| Hot rolling → Plating | 24 | 1150 | 850 | 40 | 700 | 40 | 20 | 450 | — | — | — | — |
| | 25 | 1150 | 750 | 40 | — | — | 40 | 450 | — | — | — | — |
| Hot rolling → Cold rolling → Continuous annealing | 26 | 1150 | 850 | 40 | 700 | 40 | 20 | 450 | 30 | — | — | — |
| | 27 | 1150 | 850 | 40 | 700 | 40 | 20 | 450 | 60 | — | — | — |
| | 28 | 1150 | 750 | 40 | — | — | 40 | 450 | 30 | — | — | — |
| Hot rolling → Cold rolling → Plating | 29 | 1150 | 850 | 5 | 700 | 40 | 10 | 450 | 40 | — | — | — |
| | 30 | 1150 | 750 | 5 | — | — | 5 | 450 | 40 | — | — | — |

| | Continuous annealing or plating | | | | | | | | |
|---|---|---|---|---|---|---|---|---|---|
| | T3 ° C. | t3 sec | Tq ° C. | CR ° C./s | T4 ° C. | t4 sec | Zn→GA ° C. | Desired structure | Details of structure |
| Hot rolling → Continuous annealing | 800 | 60 | 700 | 25 | 400 | 10 | — | ○ | |
| | 800 | 60 | 700 | 25 | 400 | 10 | — | ○ | $C_{\gamma R}$: 1.5% |
| | 800 | 60 | — | 25 | 400 | 10 | — | ○ | $C_{\gamma R}$: 1.0% |
| | 800 | 60 | 700 | 25 | 400 | 10 | — | X | F + tempered M |
| | 800 | 60 | 700 | 25 | 400 | 10 | — | X | Conventional TRIP |

TABLE 23-continued

| | | | | | | | | | |
|---|---|---|---|---|---|---|---|---|---|
| | 800 | 60 | 700 | 25 | 400 | 10 | — | X | Conventional TRIP |
| | 800 | 60 | 700 | 25 | 400 | 10 | — | ○ | Rolling in two phase region |
| | 900 | 60 | 700 | 25 | 400 | 10 | — | X | Conventional |
| | 850 | 60 | 700 | 25 | 400 | 10 | — | ○ | |
| | 750 | 60 | 700 | 25 | 400 | 10 | — | ○ | |
| | 700 | 60 | 700 | 25 | 400 | 10 | — | ○ | |
| | 650 | 60 | 700 | 25 | 400 | 10 | — | X | γ-less |
| | 800 | 180 | 700 | 25 | 400 | 10 | — | ○ | |
| | 800 | 30 | 700 | 25 | 400 | 10 | — | ○ | |
| | 800 | 5 | 700 | 25 | 400 | 10 | — | X | Insufficient tempering |
| | 800 | 60 | 700 | 20 | 400 | 10 | — | ○ | |
| | 800 | 30 | 700 | 3 | 400 | 10 | — | X | P |
| | 800 | 60 | 700 | 25 | 450 | 10 | — | ○ | |
| | 800 | 60 | 700 | 25 | 350 | 10 | — | ○ | |
| | 800 | 60 | 700 | 25 | 200 | 10 | — | X | Austempering not performed |
| | 800 | 60 | 700 | 25 | RT | — | — | X | Austempering not performed |
| | 800 | 60 | 700 | 25 | 400 | 100 | — | ○ | |
| | 800 | 60 | 700 | 25 | 400 | 1 | — | ○ | |
| Hot rolling → Plating | 800 | 60 | 700 | 25 | 400 | 10 | 600 | ○ | |
| | 800 | 60 | 700 | 25 | 400 | 10 | 600 | ○ | Rolling in two phase region |
| Hot rolling → Cold | 800 | 60 | 700 | 25 | 400 | 10 | — | ○ | |
| rolling → Continuous | 800 | 60 | 700 | 25 | 400 | 10 | — | X | Tempered B not obtained |
| annealing | 800 | 60 | 700 | 25 | 400 | 10 | — | ○ | |
| Hot rolling → Cold | 800 | 60 | 700 | 25 | 400 | 10 | 600 | ○ | |
| rolling → Plating | 800 | 60 | 700 | 25 | 400 | 10 | 600 | ○ | |

Note:
F: ferrite,
M: martensite,
P: pearlite

TABLE 24

| | | Hot rolling | | | | | | | Cold rolling | Continuous annealing | | |
|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | Cold rolling rate % | T1 ° C. | CR ° C./s | T2 ° C. |
| Hot rolling → | 31 | 1150 | 850 | 40 | — | — | 40 | 550 | 60 | 900 | 20 | 450 |
| Cold rolling → First | 32 | 1150 | 850 | 40 | — | — | 40 | 550 | 60 | 850 | 20 | 450 |
| continous annealing → | 33 | 1150 | 850 | 40 | — | — | 40 | 550 | 60 | 800 | 20 | 450 |
| Second continuous | 34 | 1150 | 850 | 40 | — | — | 40 | 550 | 60 | 750 | 20 | 450 |
| annealing | 35 | 1150 | 850 | 40 | — | — | 40 | 550 | 60 | 700 | 20 | 450 |
| | 36 | 1150 | 850 | 40 | — | — | 40 | 550 | 60 | 800 | 50 | 450 |
| | 37 | 1150 | 850 | 40 | — | — | 40 | 550 | 60 | 800 | 10 | 450 |
| | 38 | 1150 | 850 | 40 | — | — | 40 | 550 | 60 | 800 | 5 | 450 |
| | 39 | 1150 | 850 | 40 | — | — | 40 | 550 | 60 | 800 | 20 | 400 |
| | 40 | 1150 | 850 | 40 | — | — | 40 | 550 | 60 | 800 | 20 | 450 |
| | 41 | 1150 | 850 | 40 | — | — | 40 | 550 | 60 | 800 | 20 | 450 |
| | 42 | 1150 | 850 | 40 | — | — | 40 | 550 | 60 | 800 | 20 | 450 |
| | 43 | 1150 | 850 | 40 | — | — | 40 | 550 | 60 | 800 | 20 | 450 |
| | 44 | 1150 | 850 | 40 | — | — | 40 | 550 | 60 | 800 | 20 | 450 |
| | 45 | 1150 | 850 | 40 | — | — | 40 | 550 | 60 | 800 | 20 | 450 |
| | 46 | 1150 | 850 | 40 | — | — | 40 | 550 | 60 | 800 | 20 | 450 |
| | 47 | 1150 | 850 | 40 | — | — | 40 | 550 | 60 | 800 | 20 | 450 |
| | 48 | 1150 | 850 | 40 | — | — | 40 | 550 | 60 | 800 | 20 | 450 |
| | 49 | 1150 | 850 | 40 | — | — | 40 | 550 | 60 | 800 | 20 | 450 |
| | 50 | 1150 | 850 | 40 | — | — | 40 | 550 | 60 | 800 | 20 | 450 |
| | 51 | 1150 | 850 | 40 | — | — | 40 | 550 | 60 | 800 | 20 | 450 |
| | 52 | 1150 | 850 | 40 | — | — | 40 | 550 | 60 | 800 | 20 | 450 |
| | 53 | 1150 | 850 | 40 | — | — | 40 | 550 | 60 | 800 | 20 | 450 |
| | 54 | 1150 | 850 | 40 | — | — | 40 | 550 | 60 | 800 | 20 | 450 |
| | 55 | 1150 | 850 | 40 | — | — | 40 | 550 | 60 | 800 | 20 | 450 |
| | 56 | 1150 | 850 | 40 | — | — | 40 | 550 | 60 | 800 | 20 | 450 |
| Hot rolling → Cold rolling → First continuous annealing → Plating | 57 | 1150 | 850 | 40 | — | — | 40 | 550 | 50 | 800 | 20 | 450 |

| | Continuous annealing or plating | | | | | | | | |
|---|---|---|---|---|---|---|---|---|---|
| | T3 ° C. | t3 sec | Tq ° C. | CR ° C./s | T4 ° C. | t4 sec | Zn→GA ° C. | Desired structure | Details of structure |
| Hot rolling → | 800 | 60 | 700 | 25 | 400 | 10 | — | X | F + tempered M |
| rolling → First | 800 | 60 | 700 | 25 | 400 | 10 | — | ○ | |

TABLE 24-continued

| | | | | | | | | | |
|---|---|---|---|---|---|---|---|---|---|
| continous annealing → | 800 | 60 | 700 | 25 | 400 | 10 | — | ○ | |
| Second continuous | 800 | 60 | 700 | 25 | 400 | 10 | — | ○ | |
| annealing | 800 | 60 | 700 | 25 | 400 | 10 | — | X | γ-less |
| | 800 | 60 | 700 | 25 | 400 | 10 | — | ○ | |
| | 800 | 60 | 700 | 25 | 400 | 10 | — | ○ | |
| | 800 | 60 | 700 | 25 | 400 | 10 | — | X | F, P |
| | 800 | 60 | 700 | 25 | 400 | 10 | — | ○ | |
| | 900 | 60 | 700 | 25 | 400 | 10 | — | X | Conventional TRIP |
| | 850 | 60 | 700 | 25 | 400 | 10 | — | ○ | |
| | 750 | 60 | 700 | 25 | 400 | 10 | — | ○ | |
| | 700 | 60 | 700 | 25 | 400 | 10 | — | ○ | |
| | 650 | 60 | 700 | 25 | 400 | 10 | — | X | γ-less |
| | 800 | 100 | 700 | 25 | 400 | 10 | — | X | Tempered B not obtained |
| | 800 | 180 | 700 | 25 | 400 | 10 | — | ○ | |
| | 800 | 30 | 700 | 25 | 400 | 10 | — | ○ | |
| | 800 | 5 | 700 | 25 | 450 | 10 | — | X | Insufficient tempering |
| | 800 | 60 | 700 | 20 | 400 | 10 | — | ○ | |
| | 800 | 30 | 700 | 3 | 400 | 10 | — | X | P |
| | 800 | 60 | 700 | 25 | 450 | 10 | — | ○ | |
| | 800 | 60 | 700 | 25 | 350 | 10 | — | ○ | |
| | 800 | 60 | 700 | 25 | 200 | 10 | — | X | Austempering not performed |
| | 800 | 60 | 700 | 25 | RT | — | — | X | Austempering not performed |
| | 800 | 60 | 700 | 25 | 400 | 100 | — | ○ | |
| | 800 | 60 | 700 | 25 | 400 | 1 | — | ○ | |
| Hot rolling → Cold rolling → First continuous annealing → Plating | 800 | 60 | 700 | 25 | 400 | 10 | 600 | ○ | |

Notes:
F: ferrite,
P: pearlite,
B: bainite,
M: martensite

TABLE 25

| No. | C | Si | Mn | P | S | Al | Others |
|---|---|---|---|---|---|---|---|
| 1 | 0.03 | 1.5 | 1.5 | 0.08 | 0.005 | 0.035 | |
| 2 | 0.09 | 1.5 | 1.5 | 0.09 | 0.005 | 0.035 | |
| 3 | 0.15 | 1.5 | 1.5 | 0.07 | 0.006 | 0.035 | |
| 4 | 0.20 | 1.5 | 1.5 | 0.06 | 0.004 | 0.035 | |
| 5 | 0.15 | 0.3 | 0.3 | 0.07 | 0.004 | 0.035 | |
| 6 | 0.15 | 1.5 | 1.5 | 0.08 | 0.005 | 0.035 | Mo: 0.2 |

TABLE 25-continued

| No. | C | Si | Mn | P | S | Al | Others |
|---|---|---|---|---|---|---|---|
| 7 | 0.15 | 1.5 | 1.5 | 0.07 | 0.006 | 0.035 | Ni: 0.2 |
| 8 | 0.15 | 1.5 | 1.5 | 0.06 | 0.006 | 0.035 | Cu: 0.2 |
| 9 | 0.15 | 1.5 | 1.5 | 0.07 | 0.005 | 0.035 | Cr: 0.2 |
| 10 | 0.15 | 1.5 | 1.5 | 0.07 | 0.006 | 0.035 | Ti: 0.03 |
| 11 | 0.15 | 1.5 | 1.5 | 0.06 | 0.005 | 0.035 | Nb: 0.03 |
| 12 | 0.15 | 1.5 | 1.5 | 0.07 | 0.006 | 0.035 | V: 0.03 |
| 13 | 0.15 | 1.5 | 1.5 | 0.06 | 0.005 | 0.035 | Ca: 10 ppm |

TABLE 26

| | | Hot rolling | | | | Cold rolling | Continuous annealing | | | Tempering | | Continuous annealing or plating | | | | | | Zn→ |
|---|---|---|---|---|---|---|---|---|---|---|---|---|---|---|---|---|---|---|
| No. | Steel No. | SRT ° C. | FDT ° C. | CR ° C./s | CT ° C. | Cold rolling rate % | T1 ° C. | CR ° C./s | T2 ° C. | Temp. ° C. | Time sec | T3 ° C. | t3 sec | Tq ° C. | CR ° C./s | T4 ° C. | t4 sec | GA ° C. |
| 1 | 1 | 1150 | 850 | 40 | 550 | 50 | 850 | 20 | RT | — | — | 800 | 60 | 700 | 10 | 400 | 100 | — |
| 2 | 2 | 1150 | 850 | 40 | 550 | 50 | 850 | 20 | RT | — | — | 800 | 60 | 700 | 10 | 400 | 100 | — |
| 3 | 2 | 1150 | 850 | 40 | 550 | 50 | 850 | 20 | RT | 450 | 1000 | 800 | 60 | 700 | 10 | 400 | 100 | — |
| 4 | 3 | 1150 | 850 | 40 | 550 | 50 | 850 | 20 | RT | 450 | 1000 | 800 | 60 | 700 | 10 | 400 | 100 | — |
| 5 | 4 | 1150 | 850 | 40 | 550 | 50 | 850 | 20 | RT | 450 | 1000 | 800 | 60 | 700 | 10 | 400 | 100 | — |
| 6 | 5 | 1150 | 850 | 40 | 550 | 50 | 850 | 20 | RT | 450 | 1000 | 800 | 60 | 700 | 10 | 400 | 100 | — |
| 7 | 6 | 1150 | 850 | 40 | 550 | 50 | 850 | 20 | RT | 450 | 1000 | 800 | 60 | 700 | 10 | 400 | 100 | — |
| 8 | 7 | 1150 | 850 | 40 | 550 | 50 | 850 | 20 | RT | 450 | 1000 | 800 | 60 | 700 | 10 | 400 | 100 | — |
| 9 | 8 | 1150 | 850 | 40 | 550 | 50 | 850 | 20 | RT | 450 | 1000 | 800 | 60 | 700 | 10 | 400 | 100 | — |
| 10 | 9 | 1150 | 850 | 40 | 550 | 50 | 850 | 20 | RT | 450 | 1000 | 800 | 60 | 700 | 10 | 400 | 100 | — |
| 11 | 10 | 1150 | 850 | 40 | 550 | 50 | 850 | 20 | RT | 450 | 1000 | 800 | 60 | 700 | 10 | 400 | 100 | — |
| 12 | 11 | 1150 | 850 | 40 | 550 | 50 | 850 | 20 | RT | 450 | 1000 | 800 | 60 | 700 | 10 | 400 | 100 | — |
| 13 | 12 | 1150 | 850 | 40 | 550 | 50 | 850 | 20 | RT | 450 | 1000 | 800 | 60 | 700 | 10 | 400 | 100 | — |

TABLE 26-continued

| | | Hot rolling | | | | Cold rolling | Continuous annealing | | | Tempering | | Continuous annealing or plating | | | | | | Zn→ |
|---|---|---|---|---|---|---|---|---|---|---|---|---|---|---|---|---|---|---|
| No. | Steel No. | SRT ° C. | FDT ° C. | CR ° C./s | CT ° C. | Cold rolling rate % | T1 ° C. | CR ° C./s | T2 ° C. | Temp. ° C. | Time sec | T3 ° C. | t3 sec | Tq ° C. | CR ° C./s | T4 ° C. | t4 sec | GA ° C. |
| 14 | 13 | 1150 | 850 | 40 | 550 | 50 | 850 | 20 | RT | 450 | 1000 | 800 | 60 | 700 | 10 | 400 | 100 | — |
| 15 | 3 | 1150 | 850 | 40 | 550 | 50 | 850 | 20 | RT | 450 | 1000 | 800 | 60 | 700 | 1 | 400 | 100 | — |

Note:
RT: room temperature

TABLE 27

| No. | Steel No. | F (%) | TM (%) | B (%) | γR (%) | Others (%) | $C_{\gamma R}$ (%) | (S1/S) × 100 | TS (Mpa) | EI (%) | λ (%) | σw/YP (%) |
|---|---|---|---|---|---|---|---|---|---|---|---|---|
| 1 | 1 | 48 | 47 | 5 | 0 | 0 | — | — | 460 | 33 | 96 | 0.80 |
| 2 | 2 | 44 | 42 | 5 | 9 | 0 | 1.4 | 17.5 | 610 | 26 | 54 | 0.67 |
| 3 | 2 | 47 | 37 | 8 | 8 | 0 | 1.4 | 8.4 | 590 | 38 | 72 | 0.83 |
| 4 | 3 | 55 | 29 | 6 | 10 | 0 | 1.3 | 10.2 | 750 | 40 | 59 | 0.87 |
| 5 | 4 | 47 | 35 | 6 | 12 | 0 | 1.3 | 11.0 | 805 | 33 | 71 | 0.77 |
| 6 | 5 | 54 | 40 | 5 | 1 | 0 | 0.5 | — | 680 | 25 | 62 | 0.89 |
| 7 | 6 | 50 | 39 | 3 | 8 | 0 | 1.3 | 13.1 | 960 | 25 | 67 | 0.72 |
| 8 | 7 | 46 | 41 | 2 | 11 | 0 | 1.3 | 7.2 | 795 | 32 | 68 | 0.80 |
| 9 | 8 | 38 | 50 | 3 | 9 | 0 | 1.4 | 3.8 | 800 | 32 | 71 | 0.79 |
| 10 | 9 | 39 | 44 | 5 | 12 | 0 | 1.3 | 6.6 | 810 | 33 | 66 | 0.80 |
| 11 | 10 | 44 | 37 | 5 | 14 | 0 | 1.4 | 13.1 | 805 | 30 | 73 | 0.80 |
| 12 | 11 | 53 | 31 | 3 | 13 | 0 | 1.4 | 699 | 790 | 33 | 64 | 0.83 |
| 13 | 12 | 44 | 40 | 4 | 12 | 0 | 1.3 | 10.8 | 795 | 34 | 67 | 0.81 |
| 14 | 13 | 39 | 47 | 3 | 11 | 0 | 1.3 | 3.6 | 800 | 32 | 73 | 0.82 |
| 15 | 3 | 30 | 39 | 6 | 8 | 17(P) | 1.3 | 17.8 | 730 | 28 | 43 | 0.67 |

Notes:
TM: tempered martensite,
F: ferrite,
B: bainite,
γR: retained austenite,
P: pearlite

TABLE 28

| No. | Steel No. | M (%) | B (%) | γR (%) | F (%) | $C_{\gamma R}$ (%) | (S1/S) × 100 | TS (Mpa) | EI (%) | λ (%) | YR (%) | σw/YP (%) |
|---|---|---|---|---|---|---|---|---|---|---|---|---|
| 20 | 2 | 23 | 3 | 0 | 74 | — | 18.6 | 850 | 22 | 43 | 52 | 0.61 |
| 21 | 3 | 0 | 4 | 12 | 84 | 1.4 | 22.3 | 788 | 37 | 41 | 67 | 0.65 |
| 22 | 2 | 0 | 83 | 0 | 17 | — | — | 830 | 15 | 59 | 93 | 0.88 |

Notes:
M: martensite,
B: bainite,
F: ferrite,
γR: retained austenite,

TABLE 29

| | | Hot rolling | | | | | | | Tempered | | Continuous annealing or plating | | | | | |
|---|---|---|---|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | Temp. ° C. | Time sec | T3 ° C. | t3 sec | Tq ° C. | CR ° C./s | T4 ° C. | t4 sec |
| Hot | 1 | 1150 | 850 | 40 | — | — | 40 | 200 | — | — | 800 | 60 | 700 | 10 | 400 | 100 |
| rolling → | 2 | 1150 | 850 | 40 | — | — | 40 | 200 | 450 | 1000 | 800 | 60 | 700 | 10 | 400 | 100 |
| Continuous | 3 | 1150 | 850 | 40 | 700 | 40 | 20 | 200 | — | — | 800 | 60 | 700 | 10 | 400 | 100 |
| annealing | 4 | 1150 | 850 | 40 | 700 | 40 | 20 | 200 | 450 | 1000 | 800 | 60 | 700 | 10 | 400 | 100 |
| | 5 | 1150 | 850 | 40 | — | — | 40 | 450 | — | — | 800 | 60 | 700 | 10 | 400 | 100 |
| | 6 | 1150 | 850 | 40 | 700 | 40 | 20 | 450 | — | — | 800 | 60 | 700 | 10 | 400 | 100 |

TABLE 30

| No. | Base phase structure | Second phase structure (S1/S) × 100 | TS (MPa) | E1 (%) | λ (%) | FL/YP |
|---|---|---|---|---|---|---|
| 1 | TM | 33.1 | 750 | 40 | 44 | 0.72 |
| 2 | TM | 7.5 | 750 | 40 | 64 | 0.86 |
| 3 | F + TM | 27.8 | 750 | 40 | 45 | 0.73 |
| 4 | F + TM | 11.3 | 750 | 40 | 63 | 0.89 |
| 5 | TB | 1.8 | 750 | 40 | 69 | 0.87 |
| 6 | F + TB | 6.2 | 750 | 40 | 64 | 0.83 |

Note:
TM: tempered martensite,
TB: tempered bainite,
F: ferrite

TABLE 31

| | | | Hot rolling | | | | Cold rolling | Continuous annealing | | |
|---|---|---|---|---|---|---|---|---|---|---|
| | No. | Steel No. | SRT ° C. | FDT ° C. | CR ° C./s | CT ° C. | Cold rolling rate % | T1 ° C. | CR ° C./s | T2 ° C. |
| Hot rolling → | 1 | 1 | 1150 | 850 | 40 | 550 | 50 | 850 | 20 | RT |
| Cold rolling → | 2 | 1 | 1150 | 850 | 40 | 550 | 50 | 850 | 20 | RT |
| First continuous | 3 | 2 | 1150 | 850 | 40 | 550 | 50 | 850 | 20 | RT |
| annealing → | 4 | 2 | 1150 | 850 | 40 | 550 | 50 | 850 | 20 | RT |
| Second | 5 | 3 | 1150 | 850 | 40 | 550 | 50 | 850 | 20 | RT |
| continuous | 6 | 3 | 1150 | 850 | 40 | 550 | 50 | 850 | 20 | RT |
| annealing | 7 | 3 | 1150 | 850 | 40 | 550 | 50 | 850 | 20 | RT |
| | 8 | 3 | 1150 | 850 | 40 | 550 | 50 | 850 | 20 | RT |
| | 9 | 3 | 1150 | 850 | 40 | 550 | 50 | 850 | 20 | RT |
| | 10 | 3 | 1150 | 850 | 40 | 550 | 50 | 850 | 20 | RT |
| | 11 | 3 | 1150 | 850 | 40 | 550 | 50 | 850 | 20 | 450 |
| | 12 | 3 | 1150 | 850 | 40 | 550 | 50 | 900 | 20 | RT |
| | 13 | 3 | 1150 | 850 | 40 | 550 | 50 | 900 | 20 | RT |
| | 14 | 3 | 1150 | 850 | 40 | 550 | 50 | 900 | 20 | 450 |
| | 15 | 4 | 1150 | 850 | 40 | 550 | 50 | 850 | 20 | RT |
| | 16 | 4 | 1150 | 850 | 40 | 550 | 50 | 850 | 20 | RT |
| | 17 | 5 | 1150 | 850 | 40 | 550 | 50 | 850 | 20 | RT |
| | 18 | 5 | 1150 | 850 | 40 | 550 | 50 | 850 | 20 | RT |
| | 19 | 6 | 1150 | 850 | 40 | 550 | 50 | 850 | 20 | RT |
| | 20 | 6 | 1150 | 850 | 40 | 550 | 50 | 850 | 20 | RT |
| | 21 | 7 | 1150 | 850 | 40 | 550 | 50 | 850 | 20 | RT |
| | 22 | 7 | 1150 | 850 | 40 | 550 | 50 | 850 | 20 | RT |
| | 23 | 8 | 1150 | 850 | 40 | 550 | 50 | 850 | 20 | RT |
| | 24 | 8 | 1150 | 850 | 40 | 550 | 50 | 850 | 20 | RT |
| | 25 | 9 | 1150 | 850 | 40 | 550 | 50 | 850 | 20 | RT |
| | 26 | 9 | 1150 | 850 | 40 | 550 | 50 | 850 | 20 | RT |
| | 27 | 10 | 1150 | 850 | 40 | 550 | 50 | 850 | 20 | RT |
| | 28 | 10 | 1150 | 850 | 40 | 550 | 50 | 850 | 20 | RT |
| | 29 | 11 | 1150 | 850 | 40 | 550 | 50 | 850 | 20 | RT |
| | 30 | 11 | 1150 | 850 | 40 | 550 | 50 | 850 | 20 | RT |
| | 31 | 12 | 1150 | 850 | 40 | 550 | 50 | 850 | 20 | RT |
| | 32 | 12 | 1150 | 850 | 40 | 550 | 50 | 850 | 20 | RT |
| | 33 | 13 | 1150 | 850 | 40 | 550 | 50 | 850 | 20 | RT |
| | 34 | 13 | 1150 | 850 | 40 | 550 | 50 | 850 | 20 | RT |

| | Tempered | | Continuous annealing or plating | | | | | | |
|---|---|---|---|---|---|---|---|---|---|
| | Temp. ° C. | Time sec | T3 ° C. | t3 sec | Tq ° C. | CR ° C./s | T4 ° C. | t4 sec | Zn→GA ° C. |
| Hot rolling → | — | — | 800 | 60 | 700 | 10 | 400 | 100 | — |
| Cold rolling → | 450 | 1000 | 800 | 60 | 700 | 10 | 400 | 100 | — |
| First continuous | — | — | 800 | 60 | 700 | 10 | 400 | 100 | — |
| annealing → | 450 | 1000 | 800 | 60 | 700 | 10 | 400 | 100 | — |
| Second | — | — | 800 | 60 | 700 | 10 | 400 | 100 | — |
| continuous | 300 | 1000 | 800 | 60 | 700 | 10 | 400 | 100 | — |
| annealing | 450 | 1000 | 800 | 60 | 700 | 10 | 400 | 100 | — |
| | 600 | 1000 | 800 | 60 | 700 | 10 | 400 | 100 | — |
| | 600 | 3600 | 800 | 60 | 700 | 10 | 400 | 100 | — |
| | 750 | 3600 | 800 | 60 | 700 | 10 | 400 | 100 | — |
| | — | — | 800 | 60 | 700 | 10 | 400 | 100 | — |
| | — | — | 800 | 60 | 700 | 10 | 400 | 100 | — |

TABLE 31-continued

| | | | | | | | | |
|---|---|---|---|---|---|---|---|---|
| 450 | 1000 | 800 | 60 | 700 | 10 | 400 | 100 | — |
| — | — | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |
| — | — | 800 | 60 | 700 | 10 | 400 | 100 | — |
| 450 | 1000 | 800 | 60 | 700 | 10 | 400 | 100 | — |

Note:
RT: Room temperature

TABLE 32

| No. | Base phase structure | Second phase structure (S1/S) × 100 | TS (MPa) | E1 (%) | λ (%) | FL/YP |
|---|---|---|---|---|---|---|
| 1 | F + TM | — | 460 | 33 | 96 | 0.80 |
| 2 | F + TM | — | 460 | 33 | 98 | 0.81 |
| 3 | F + TM | 30.3 | 590 | 38 | 57 | 0.72 |
| 4 | F + TM | 8.4 | 590 | 38 | 72 | 0.83 |
| 5 | F + TM | 28.5 | 750 | 40 | 45 | 0.78 |
| 6 | F + TM | 23.3 | 750 | 40 | 42 | 0.74 |
| 7 | F + TM | 10.2 | 750 | 40 | 59 | 0.87 |
| 8 | F + TM | 7.8 | 750 | 40 | 63 | 0.85 |
| 9 | F + TM | 8.5 | 750 | 40 | 66 | 0.86 |
| 10 | F + TM | 25.7 | 750 | 40 | 46 | 0.76 |
| 11 | F + TB | 33.1 | 750 | 40 | 61 | 0.86 |
| 12 | TM | 30.3 | 750 | 40 | 43 | 0.74 |
| 13 | TM | 8.4 | 750 | 40 | 64 | 0.88 |
| 14 | TB | 27.8 | 750 | 40 | 59 | 0.86 |
| 15 | F + TM | 25.3 | 805 | 33 | 54 | 0.69 |
| 16 | F + TM | 11.0 | 805 | 33 | 71 | 0.77 |
| 17 | F + TM | — | 680 | 25 | 61 | 0.88 |
| 18 | F + TM | — | 680 | 25 | 62 | 0.89 |
| 19 | F + TM | 35.8 | 960 | 25 | 55 | 0.65 |
| 20 | F + TM | 13.1 | 960 | 25 | 67 | 0.72 |
| 21 | F + TM | 27.4 | 795 | 32 | 52 | 0.71 |
| 22 | F + TM | 7.2 | 795 | 32 | 68 | 0.80 |
| 23 | F + TM | 28.0 | 800 | 32 | 54 | 0.69 |

TABLE 32-continued

| No. | Base phase structure | Second phase structure (S1/S) × 100 | TS (MPa) | E1 (%) | λ (%) | FL/YP |
|---|---|---|---|---|---|---|
| 24 | F + TM | 3.8 | 800 | 32 | 71 | 0.79 |
| 25 | F + TM | 25.4 | 810 | 33 | 53 | 0.71 |
| 26 | F + TM | 6.6 | 810 | 33 | 66 | 0.80 |
| 27 | F + TM | 27.1 | 805 | 30 | 55 | 0.72 |
| 28 | F + TM | 13.1 | 805 | 30 | 73 | 0.80 |
| 29 | F + TM | 33.1 | 790 | 33 | 49 | 0.71 |
| 30 | F + TM | 8.5 | 790 | 33 | 64 | 0.83 |
| 31 | F + TM | 24.8 | 795 | 34 | 51 | 0.72 |
| 32 | F + TM | 10.8 | 795 | 34 | 67 | 0.81 |
| 33 | F + TM | 28.7 | 800 | 32 | 53 | 0.74 |
| 34 | F + TM | 3.6 | 800 | 32 | 73 | 0.82 |

Note:
TM: tempered martensite,
TB: tempered bainite,
F: ferrite

TABLE 33

| | | | Hot rolling | | | | Cold rolling | Continuous annealing | | |
|---|---|---|---|---|---|---|---|---|---|---|
| | No. | Steel No. | SRT ° C. | FDT ° C. | CR ° C./s | CT ° C. | Cold rolling rate % | T1 ° C. | CR ° C./s | T2 ° C. |
| Hot rolling → | 1 | 3 | 1150 | 850 | 40 | 550 | 50 | 850 | 20 | RT |
| Cold rolling → | 2 | 3 | 1150 | 850 | 40 | 550 | 50 | 850 | 20 | RT |
| First continuous | 3 | 3 | 1150 | 850 | 40 | 550 | 50 | 850 | 20 | 450 |
| annealing → | 4 | 3 | 1150 | 850 | 40 | 550 | 50 | 900 | 20 | RT |
| Second | 5 | 3 | 1150 | 850 | 40 | 550 | 50 | 900 | 20 | RT |
| continuous | 6 | 3 | 1150 | 850 | 40 | 550 | 50 | 900 | 20 | 450 |
| annealing | | | | | | | | | | |

TABLE 33-continued

| | Tempered | | Continuous annealing or plating | | | | | | |
|---|---|---|---|---|---|---|---|---|---|
| | Temp. ° C. | Time sec | T3 ° C. | t3 sec | Tq ° C. | CR ° C./s | T4 ° C. | t4 sec | Zn→GA ° C. |
| Hot rolling → | — | — | 800 | 60 | 700 | 10 | 400 | 100 | — |
| Cold rolling → | 450 | 1000 | 800 | 60 | 700 | 10 | 400 | 100 | — |
| First continuous | — | — | 800 | 60 | 700 | 10 | 400 | 100 | — |
| annealing → | — | — | 800 | 60 | 700 | 10 | 400 | 100 | — |
| Second | 450 | 1000 | 800 | 60 | 700 | 10 | 400 | 100 | — |
| continuous | — | — | 800 | 60 | 700 | 10 | 400 | 100 | — |
| annealing | | | | | | | | | |

TABLE 34

| No. | Base phase structure | Second phase structure (S1/S) | TS (MPa) | E1 (%) | λ (%) | FL/YP |
|---|---|---|---|---|---|---|
| 1 | F + TM | 23.6 | 750 | 40 | 44 | 0.73 |
| 2 | F + TM | 3.5 | 750 | 40 | 56 | 0.81 |
| 3 | F + TB | 28.0 | 750 | 40 | 62 | 0.80 |
| 4 | TM | 30.3 | 750 | 40 | 48 | 0.74 |
| 5 | TM | 7.2 | 750 | 40 | 62 | 0.84 |
| 6 | TB | 27.5 | 750 | 40 | 67 | 0.85 |

Note:

TM: tempered martensite,

TB: tempered bainite,

F: ferrite

TABLE 35

| No. | C | Si | Mn | P | S | Al | Others |
|---|---|---|---|---|---|---|---|
| 1 | 0.03 | 1.5 | 1.5 | 0.08 | 0.005 | 0.035 | |
| 2 | 0.09 | 1.5 | 1.5 | 0.09 | 0.005 | 0.035 | |
| 3 | 0.15 | 1.5 | 1.5 | 0.07 | 0.08 | 0.035 | |
| 4 | 0.20 | 1.5 | 1.5 | 0.06 | 0.004 | 0.035 | |
| 5 | 0.15 | 0.3 | 0.3 | 0.07 | 0.004 | 0.035 | |
| 6 | 0.15 | 1.5 | 1.5 | 0.08 | 0.005 | 0.035 | Mo: 0.2 |
| 7 | 0.15 | 1.5 | 1.5 | 0.07 | 0.006 | 0.035 | Ni: 0.2 |
| 8 | 0.15 | 1.5 | 1.5 | 0.06 | 0.006 | 0.035 | Cu: 0.2 |
| 9 | 0.15 | 1.5 | 1.5 | 0.07 | 0.005 | 0.035 | Cr: 0.2 |
| 10 | 0.15 | 1.5 | 1.5 | 0.07 | 0.006 | 0.035 | Ti: 0.03 |
| 11 | 0.15 | 1.5 | 1.5 | 0.06 | 0.005 | 0.035 | Nb: 0.03 |
| 12 | 0.15 | 1.5 | 1.5 | 0.07 | 0.006 | 0.035 | V: 0.03 |
| 13 | 0.15 | 1.5 | 1.5 | 0.06 | 0.005 | 0.035 | Ca: 10 ppm |

TABLE 36

| | | Hot rolling | | | | Cold rolling | Continuous annealing | | | Continuous annealing or plating | | | | | | |
|---|---|---|---|---|---|---|---|---|---|---|---|---|---|---|---|---|
| No. | Steel No. | SRT ° C. | FDT ° C. | CR ° C./s | CT ° C. | Cold rolling rate % | T1 ° C. | CR ° C./s | T2 ° C. | T3 ° C. | t3 sec | Tq ° C. | CR ° C./s | T4 ° C. | t4 sec | Zn→GA ° C. |
| 1 | 1 | 1050 | 850 | 40 | 550 | 50 | 850 | 20 | RT | 800 | 60 | 700 | 10 | 400 | 100 | — |
| 2 | 2 | 1050 | 850 | 40 | 550 | 50 | 850 | 20 | RT | 800 | 60 | 700 | 10 | 400 | 100 | — |
| 3 | 3 | 1050 | 850 | 40 | 550 | 50 | 850 | 20 | RT | 800 | 60 | 700 | 10 | 400 | 100 | — |
| 4 | 4 | 1050 | 850 | 40 | 550 | 50 | 850 | 20 | RT | 800 | 60 | 700 | 10 | 400 | 100 | — |
| 5 | 5 | 1050 | 850 | 40 | 550 | 50 | 850 | 20 | RT | 800 | 60 | 700 | 10 | 400 | 100 | — |
| 6 | 6 | 1050 | 850 | 40 | 550 | 50 | 850 | 20 | RT | 800 | 60 | 700 | 10 | 400 | 100 | — |
| 7 | 7 | 1050 | 850 | 40 | 550 | 50 | 850 | 20 | RT | 800 | 60 | 700 | 10 | 400 | 100 | — |
| 8 | 8 | 1050 | 850 | 40 | 550 | 50 | 850 | 20 | RT | 800 | 60 | 700 | 10 | 400 | 100 | — |
| 9 | 9 | 1050 | 850 | 40 | 550 | 50 | 850 | 20 | RT | 800 | 60 | 700 | 10 | 400 | 100 | — |
| 10 | 10 | 1050 | 850 | 40 | 550 | 50 | 850 | 20 | RT | 800 | 60 | 700 | 10 | 400 | 100 | — |
| 11 | 11 | 1050 | 850 | 40 | 550 | 50 | 850 | 20 | RT | 800 | 60 | 700 | 10 | 400 | 100 | — |
| 12 | 12 | 1050 | 850 | 40 | 550 | 50 | 850 | 20 | RT | 800 | 60 | 700 | 10 | 400 | 100 | — |
| 13 | 13 | 1050 | 850 | 40 | 550 | 50 | 850 | 20 | RT | 800 | 60 | 700 | 10 | 400 | 100 | — |
| 14 | 3 | 1050 | 850 | 40 | 550 | 50 | 850 | 20 | RT | 800 | 60 | 700 | 1 | 400 | 100 | — |
| 15 | 3 | 950 | 850 | 40 | 550 | 50 | 850 | 20 | RT | 800 | 60 | 700 | 1 | 400 | 100 | — |
| 16 | 3 | 975 | 850 | 40 | 550 | 50 | 850 | 20 | RT | 800 | 60 | 700 | 1 | 400 | 100 | — |
| 17 | 3 | 1000 | 850 | 40 | 550 | 50 | 850 | 20 | RT | 800 | 60 | 700 | 1 | 400 | 100 | — |
| 18 | 3 | 1025 | 850 | 40 | 550 | 50 | 850 | 20 | RT | 800 | 60 | 700 | 1 | 400 | 100 | — |
| 19 | 3 | 1075 | 850 | 40 | 550 | 50 | 850 | 20 | RT | 800 | 60 | 700 | 1 | 400 | 100 | — |
| 20 | 3 | 1100 | 850 | 40 | 550 | 50 | 850 | 20 | RT | 800 | 60 | 700 | 1 | 400 | 100 | — |

Note:

RT: Room temperature

TABLE 37

| No. | Steel No. | F (%) | TM (%) | B (%) | γR (%) | Others (%) | $C_{\gamma R}$ (%) | TS (MPa) | EI (%) | λ (%) | BH2 (MPa) | BH10 (MPa) |
|---|---|---|---|---|---|---|---|---|---|---|---|---|
| 1 | 1 | 48 | 47 | 5 | 0 | 0 | — | 465 | 34 | 96 | 5 | 0 |
| 2 | 2 | 44 | 42 | 5 | 9 | 0 | 1.4 | 610 | 26 | 54 | 80 | 45 |
| 3 | 3 | 55 | 29 | 6 | 10 | 0 | 1.3 | 760 | 41 | 59 | 85 | 50 |
| 4 | 4 | 47 | 35 | 6 | 12 | 0 | 1.3 | 810 | 33 | 71 | 95 | 55 |
| 5 | 5 | 54 | 40 | 5 | 1 | 0 | 0.5 | 685 | 24 | 62 | 15 | 0 |
| 6 | 6 | 50 | 39 | 3 | 8 | 0 | 1.3 | 960 | 26 | 67 | 85 | 50 |
| 7 | 7 | 46 | 41 | 2 | 11 | 0 | 1.3 | 800 | 32 | 68 | 85 | 45 |
| 8 | 8 | 38 | 50 | 3 | 9 | 0 | 1.4 | 800 | 33 | 71 | 80 | 50 |
| 9 | 9 | 39 | 44 | 5 | 12 | 0 | 1.3 | 810 | 33 | 66 | 90 | 55 |
| 10 | 10 | 44 | 37 | 5 | 14 | 0 | 1.4 | 805 | 31 | 73 | 90 | 50 |
| 11 | 11 | 53 | 31 | 3 | 13 | 0 | 1.4 | 795 | 33 | 64 | 80 | 45 |
| 12 | 12 | 44 | 40 | 4 | 12 | 0 | 1.3 | 795 | 35 | 67 | 80 | 45 |
| 13 | 13 | 39 | 47 | 3 | 11 | 0 | 1.3 | 800 | 32 | 73 | 85 | 45 |
| 14 | 3 | 30 | 39 | 6 | 8 | 17(P) | 1.3 | 735 | 27 | 43 | 15 | 0 |
| 15 | 3 | 50 | 34 | 4 | 12 | 0 | 1.3 | 770 | 40 | 37 | 100 | 60 |
| 16 | 3 | 53 | 31 | 5 | 11 | 0 | 1.3 | 765 | 39 | 60 | 95 | 60 |
| 17 | 3 | 56 | 27 | 7 | 10 | 0 | 1.4 | 765 | 40 | 57 | 95 | 55 |
| 18 | 3 | 53 | 33 | 3 | 11 | 0 | 1.3 | 760 | 40 | 62 | 90 | 55 |
| 19 | 3 | 53 | 33 | 4 | 10 | 0 | 1.3 | 755 | 39 | 63 | 85 | 45 |
| 20 | 3 | 52 | 32 | 5 | 11 | 0 | 1.3 | 760 | 40 | 65 | 80 | 45 |

Notes:
TM: tempered martensite,
F: ferrite,
B: bainite,
γR: retained austenite,
P: pearlite

TABLE 38

| | | Hot rolling | | | | Cold rolling | Continuous annealing | | | Continuous annealing or plating | | | | | | |
|---|---|---|---|---|---|---|---|---|---|---|---|---|---|---|---|---|
| No. | Steel No. | SRT ° C. | FDT ° C. | CR ° C./s | CT ° C. | Cold rolling rate % | T1 ° C. | CR ° C./s | T2 ° C. | T3 ° C. | t3 sec | Tq ° C. | CR ° C./s | T4 ° C. | t4 sec | Zn→GA ° C. |
| 1 | 1 | 1050 | 850 | 40 | 550 | 50 | 850 | 20 | RT | 800 | 60 | 700 | 10 | 400 | 100 | — |
| 2 | 2 | 1150 | 850 | 40 | 550 | 50 | 850 | 20 | RT | 800 | 60 | 700 | 10 | 400 | 100 | — |
| 3 | 3 | 1150 | 850 | 40 | 550 | 50 | 850 | 20 | RT | 800 | 60 | 700 | 10 | 400 | 100 | — |
| 4 | 4 | 1150 | 850 | 40 | 550 | 50 | 850 | 20 | RT | 800 | 60 | 700 | 10 | 400 | 100 | — |
| 5 | 5 | 1150 | 850 | 40 | 550 | 50 | 850 | 20 | RT | 800 | 60 | 700 | 10 | 400 | 100 | — |
| 6 | 6 | 1150 | 850 | 40 | 550 | 50 | 850 | 20 | RT | 800 | 60 | 700 | 10 | 400 | 100 | — |
| 7 | 7 | 1150 | 850 | 40 | 550 | 50 | 850 | 20 | RT | 800 | 60 | 700 | 10 | 400 | 100 | — |
| 8 | 8 | 1150 | 850 | 40 | 550 | 50 | 850 | 20 | RT | 800 | 60 | 700 | 10 | 400 | 100 | — |
| 9 | 9 | 1150 | 850 | 40 | 550 | 50 | 850 | 20 | RT | 800 | 60 | 700 | 10 | 400 | 100 | — |
| 10 | 10 | 1150 | 850 | 40 | 550 | 50 | 850 | 20 | RT | 800 | 60 | 700 | 10 | 400 | 100 | — |
| 11 | 11 | 1150 | 850 | 40 | 550 | 50 | 850 | 20 | RT | 800 | 60 | 700 | 10 | 400 | 100 | — |
| 12 | 12 | 1150 | 850 | 40 | 550 | 50 | 850 | 20 | RT | 800 | 60 | 700 | 10 | 400 | 100 | — |
| 13 | 13 | 1150 | 850 | 40 | 550 | 50 | 850 | 20 | RT | 800 | 60 | 700 | 10 | 400 | 100 | — |
| 14 | 3 | 1150 | 850 | 40 | 550 | 50 | 850 | 20 | RT | 800 | 60 | 700 | 1 | 400 | 100 | — |
| 15 | 3 | 925 | 850 | 40 | 550 | 50 | 850 | 20 | RT | 800 | 60 | 700 | 1 | 400 | 100 | — |
| 16 | 3 | 1125 | 850 | 40 | 550 | 50 | 850 | 20 | RT | 800 | 60 | 700 | 1 | 400 | 100 | — |
| 17 | 3 | 1175 | 850 | 40 | 550 | 50 | 850 | 20 | RT | 800 | 60 | 700 | 1 | 400 | 100 | — |
| 18 | 3 | 1200 | 850 | 40 | 550 | 50 | 850 | 20 | RT | 800 | 60 | 700 | 1 | 400 | 100 | — |

Note:
RT: Room temperature

TABLE 39

| No. | Steel No. | F (%) | TM (%) | B (%) | γR (%) | Others (%) | $C_{\gamma R}$ (%) | TS (MPa) | EI (%) | λ (%) | BH2 (MPa) | BH10 (MPa) |
|---|---|---|---|---|---|---|---|---|---|---|---|---|
| 1 | 1 | 48 | 47 | 5 | 0 | 0 | — | 460 | 33 | 96 | 3 | 0 |
| 2 | 2 | 44 | 42 | 5 | 9 | 0 | 1.4 | 610 | 26 | 54 | 75 | 15 |
| 3 | 3 | 53 | 31 | 6 | 10 | 0 | 1.3 | 760 | 41 | 59 | 85 | 52 |
| 4 | 4 | 47 | 35 | 6 | 12 | 0 | 1.3 | 805 | 33 | 71 | 95 | 40 |
| 5 | 5 | 54 | 40 | 5 | 1 | 0 | 0.5 | 680 | 25 | 62 | 20 | 0 |
| 6 | 6 | 50 | 39 | 3 | 8 | 0 | 1.3 | 960 | 25 | 67 | 85 | 20 |
| 7 | 7 | 46 | 41 | 2 | 11 | 0 | 1.3 | 795 | 32 | 68 | 80 | 15 |

TABLE 39-continued

| No. | Steel No. | F (%) | TM (%) | B (%) | γR (%) | Others (%) | $C_{\gamma R}$ (%) | TS (MPa) | EI (%) | λ (%) | BH2 (MPa) | BH10 (MPa) |
|---|---|---|---|---|---|---|---|---|---|---|---|---|
| 8 | 8 | 38 | 50 | 3 | 9 | 0 | 1.4 | 800 | 32 | 71 | 80 | 10 |
| 9 | 9 | 39 | 44 | 5 | 12 | 0 | 1.3 | 810 | 33 | 66 | 85 | 20 |
| 10 | 10 | 44 | 37 | 5 | 14 | 0 | 1.4 | 805 | 30 | 73 | 90 | 20 |
| 11 | 11 | 53 | 31 | 3 | 13 | 0 | 1.3 | 790 | 33 | 64 | 80 | 20 |
| 12 | 12 | 44 | 40 | 4 | 12 | 0 | 1.3 | 795 | 34 | 67 | 75 | 15 |
| 13 | 13 | 39 | 47 | 3 | 11 | 0 | 1.3 | 800 | 32 | 73 | 85 | 25 |
| 14 | 3 | 30 | 39 | 6 | 8 | 17(P) | 1.3 | 730 | 28 | 43 | 15 | 0 |
| 15 | 3 | 80 | 10 | 5 | 5 | 0 | 1.3 | 730 | 34 | 35 | 30 | 10 |
| 16 | 3 | 54 | 31 | 5 | 10 | 0 | 1.4 | 755 | 39 | 57 | 80 | 35 |
| 17 | 3 | 52 | 33 | 4 | 11 | 0 | 1.3 | 750 | 39 | 60 | 75 | 35 |
| 18 | 3 | 55 | 31 | 5 | 9 | 0 | 1.4 | 740 | 41 | 62 | 70 | 30 |

Notes:
TM: tempered martensite,
F: ferrite,
B: bainite,
γR: retained austenite

TABLE 40

| No. | Steel No. | M (%) | B (%) | γR (%) | F (%) | $C_{\gamma r}$ (%) | TS (Mpa) | EI (%) | λ (%) | BH2 (MPa) | BH10 (MPa) |
|---|---|---|---|---|---|---|---|---|---|---|---|
| 1 | 2 | 23 | 3 | 0 | 74 | — | 850 | 22 | 43 | 40 | 10 |
| 2 | 3 | 0 | 4 | 12 | 84 | 1.4 | 788 | 37 | 41 | 55 | 15 |
| 3 | 2 | 0 | 83 | 0 | 17 | — | 830 | 15 | 59 | 10 | 0 |

Notes:
M: martensite,
B: bainite,
F: ferrite,
γR: retained austenite

TABLE 41

| | | Hot rolling | | | | | | | Continuous annealing or plating | | | | | |
|---|---|---|---|---|---|---|---|---|---|---|---|---|---|---|
| | No. | SRT ° C. | FDT ° C. | CR1 ° C./s | T ° C. | CR2 ° C./s | Average CR ° C./s | CT ° C. | T3 ° C. | t3 sec | Tq ° C. | CR ° C./s | T4 ° C. | t4 sec |
| Hot rolling → | 1 | 1050 | 850 | 40 | — | — | 40 | 200 | 800 | 60 | 700 | 10 | 400 | 100 |
| Continuous | 2 | 1050 | 850 | 40 | 700 | 40 | 20 | 200 | 800 | 60 | 700 | 10 | 400 | 100 |
| annealing | 3 | 1050 | 850 | 40 | — | — | 40 | 450 | 800 | 60 | 700 | 10 | 400 | 100 |
| | 4 | 1050 | 850 | 40 | 700 | 40 | 20 | 450 | 800 | 60 | 700 | 10 | 400 | 100 |
| Hot rolling → | 5 | 1150 | 850 | 40 | — | — | 40 | 200 | 800 | 60 | 700 | 10 | 400 | 100 |
| Continuous | 6 | 1150 | 850 | 40 | 700 | 40 | 20 | 200 | 800 | 60 | 700 | 10 | 400 | 100 |
| annealing | 7 | 1150 | 850 | 40 | — | — | 40 | 450 | 800 | 60 | 700 | 10 | 400 | 100 |
| | 8 | 1150 | 850 | 40 | 700 | 40 | 20 | 450 | 800 | 60 | 700 | 10 | 400 | 100 |

TABLE 42

| No. | Base phase structure | TS (MPa) | E1 | λ (%) | BH2 (MPa) | BH10 (MPa) |
|---|---|---|---|---|---|---|
| 1 | TM | 755 | 40 | 44 | 100 | 55 |
| 2 | F + TM | 755 | 40 | 45 | 85 | 45 |
| 3 | TB | 755 | 40 | 69 | 80 | 45 |
| 4 | F + TB | 755 | 40 | 64 | 80 | 45 |
| 5 | TM | 750 | 40 | 44 | 95 | 30 |
| 6 | F + TM | 750 | 40 | 45 | 80 | 25 |

TABLE 42-continued

| No. | Base phase structure | TS (MPa) | E1 | λ (%) | BH2 (MPa) | BH10 (MPa) |
|---|---|---|---|---|---|---|
| 7 | TB | 750 | 40 | 69 | 80 | 20 |
| 8 | F + TB | 750 | 40 | 64 | 75 | 15 |

Notes:
TM: tempered martensite,
TB: tempered bainite,
F: ferrite

TABLE 43

| | | | Hot rolling | | | | Cold rolling | Continuous annealing | | | Continuous annealing or plating | | | | | | Zn→ |
|---|---|---|---|---|---|---|---|---|---|---|---|---|---|---|---|---|---|
| | No. | Steel No. | SRT ° C. | FDT ° C. | CR ° C./s | CT ° C. | Cold rolling rate % | T1 ° C. | CR ° C./s | T2 ° C. | T3 ° C. | t3 sec | Tq ° C. | CR ° C./s | T4 ° C. | t4 sec | GA ° C. |
| Hot rolling → | 1 | 1 | 1050 | 850 | 40 | 550 | 50 | 850 | 20 | RT | 800 | 60 | 700 | 10 | 400 | 100 | — |
| Cold rolling → | 2 | 2 | 1050 | 850 | 40 | 550 | 50 | 850 | 20 | RT | 800 | 60 | 700 | 10 | 400 | 100 | — |
| First continuous | 3 | 3 | 1050 | 850 | 40 | 550 | 50 | 850 | 20 | RT | 800 | 60 | 700 | 10 | 400 | 100 | — |
| annealing → | 4 | 3 | 1050 | 850 | 40 | 550 | 50 | 850 | 20 | 450 | 800 | 60 | 700 | 10 | 400 | 100 | — |
| Second | 5 | 3 | 1050 | 850 | 40 | 550 | 50 | 900 | 20 | RT | 800 | 60 | 700 | 10 | 400 | 100 | — |
| continuous | 6 | 3 | 1050 | 850 | 40 | 550 | 50 | 900 | 20 | 450 | 800 | 60 | 700 | 10 | 400 | 100 | — |
| annealing | 7 | 4 | 1050 | 850 | 40 | 550 | 50 | 850 | 20 | RT | 800 | 60 | 700 | 10 | 400 | 100 | — |
| | 8 | 5 | 1050 | 850 | 40 | 550 | 50 | 850 | 20 | RT | 800 | 60 | 700 | 10 | 400 | 100 | — |
| | 9 | 6 | 1050 | 850 | 40 | 550 | 50 | 850 | 20 | RT | 800 | 60 | 700 | 10 | 400 | 100 | — |
| | 10 | 7 | 1050 | 850 | 40 | 550 | 50 | 850 | 20 | RT | 800 | 60 | 700 | 10 | 400 | 100 | — |
| | 11 | 8 | 1050 | 850 | 40 | 550 | 50 | 850 | 20 | RT | 800 | 60 | 700 | 10 | 400 | 100 | — |
| | 12 | 9 | 1050 | 850 | 40 | 550 | 50 | 850 | 20 | RT | 800 | 60 | 700 | 10 | 400 | 100 | — |
| | 13 | 10 | 1050 | 850 | 40 | 550 | 50 | 850 | 20 | RT | 800 | 60 | 700 | 10 | 400 | 100 | — |
| | 14 | 11 | 1050 | 850 | 40 | 550 | 50 | 850 | 20 | RT | 800 | 60 | 700 | 10 | 400 | 100 | — |
| | 15 | 12 | 1050 | 850 | 40 | 550 | 50 | 850 | 20 | RT | 800 | 60 | 700 | 10 | 400 | 100 | — |
| | 16 | 13 | 1050 | 850 | 40 | 550 | 50 | 850 | 20 | RT | 800 | 60 | 700 | 10 | 400 | 100 | — |

Note:
RT: Room temperature

TABLE 44

| No. | Base phase structure | TS (MPa) | E1 (%) | λ (%) | BH2 (MPa) | BH10 (MPa) |
|---|---|---|---|---|---|---|
| 1 | F + TM | 465 | 32 | 96 | 10 | 0 |
| 2 | F + TM | 590 | 39 | 62 | 75 | 45 |
| 3 | F + TM | 755 | 40 | 51 | 85 | 50 |
| 4 | F + TB | 750 | 41 | 61 | 85 | 55 |
| 5 | TM | 750 | 40 | 48 | 80 | 45 |
| 6 | TB | 755 | 41 | 59 | 85 | 55 |
| 7 | F + TM | 805 | 33 | 59 | 100 | 65 |

TABLE 44-continued

| No. | Base phase structure | TS (MPa) | E1 (%) | λ (%) | BH2 (MPa) | BH10 (MPa) |
|---|---|---|---|---|---|---|
| 8 | F + TM | 680 | 26 | 66 | 20 | 5 |
| 9 | F + TM | 965 | 26 | 55 | 80 | 45 |
| 10 | F + TM | 795 | 32 | 57 | 80 | 45 |
| 11 | F + TM | 800 | 33 | 59 | 85 | 50 |
| 12 | F + TM | 815 | 33 | 58 | 75 | 45 |
| 13 | F + TM | 805 | 31 | 55 | 85 | 50 |
| 14 | F + TM | 795 | 34 | 49 | 85 | 45 |
| 15 | F + TM | 795 | 35 | 56 | 85 | 50 |
| 16 | F + TM | 805 | 32 | 58 | 80 | 45 |

Notes:
TM: tempered martensite,
TB: tempered bainite,
F: ferrite

TABLE 45

| | | | Hot rolling | | | | Cold rolling | Continuous annealing | | | Continuous annealing or plating | | | | | | Zn→ |
|---|---|---|---|---|---|---|---|---|---|---|---|---|---|---|---|---|---|
| | No. | Steel No. | SRT ° C. | FDT ° C. | CR ° C./s | CT ° C. | Cold rolling rate % | T1 ° C. | CR ° C./s | T2 ° C. | T3 ° C. | t3 sec | Tq ° C. | CR ° C./s | T4 ° C. | t4 sec | GA ° C. |
| Hot rolling → | 1 | 3 | 1050 | 850 | 40 | 550 | 50 | 850 | 20 | RT | 800 | 60 | 700 | 10 | 400 | 100 | 600 |
| Cold rolling → | 2 | 3 | 1050 | 850 | 40 | 550 | 50 | 850 | 20 | 450 | 800 | 60 | 700 | 10 | 400 | 100 | 600 |
| First continuous | 3 | 3 | 1050 | 850 | 40 | 550 | 50 | 900 | 20 | RT | 800 | 60 | 700 | 10 | 400 | 100 | 600 |
| annealing → | 4 | 3 | 1050 | 850 | 40 | 550 | 50 | 900 | 20 | 450 | 800 | 60 | 700 | 10 | 400 | 100 | 600 |
| Second continuous annealing | | | | | | | | | | | | | | | | | |

Note:
RT: Room temperature

TABLE 46

| No. | Base phase structure | TS (MPa) | E1 (%) | λ (%) | BH2 (MPa) | BH10 (MPa) |
|---|---|---|---|---|---|---|
| 1 | F + TM | 755 | 40 | 44 | 85 | 50 |
| 2 | F + TB | 755 | 40 | 62 | 75 | 45 |
| 3 | TM | 755 | 40 | 48 | 105 | 60 |
| 4 | TB | 755 | 40 | 67 | 75 | 45 |

Notes:
TM: tempered martensite,
TB: tempered bainite,
F: ferrite

TABLE 47

| | | | Hot rolling | | | | Cold rolling | Continuous annealing | | | Continuous annealing or plating | | | | | | Zn→ |
|---|---|---|---|---|---|---|---|---|---|---|---|---|---|---|---|---|---|
| | No. | Steel No. | SRT ° C. | FDT ° C. | CR ° C./s | CT ° C. | Cold rolling rate % | T1 ° C. | CR ° C./s | T2 ° C. | T3 ° C. | t3 sec | Tq ° C. | CR ° C./s | T4 ° C. | t4 sec | GA ° C. |
| Hot rolling → | 1 | 1 | 1150 | 850 | 40 | 550 | 50 | 850 | 20 | RT | 800 | 60 | 700 | 11 | 400 | 100 | — |
| Cold rolling → | 2 | 2 | 1150 | 850 | 40 | 550 | 50 | 850 | 20 | RT | 800 | 60 | 700 | 10 | 400 | 100 | — |
| First continuous | 3 | 3 | 1150 | 850 | 40 | 550 | 50 | 850 | 20 | RT | 800 | 60 | 700 | 10 | 400 | 100 | — |
| annealing → | 4 | 3 | 1150 | 850 | 40 | 550 | 50 | 850 | 20 | 450 | 800 | 60 | 700 | 10 | 400 | 100 | — |
| Second | 5 | 3 | 1150 | 850 | 40 | 550 | 50 | 900 | 20 | RT | 800 | 60 | 700 | 10 | 400 | 100 | — |
| continuous | 6 | 3 | 1150 | 850 | 40 | 550 | 50 | 900 | 20 | 450 | 800 | 60 | 700 | 10 | 400 | 100 | — |
| annealing | 7 | 4 | 1150 | 850 | 40 | 550 | 50 | 850 | 20 | RT | 800 | 60 | 700 | 10 | 400 | 100 | — |
| | 8 | 5 | 1150 | 850 | 40 | 550 | 50 | 850 | 20 | RT | 800 | 60 | 700 | 10 | 400 | 100 | — |
| | 9 | 6 | 1150 | 850 | 40 | 550 | 50 | 850 | 20 | RT | 800 | 60 | 700 | 10 | 400 | 100 | — |
| | 10 | 7 | 1150 | 850 | 40 | 550 | 50 | 850 | 20 | RT | 800 | 60 | 700 | 10 | 400 | 100 | — |
| | 11 | 8 | 1150 | 850 | 40 | 550 | 50 | 850 | 20 | RT | 800 | 60 | 700 | 10 | 400 | 100 | — |
| | 12 | 9 | 1150 | 850 | 40 | 550 | 50 | 850 | 20 | RT | 800 | 60 | 700 | 10 | 400 | 100 | — |
| | 13 | 10 | 1150 | 850 | 40 | 550 | 50 | 850 | 20 | RT | 800 | 60 | 700 | 10 | 400 | 100 | — |
| | 14 | 11 | 1150 | 850 | 40 | 550 | 50 | 850 | 20 | RT | 800 | 60 | 700 | 10 | 400 | 100 | — |
| | 15 | 12 | 1150 | 850 | 40 | 550 | 50 | 850 | 20 | RT | 800 | 60 | 700 | 10 | 400 | 100 | — |
| | 16 | 13 | 1150 | 850 | 40 | 550 | 50 | 850 | 20 | RT | 800 | 60 | 700 | 10 | 400 | 100 | — |

Note:
RT: Room temperature

TABLE 48

| No. | Base phase structure | TS (MPa) | E1 (%) | λ (%) | BH2 (MPa) | BH10 (MPa) |
|---|---|---|---|---|---|---|
| 1 | F + TM | 460 | 33 | 96 | 10 | 0 |
| 2 | F + TM | 590 | 38 | 57 | 70 | 20 |
| 3 | F + TM | 750 | 40 | 46 | 85 | 25 |
| 4 | F + TB | 750 | 40 | 61 | 80 | 25 |
| 5 | TM | 750 | 40 | 43 | 80 | 25 |
| 6 | TB | 750 | 40 | 59 | 75 | 25 |
| 7 | F + TM | 805 | 33 | 54 | 95 | 35 |
| 8 | F + TM | 680 | 25 | 61 | 85 | 20 |
| 9 | F + TM | 960 | 25 | 55 | 80 | 25 |
| 10 | F + TM | 795 | 32 | 52 | 75 | 25 |
| 11 | F + TM | 800 | 32 | 54 | 85 | 20 |
| 12 | F + TM | 810 | 33 | 53 | 70 | 25 |
| 13 | F + TM | 805 | 30 | 55 | 75 | 30 |

TABLE 48-continued

| No. | Base phase structure | TS (MPa) | E1 (%) | λ (%) | BH2 (MPa) | BH10 (MPa) |
|---|---|---|---|---|---|---|
| 14 | F + TM | 790 | 33 | 49 | 80 | 30 |
| 15 | F + TM | 795 | 34 | 51 | 85 | 25 |
| 16 | F + TM | 800 | 32 | 53 | 75 | 30 |

Notes:
TM: tempered martensite,
TB: tempered bainite,
F: ferrite

TABLE 49

| | No. | Steel No. | Hot rolling SRT ° C. | FDT ° C. | CR ° C./s | CT ° C. | Cold rolling Cold rolling rate % | Continuous annealing T1 ° C. | CR ° C./s | T2 ° C. | Continuous annealing or plating T3 ° C. | t3 sec | Tq ° C. | CR ° C./s | T4 ° C. | t4 sec | Zn→ GA ° C. |
|---|---|---|---|---|---|---|---|---|---|---|---|---|---|---|---|---|---|
| Hot rolling → | 1 | 3 | 1150 | 850 | 40 | 550 | 50 | 850 | 20 | RT | 800 | 60 | 700 | 10 | 400 | 100 | 600 |
| Cold rolling → | 2 | 3 | 1150 | 850 | 40 | 550 | 50 | 850 | 20 | 450 | 800 | 60 | 700 | 10 | 400 | 100 | 600 |
| First continuous | 3 | 3 | 1150 | 850 | 40 | 550 | 50 | 900 | 20 | RT | 800 | 60 | 700 | 10 | 400 | 100 | 600 |
| annealing → | 4 | 3 | 1150 | 850 | 40 | 550 | 50 | 900 | 20 | 450 | 800 | 60 | 700 | 10 | 400 | 100 | 600 |
| Second continuous annealing | | | | | | | | | | | | | | | | | |

Note:
RT: Room temperature

TABLE 50

| No. | Base phase structure | TS (MPa) | E1 (%) | λ (%) | BH2 (MPa) | BH10 (MPa) |
|---|---|---|---|---|---|---|
| 1 | F + TM | 750 | 40 | 44 | 80 | 25 |
| 2 | F + TB | 750 | 40 | 62 | 70 | 15 |
| 3 | TM | 750 | 40 | 48 | 95 | 35 |
| 4 | TB | 750 | 40 | 67 | 70 | 20 |

Notes:
TM: tempered martensite,
TB: tempered bainite,
F: ferrite

The invention claimed is:

1. A high strength steel sheet superior in formability, (1) containing the following chemical components in mass %:

C: 0.06 to 0.25%
Si+Al: 0.5 to 3%
Mn: 0.5 to 3%
P: 0.15% or less (not including 0%)
S: 0.02% or less (not including 0%), and (2) having a structure comprising:

(2-1) a base phase structure, the base phase structure being tempered martensite or tempered bainite and accounting for 50% or more in terms of a space factor relative to the whole structure, or the base structure comprising tempered martensite or tempered bainite which accounts for 15% or more in terms of a space factor relative to the whole structure and further comprising ferrite, the tempered martensite or the tempered bainite having a hardness which satisfies the relation of:

Vickers hardness (Hv)≧500[C]+30[Si]+3[Mn]+50 where [ ] represents the content (mass %) of each element; and (2-2) a second phase structure comprising retained austenite which accounts for 3 to 30% in terms of a space factor relative to the whole structure and optionally further comprising bainite and/or martensite, the retained austenite having a C concentration ($C\gamma_R$) of 0.8% or more, wherein the second phase structure satisfies the following expression (1) to enhance the fatigue characteristic:

$$(S1/S)\times 100 \geqq 20 \quad (1)$$

where S stands for a total area of the second phase structure, and S1 stands for a total area of coarse second phase crystal grains (Sb) contained in the second phase structure, the Sb corresponding to three times or more as large as an average crystal grain area (Sm) of the second phase structure.

2. A high strength steel sheet according to claim 1, (1) containing the following chemical components in mass %:

C: 0.06 to 0.25%
Si+Al: 0.5 to 3%
Mn: 0.5 to 3%
P: 0.15% or less (not including 0%)
5: 0.02% or less (not including 0%), and (2) having such bake hardening (BH) characteristics after baking finish as satisfy the following expressions:

BH (2%)≧70 MPa, and
BH (10%)≧BH (2%)/2.

3. A high strength steel sheet according to claim 1, wherein the retained austenite is in a lath form.

4. A high strength steel sheet according to claim 1, wherein the content of the ferrite is 5 to 60% in terms of a space factor relative to the whole structure.

5. A high strength steel sheet according to claim 4, wherein the content of the ferrite is 5 to 30% in terms of a space factor relative to the whole structure.

6. A high strength steel sheet according to claim 1, further containing at least one of the following components in mass %:

Mo: 1% or less (not including 0%)
Ni: 0.5% or less (not including 0%)
Cu: 0.5% or less (not including 0%)
Cr: 1% or less (not including 0%).

7. A high strength steel sheet according to claim 1, further containing at least one of the following components in mass %:

Ti: 0.1% or less (not including 0%)
Nb: 0.1% or less (not including 0%)
V: 0.1% or less (not including 0%).

8. A high strength steel sheet according to claim 1, further containing the following component(s) in mass %:

Ca: 0.003% or less (not including 0%), and/or
REM: 0.003% or less (not including 0%).

9. A method of producing the high strength steel sheet described in claim 1 wherein the base phase structure is tempered martensite or tempered bainite, the method comprising a hot rolling process and a continuous annealing process or a plating process to achieve tempering, the hot rolling process comprising a step of terminating finish rolling at a temperature of not lower than ($A_{r3}$−50)° C. and a step of cooling a resulting steel sheet to a temperature of not higher than Ms point or a temperature of not lower than Ms point and not higher than Bs point at an average cooling rate of not lower than 20° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

10. A method of producing the high strength steel described in claim 1 wherein the base phase structure is tempered martensite or tempered bainite, the method comprising a hot rolling process, a cold rolling process, a first continuous annealing process, and a second continuous annealing process or a plating process to achieve tempering, the continuous annealing process comprising a step of holding a resulting steel sheet in a heated state at a temperature of not lower than $A_3$ point and a step of cooling the steel sheet to a temperature of not higher than Ms point or a temperature of not lower than Ms point and not higher than Bs point at an average cooling rate of not lower than 20° C./s, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

11. A method of producing the high strength steel sheet described in claim 1 wherein the base phase structure comprises tempered martensite and ferrite or comprises tempered bainite and ferrite, the method comprising a hot rolling process and a continuous annealing process or a plating process to achieve tempering, the hot rolling process comprising a step of terminating finish rolling at a temperature of not lower than ($A_{r3}$−50)° C. and a step of cooling a resulting steel sheet to a temperature of not higher than Ms point or a temperature of not lower than Ms point and not higher than Bs point at an average cooling rate of not lower than 10° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

12. The method of claim 11, wherein the hot rolling process comprises a step of terminating finish rolling at a temperature of not lower than ($A_{r3}$−50)° C., a step of cooling the steel sheet to a temperature in the range of 700±100° C. at an average cooling rate of not lower than 30° C./s, a step of cooling the steel sheet with air in said temperature range for 1 to 30 seconds, and a step of subsequently cooling the steel sheet to a temperature of not higher than Ms point or a temperature of not lower than Ms point and not higher than Bs point at an average cooling rate of not lower than 30° C./s and winding up the steel sheet.

13. The method of claim 11, wherein the continuous annealing process comprises a step of holding the steel sheet in a heated state at a temperature of not lower than $A_1$ point and not higher than $A_3$ point for 10 to 600 seconds, a step of cooling the steel sheet to a temperature of ($A_1$ point to 600° C.) at an average cooling rate of not higher than 15° C./s, a step of cooling the steel sheet to a temperature of not lower than 300° C. and not higher than 480° C. at an average cooling rate of not lower than 20° C./s, and a step of holding the steel sheet in said temperature range for 1 second or more.

14. A method of producing the high strength steel described in claim 1 wherein the base phase structure comprises tempered martensite and ferrite or comprises tempered bainite and ferrite, the method comprising a hot rolling process, a cold rolling process, a first continuous annealing process, a tempering process, and a second continuous annealing process or a plating process, the first continuous annealing process comprising a step of holding a resulting steel sheet in a heated state at a temperature of not lower than $A_1$ point and not higher than $A_3$ point and a step of cooling the steel sheet to a temperature of not higher than Ms point or a temperature of not lower than Ms point and not higher than Bs point at an average cooling rate of not lower than 10° C./s, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

15. The method of claim 14, wherein the second continuous annealing process comprises a step of holding the steel sheet in a heated state at a temperature of not lower than $A_1$ point and not higher than $A_3$ point for 10 to 600 seconds, a step of cooling the steel sheet to a temperature of ($A_1$ point to 600° C.) at an average cooling rate of not lower than 20° C./s, a step of cooling the steel sheet to a temperature of not lower than 300° C. and not higher than 480° C. at an average cooling rate of not lower than 20° C./s, and a step of holding the steel sheet in said temperature range for 1 second or more.

16. A method of producing the high strength steel described in claim 1 wherein the base phase structure is tempered martensite or tempered bainite, the method comprising a hot rolling process, a tempering process, and a continuous annealing process or a plating process, the hot rolling process comprising a step of terminating finish rolling at a temperature of not lower than ($A_{r3}$−50)° C. and a step of cooling a resulting steel sheet to a temperature of not higher than Ms point or a temperature of not lower than Ms point and not higher than Bs point at an average cooling rate of not lower than 20° C./s, the tempering process comprising a step of tempering the steel sheet at a temperature of not lower than 400° C. and not higher than Ad point for a period of time of not shorter than 10 minutes and shorter than 2 hours, the continuous annealing process or the plating process comprising a step of holding the steel sheet at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

17. A method of producing the high strength steel sheet described in claim 1 wherein the base phase structure is tempered martensite or tempered bainite, the method comprising a hot rolling process, a cold rolling process, a first continuous annealing process, a tempering process, and a second continuous annealing process or a plating process, the first continuous annealing process comprising a step of holding a resulting steel sheet in a heated state at a temperature of not lower than $A_3$ point and a step of cooling the steel sheet to a temperature of not higher than Ms point or a temperature of not lower than Ms point and not higher than Bs point at an average cooling rate of not lower than 20° C./s, the tempering process comprising a step of tempering the steel sheet at a temperature of not lower than 400° C. and not higher than $A_{c1}$ point for a period of time of not shorter than 10 minutes and shorter than 2 hours, the second continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

18. A method of producing the high strength steel sheet described in claim 1 wherein the base phase structure comprises tempered martensite and ferrite or comprises tempered bainite and ferrite, the method comprising a hot rolling process, a tempering process, and a continuous annealing process or a plating process, the hot rolling process comprising a step of terminating finish rolling at a temperature of not lower than ($A_{r3}$−50)° C. and a step of cooling a resulting steel sheet to a temperature of not higher than Ms point or a temperature of not lower than Ms point and not higher than Bs point at an average cooling rate of not lower than 10° C./s and winding up the steel sheet, the tempering process comprising a step of tempering the steel sheet at a temperature of not lower than 400° C. and not higher than $A_1$ point for a period of time of not shorter than 10 minutes and shorter than 2 hours, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

19. The method of claim 18, wherein the hot rolling process comprises a step of terminating finish rolling at a temperature of not lower than ($A_{r3}$−50)° C., a step of cooling the steel sheet to a temperature in the range of 700±100° C. at an average cooling rate of not lower than 30° C./s, a step of cooling the steel sheet with air in said temperature range for 1 to 30 seconds, and a step of subsequently cooling the steel sheet to a temperature of not higher than Ms point or a temperature of not lower than Ms point and not higher than Bs point at an average cooling rate of not lower than 30° C./s and winding up the steel sheet.

20. The method of claim 18, wherein the continuous annealing process comprises a step of holding the steel sheet at a temperature of not lower than $A_1$ point and not higher than $A_3$ point for 10 to 600 seconds, a step of cooling the steel sheet to a temperature of ($A_1$ point to 600° C.) at an average cooling rate of not higher than 15° C./s, a step of cooling the steel sheet to a temperature of not lower than 300° C. and not higher than 480° C. at an average cooling rate of not lower than 20° C./s, and a step of holding the steel sheet in said temperature range for 1 second or more.

21. A method of producing the high strength steel described in claim 1 wherein the base phase structure comprises tempered martensite and ferrite or comprises tempered bainite and ferrite, the method comprising a hot rolling process, a cold rolling process, a first continuous annealing process, a tempering process, and a second continuous annealing process or a plating process, the first continuous annealing process comprising a step of holding a resulting steel sheet at a temperature of not lower than $A_1$ point and not higher than $A_3$ point and a step of cooling the steel sheet to a temperature of not higher than Ms point or a temperature of not lower than Ms point and not higher than Bs point at an average cooling rate of not lower than 10° C./s, the tempering process comprising a step of tempering the steel sheet at a temperature of not lower than 400° C. and not higher than $A_1$ point for a period of time of not shorter than 10 minutes and shorter than 2 hours, the second continuous annealing process or the plating process comprising a step of holding the steel sheet at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, and a step of holding the steel sheet in said temperature range for 1 second or more, and an optional plating step.

22. The method of claim 21, wherein the second continuous annealing process comprises a step of holding the steel sheet at a temperature of not lower than $A_1$ point and not higher than $A_3$ point for 10 to 600 seconds, a step of cooling the steel sheet to a temperature of ($A_1$ point to 600° C.) at an average cooling rate of not higher than 15° C./s, a step of cooling the steel sheet to a temperature of not lower than 300° C. and not higher than 480° C. at an average cooling rate of not lower than 20° C./s, and a step of holding the steel sheet in said temperature range for 1 second or more.

23. A method of producing the high strength steel sheet described in claim 2 wherein the base phase structure is tempered martensite or tempered bainite, the method comprising a hot rolling process and a continuous annealing process or a plating process to achieve tempering, the hot rolling process comprising a step of controlling a heat treatment temperature before hot rolling to a temperature in the range of 950° to 1100° C., a step of terminating finish rolling at a temperature of not lower than ($A_{r3}$−50)° C., and a step of cooling a resulting steel sheet to a temperature of not higher than Ms point or a temperature of not lower than Ms point and not higher than Bs point at an average cooling rate of not lower than 20° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

24. A method of producing the high strength steel sheet described in claim 3 wherein the base phase structure is tempered martensite or tempered bainite, the method comprising a hot rolling process, a cold rolling process, a first annealing process, and a second annealing process or a plating process to achieve tempering, the hot rolling process comprising a step of controlling a heat treatment temperature before hot rolling to a temperature in the range of 950° to 1100° C., the first continuous annealing process comprising a step of holding a resulting steel sheet in a heated state at a temperature of not lower than $A_3$ point and a step of cooling the steel sheet to a temperature of not higher than Ms point or a temperature of not lower than Ms point and not higher than Bs point at an average cooling rate of not lower than 20° C./s, the second continuous annealing step or the plating step comprising a step of holding the steel sheet at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

25. A method of producing the high strength steel sheet described in claim 2 wherein the base phase structure comprises tempered martensite and ferrite or comprises tempered bainite and ferrite, the method comprising a hot rolling process and a continuous annealing process or a plating process to achieve tempering, the hot rolling process comprising a step of controlling a heat treatment temperature before hot rolling to a temperature in the range of 950° to 1100° C., a step of terminating finish rolling at a temperature of not lower than $(A_{r3}-50)$° C., and a step of cooling the steel sheet to a temperature of not higher than Ms point or a temperature of not lower than Ms point and not higher than Bs point at an average cooling rate of not lower than 10° C./s and winding up the steel sheet, the continuous annealing process or the plating process comprising a step of holding the steel sheet in a heated state at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

26. The method of claim 25, wherein the hot rolling process comprises a step of controlling a heat treatment temperature before hot rolling to a temperature in the range of 950° to 1100° C., a step of terminating finish rolling at a temperature of not lower than $(A_{r3}-50)$° C., a step of cooling the steel sheet to a temperature in the range of 700±100° C. at an average cooling rate of 30° C./s, a step of cooling the steel sheet with air in said temperature range for 1 to 30 seconds, and a step of subsequently cooling the steel sheet to a temperature of not higher than Ms point or a temperature of not lower than Ms point and not higher than Bs point at an average cooling rate of not lower than 30° C./s and winding up the steel sheet.

27. The method of claim 25, wherein the continuous annealing process comprises a step of holding the steel sheet in a heated state at a temperature of not lower than $A_1$ point and not higher than $A_3$ point for 10 to 600 seconds, a step of cooling the steel sheet to a temperature of ($A_1$ point to 600° C.) at an average cooling rate of not higher than 15° C./s, a step of cooling the steel sheet to a temperature of not lower than 300° C. and not higher than 480° C. at an average cooling rate of not lower than 20° C./s, and a step of holding the steel sheet in said temperature range for 1 second or more.

28. A method of producing the high strength sheet described in claim 2 wherein the base phase structure comprises tempered martensite and ferrite or comprises tempered bainite and ferrite, the method comprising a hot rolling process, a cold rolling process, a first continuous annealing process, and a second continuous annealing process or a plating process to achieve tempering, the hot rolling process comprising a step of controlling a heat treatment temperature before hot rolling to a temperature in the range of 950° to 1100° C., the first continuous annealing process comprising a step of holding a resulting steel sheet in a heated state at a temperature of not lower than $A_1$ point and not higher than $A_3$ point and a step of cooling the steel sheet to a temperature of not higher than Ms point or a temperature of not lower than Ms point and not higher than Bs point at an average cooling rate of not lower than 10° C./s, the second continuous annealing process or the plating process comprising a step of holding the steel sheet at a temperature of not lower than $A_1$ point and not higher than $A_3$ point for 10 to 600 seconds, a step of cooling the steel sheet to a temperature of not lower than 300° C. and not higher than 480° C. at an average cooling rate of not lower than 3° C./s, a step of holding the steel sheet in said temperature range for 1 second or more, and an optional plating step.

29. The method of claim 28, wherein the second continuous annealing process comprises a step of holding the steel sheet in a heated state at a temperature of not lower than $A_1$ point and not higher than $A_3$ point for 10 to 600 seconds, a step of cooling the steel sheet to a temperature of ($A_1$ point to 600° C.) at an average cooling rate of not higher than 15 ° C./s, a step of cooling the steel sheet to a temperature of not lower than 300° C. and not higher than 480° C. at an average cooling rate of not lower than 20° C./s, and a step of holding the steel sheet in said temperature range for 1 second or more.

* * * * *